US009992836B2

(12) United States Patent
Girard et al.

(10) Patent No.: US 9,992,836 B2
(45) Date of Patent: Jun. 5, 2018

(54) METHOD, SYSTEM AND APPARATUS FOR ACTIVATING A LIGHTING MODULE USING A BUFFER LOAD MODULE

(71) Applicant: ARKALUMEN INC., Ottawa (CA)

(72) Inventors: Julien Girard, Gatineau (CA); Yan Vermette, Kanata (CA); Sean MacLean Murray, Ottawa (CA); Gerald Edward Briggs, Ottawa (CA)

(73) Assignee: ARKAWMEN INC., Ottawa (CA)

( * ) Notice: Subject to any disclaimer, the term of this patent is extended or adjusted under 35 U.S.C. 154(b) by 0 days. days.

(21) Appl. No.: 15/465,591

(22) Filed: Mar. 21, 2017

(65) Prior Publication Data

US 2018/0070419 A1 Mar. 8, 2018

Related U.S. Application Data

(63) Continuation-in-part of application No. 15/052,873, filed on Feb. 24, 2016, now Pat. No. 9,775,211.

(60) Provisional application No. 62/157,460, filed on May 5, 2015.

(51) Int. Cl.
*H05B 33/08* (2006.01)
*H05B 37/02* (2006.01)

(52) U.S. Cl.
CPC ..... *H05B 33/0845* (2013.01); *H05B 33/0857* (2013.01); *H05B 37/02* (2013.01)

(58) Field of Classification Search
None
See application file for complete search history.

(56) References Cited

U.S. PATENT DOCUMENTS

| | | | |
|---|---|---|---|
| 4,593,234 | A | 6/1986 | Yang |
| 5,006,782 | A | 4/1991 | Pelly |
| 5,237,264 | A | 8/1993 | Moseley et al. |
| 5,248,919 | A | 9/1993 | Hanna et al. |
| 5,783,909 | A | 7/1998 | Hochstein |
| 5,803,579 | A | 9/1998 | Turnbull et al. |
| 5,932,995 | A | 8/1999 | Wagoner |
| 5,949,539 | A | 9/1999 | Britton, Jr. et al. |
| 6,069,905 | A | 5/2000 | Davis et al. |
| 6,127,798 | A | 10/2000 | Lansang et al. |

(Continued)

FOREIGN PATENT DOCUMENTS

| | | | |
|---|---|---|---|
| CN | 201220626 | Y | 4/2009 |
| WO | WO-0113038 | A1 | 2/2001 |

*Primary Examiner* — Jany Richardson
(74) *Attorney, Agent, or Firm* — Sean Murray; Murray IP Consulting Inc

(57) ABSTRACT

Control apparatus and system for controlling an output of a constant current driver are disclosed. A control apparatus is coupled between a constant current driver and a load, such as a lighting module, in order to add functionality to the overall system. The control apparatus is powered by the constant current driver and may control the dimming of the constant current driver by controlling the 0-10V dim input into the driver. The control apparatus may comprise one or more switching elements between the constant current driver and the load to allow for mixing of groups of LEDs of various colors or color temperatures. The control apparatus may include a buffer load to mitigate negative impacts of turning on the lighting module after a period of deactivation. The control apparatus can also be adapted to operate as a dim-to-warm module within a lighting apparatus.

20 Claims, 37 Drawing Sheets

(56) References Cited

U.S. PATENT DOCUMENTS 6,150,774 A 11/2000 Mueller et al.
6,175,195 B1 1/2001 Janczak et al.
6,198,230 B1 3/2001 Leeb et al.
6,222,352 B1 4/2001 Lenk
6,307,331 B1 10/2001 Bonasia
6,351,079 B1 2/2002 Willis
6,400,482 B1 6/2002 Lupton et al.
6,426,599 B1 7/2002 Leeb
6,441,558 B1 8/2002 Muthu
6,445,139 B1 9/2002 Marshall et al.
6,495,964 B1 12/2002 Muthu et al.
6,504,633 B1 1/2003 Hovorka et al.
6,518,561 B1 2/2003 Miura
6,548,967 B1 4/2003 Dowling et al.
6,596,977 B2 7/2003 Muthu et al.
6,621,235 B2 9/2003 Chang
6,794,831 B2 9/2004 Leeb et al.
6,798,152 B2 9/2004 Rooke et al.
6,853,150 B2 2/2005 Clauberg et al.
6,894,442 B1 5/2005 Lim et al.
6,954,591 B2 10/2005 Lupton et al.
7,016,115 B1 3/2006 Leeb et al.
7,141,779 B1 11/2006 Chew et al.
7,233,115 B2 6/2007 Lys
7,256,554 B2 8/2007 Lys
7,265,681 B2 9/2007 Chen
7,319,298 B2 1/2008 Jungwirth et al.
7,321,203 B2 1/2008 Marosek
7,347,706 B1 3/2008 Wu et al.
7,352,135 B2 4/2008 Shiotsu et al.
7,457,089 B2 11/2008 Ohshima
7,486,032 B2 2/2009 Lee
7,495,425 B2 2/2009 Friedrich
7,498,754 B2 3/2009 Masood
7,511,463 B2 3/2009 Kumar
7,521,667 B2 4/2009 Rains et al.
7,633,577 B2 12/2009 Moon et al.
7,649,326 B2 1/2010 Johnson et al.
7,683,470 B2 3/2010 Lee et al.
7,683,504 B2 3/2010 Blair et al.
7,750,616 B2 7/2010 Liu
7,759,881 B1 7/2010 Melanson
7,847,783 B2 12/2010 Liu et al.
7,918,580 B2 4/2011 Liu
8,105,854 B2 1/2012 Lee et al.
8,193,737 B2 6/2012 Peker et al.
8,232,742 B2 7/2012 Briggs
8,247,975 B2 8/2012 Yoo et al.
8,248,439 B2 8/2012 Ran et al.
8,324,834 B2 12/2012 Wang et al.
8,358,085 B2 1/2013 Catalano et al.
8,552,659 B2 10/2013 Ashdown et al.
8,587,203 B2 11/2013 Chen et al.
8,681,192 B2 3/2014 Inoue et al.
8,766,162 B2 7/2014 Tanase
8,848,202 B2 9/2014 Dyer et al.
8,941,308 B2 1/2015 Briggs
9,089,024 B2 7/2015 Briggs et al.
9,185,754 B2 11/2015 Huang et al.
9,204,509 B2 12/2015 Sievers et al.
9,204,511 B2 12/2015 Esaki et al.
9,217,557 B2 12/2015 Briggs
9,345,109 B2 5/2016 Briggs
9,347,631 B2 5/2016 Briggs
2004/0119602 A1 6/2004 Blum et al.
2004/0263093 A1 12/2004 Matsubayashi et al.
2005/0127888 A1 6/2005 Marschalkowski et al.
2005/0156644 A1 7/2005 Karnahan et al.
2005/0173924 A1 8/2005 French
2005/0199841 A1 9/2005 O'Maley et al.
2005/0213353 A1 9/2005 Lys
2005/0225264 A1 10/2005 Kemp
2005/0269580 A1 12/2005 D'Angelo
2006/0044800 A1 3/2006 Reime
2006/0049782 A1* 3/2006 Vornsand ..... H05B 33/0869 315/312
2006/0109219 A1 5/2006 Robinson et al.
2006/0113975 A1 6/2006 Mednik et al.
2006/0239689 A1 10/2006 Ashdown
2007/0080911 A1 4/2007 Liu et al.
2007/0103086 A1 5/2007 Neudorf et al.
2007/0103832 A1 5/2007 Ohshima
2007/0159421 A1 7/2007 Peker et al.
2007/0182338 A1 8/2007 Shteynberg et al.
2007/0195552 A1 8/2007 Park
2007/0229047 A1 10/2007 Sigamani et al.
2007/0267978 A1 11/2007 Shteynberg et al.
2007/0268028 A1 11/2007 Moyer et al.
2007/0278974 A1 12/2007 Van De Ven
2008/0079705 A1 4/2008 Yang et al.
2008/0088769 A1 4/2008 Kim et al.
2008/0138085 A1 6/2008 Lin et al.
2008/0150449 A1 6/2008 Wang et al.
2008/0164826 A1 7/2008 Lys
2008/0180040 A1 7/2008 Prendergast et al.
2008/0191642 A1 8/2008 Slot et al.
2008/0224636 A1 9/2008 Melanson
2008/0238341 A1 10/2008 Korcharz et al.
2008/0252664 A1 10/2008 Huang et al.
2008/0272277 A1 11/2008 Wei
2009/0027652 A1 1/2009 Chang et al.
2009/0096392 A1 4/2009 Chandran et al.
2009/0134817 A1 5/2009 Jurngwirth et al.
2009/0160422 A1 6/2009 Isobe et al.
2009/0167194 A1 7/2009 Mizuta
2009/0174337 A1 7/2009 Miskin et al.
2009/0195168 A1 8/2009 Greenfield
2009/0195183 A1 8/2009 Yang
2009/0251059 A1 10/2009 Veltman
2009/0251071 A1 10/2009 Gater et al.
2009/0251934 A1 10/2009 Shteynberg et al.
2009/0322252 A1 12/2009 Shiu et al.
2009/0323342 A1 12/2009 Liu
2010/0019692 A1 1/2010 Kimura
2010/0026208 A1 2/2010 Shteynberg et al.
2010/0033146 A1 2/2010 Irissou et al.
2010/0033150 A1 2/2010 Irissou et al.
2010/0046210 A1 2/2010 Mathai et al.
2010/0060187 A1 3/2010 Newman et al.
2010/0066266 A1 3/2010 Huang et al.
2010/0066484 A1 3/2010 Hanwright et al.
2010/0072899 A1 3/2010 Engstrand
2010/0072902 A1 3/2010 Wendt et al.
2010/0079124 A1 4/2010 Melanson
2010/0100253 A1 4/2010 Fausek et al.
2010/0102230 A1 4/2010 Chang et al.
2010/0117450 A1 5/2010 Azrai et al.
2010/0156319 A1 6/2010 Melanson
2010/0164406 A1 7/2010 Kost et al.
2010/0171429 A1 7/2010 Garcia et al.
2010/0171442 A1 7/2010 Draper et al.
2010/0177127 A1 7/2010 Akiyama et al.
2010/0194308 A1 8/2010 Zhao et al.
2010/0244707 A1 9/2010 Gaines et al.
2010/0245289 A1 9/2010 Svajda
2010/0264834 A1 10/2010 Gaines et al.
2010/0277075 A1 11/2010 Rees
2010/0289424 A1 11/2010 Chang et al.
2010/0302477 A1 12/2010 Ohmi et al.
2010/0320936 A1 12/2010 Yao
2010/0320939 A1 12/2010 Lai
2011/0006691 A1 1/2011 Blaha et al.
2011/0050130 A1 3/2011 Rudolph
2011/0068703 A1 3/2011 McKinney
2011/0080110 A1 4/2011 Nuhfer et al.
2011/0086676 A1 4/2011 Choi et al.
2011/0101950 A1 5/2011 Babb
2011/0115394 A1 5/2011 Shteynberg et al.
2011/0115412 A1 5/2011 Welten
2011/0187313 A1 8/2011 Lee
2011/0193489 A1 8/2011 Moss
2011/0194047 A1 8/2011 Bruyneel et al.
2011/0200707 A1 8/2011 Kortes

(56) References Cited

U.S. PATENT DOCUMENTS

| | | | | |
|---|---|---|---|---|
| 2011/0227489 | A1* | 9/2011 | Huynh | H05B 33/083 315/185 R |
| 2011/0227492 | A1 | 9/2011 | Du et al. | |
| 2011/0248640 | A1 | 10/2011 | Welten | |
| 2011/0279040 | A1 | 11/2011 | Briggs et al. | |
| 2011/0279048 | A1 | 11/2011 | Briggs | |
| 2011/0279053 | A1 | 11/2011 | Briggs | |
| 2011/0279055 | A1 | 11/2011 | Briggs | |
| 2011/0279057 | A1 | 11/2011 | Briggs | |
| 2011/0298386 | A1 | 12/2011 | Corradi | |
| 2012/0146519 | A1 | 6/2012 | Briggs | |
| 2012/0223649 | A1* | 9/2012 | Saes | H05B 33/0818 315/186 |
| 2012/0262071 | A1 | 10/2012 | Briggs | |
| 2012/0262076 | A1 | 10/2012 | Briggs | |
| 2012/0268019 | A1 | 10/2012 | Briggs | |
| 2012/0312956 | A1 | 12/2012 | Chang et al. | |
| 2012/0320626 | A1 | 12/2012 | Quillici et al. | |
| 2013/0009561 | A1 | 1/2013 | Briggs | |
| 2013/0015774 | A1 | 1/2013 | Briggs | |
| 2013/0170263 | A1* | 7/2013 | Newman, Jr. | H02M 7/06 363/126 |
| 2013/0223058 | A1 | 8/2013 | Briggs | |
| 2013/0293722 | A1 | 11/2013 | Chen | |
| 2013/0297251 | A1 | 11/2013 | Engel-Hall et al. | |
| 2013/0300316 | A1 | 11/2013 | Engel-Hall et al. | |
| 2013/0301266 | A1 | 11/2013 | Poissonnet et al. | |
| 2016/0212804 | A1 | 7/2016 | Peeters et al. | |
| 2017/0231037 | A1 | 8/2017 | Briggs | |

* cited by examiner

METHOD, SYSTEM AND APPARATUS FOR ACTIVATING A LIGHTING MODULE USING A BUFFER LOAD MODULE

CROSS-REFERENCE TO RELATED APPLICATION

The present application is a continuation-in-part of and claims the benefit under 35 USC 120 of U.S. patent application Ser. No. 15/052,873 entitled "CIRCUIT AND APPARATUS FOR CONTROLLING A CONSTANT CURRENT DC DRIVER OUTPUT" by Briggs filed on Feb. 24, 2016 which claims the benefit under 35 USC 119(e) of U.S. Provisional Patent Application 62/157,460 filed on May 5, 2015. The present application hereby incorporated both patent applications by reference herein.

FIELD OF THE INVENTION

The invention relates generally to lighting controls and, more particularly, to method, system and apparatus for activating a lighting module using a buffer load module.

BACKGROUND

Light Emitting Diodes (LEDs) are increasingly being adopted as general illumination lighting sources due to their high energy efficiency and long service life relative to traditional sources of light such as incandescent, fluorescent and halogen. Each generation of LEDs are providing improvements in energy efficiency and cost per lumen, thus allowing for lighting manufacturers to produce LED light fixtures at increasingly competitive prices.

With the exception of relatively limited AC LED modules, LED modules typically operate using DC power with the current flowing through the LEDs dictating the lumens produced. In a typical LED light fixture, an AC to DC driver is implemented to convert AC power from the power grid to DC power that can be used to power the LEDs. In some cases, a constant voltage driver is used which will maintain a particular DC voltage. This architecture can work if the DC voltage of the driver is matched perfectly with the LED modules being used to ensure an appropriate current will flow through the LEDs to produce the desired output light intensity. Perfectly matching the DC voltage output of a constant voltage driver with a particular forward voltage for a series of LEDs is not simple and could add complexity to the design of the LED modules. Further, fluctuations in the forward voltage of LEDs will occur if thermal temperature changes occur and long wires used to connect the LED modules may increase voltage drops. These fluctuations will result in load requirements changing while the constant voltage driver maintains the same voltage output, thus causing fluctuations in the current flowing through the LEDs. The result of this situation is an inconsistent light output intensity which is not desired.

To overcome the problems with the use of constant voltage drivers with LEDs, it has become typical for light fixtures to be designed using AC to DC drivers that are constant current drivers. The constant current drivers, as their name indicates, output a constant current to the attached LED modules as long as the load has an operating voltage range within the acceptable limits of the driver. For instance, a constant current driver may be set to 700 mA with an operating voltage range of 12-24V. In this case, LED modules with a forward voltage of 21V will operate with a current of 700 mA. Typical constant current drivers use a feedback control mechanism to adjust the output voltage between a high power rail and a low power rail depending upon the current that is detected.

Due to their popularity in LED light fixtures, constant current drivers are decreasing in cost at a fast rate and becoming a commodity product. Key differentiators of different constant current drivers are their efficiency, wattage and flexibility. In terms of flexibility, some designs for constant current drivers allow for their output current to be programmed in using a programming tool (either wired or wireless). In some cases, a plurality of different outputs with different current levels may be output from the constant current drivers.

One control feature that is offered increasingly as a standard control feature within constant current drivers is 0-10V dimming 0-10V dimming is a system that typically interfaces with a wall mounted dimmer and allows a user to adjust the output current of the constant current driver and therefore the light intensity of the light fixture that the constant current driver is implemented. In normal implementations, the wall mounted dimmer acts effectively as a variable resistor and the constant current driver provides a very small current between grey and purple dimming wires that connect through the dimmer to detect a voltage drop. The level of the voltage drop can determine a desired dim level for the constant current driver. As a result, the constant current driver can adjust the desired output current to be provided to attached LED modules.

A problem with the commoditization of the constant current drivers is that there is little development on how to implement advanced control features using these simple AC to DC converters. Technologies have developed in lighting to allow for a wide range of control features to lower energy usage, increase user experience and/or communicate information to/from light fixtures. None of these features can easily be implemented using the simple constant current drivers that are becoming the standard components in LED light fixtures.

Against this background, there is a need for solutions that will mitigate at least one of the above problems, particularly enabling additional control features to be implemented using standard constant current drivers.

SUMMARY OF THE INVENTION

According to a first broad aspect, the present invention is a control apparatus adapted to be coupled between a power source and a lighting module. The power source is operable to generate an output voltage at a power source output. If the lighting module is coupled to the power source output, the power source is operable to generate a first output voltage to maintain a constant current level flowing through the lighting module and, if the lighting module is not coupled to the power source output, the power source is operable to generate a second output voltage at a maximum voltage limit for the power source. The control apparatus comprises a voltage control module and a controller. The voltage control module is adapted to be coupled to the power source output and is operable to convert the output voltage generated by the power source to a controlled voltage independent of whether the output voltage generated by the power source is the first output voltage or the second output voltage. The voltage control module has a maximum input voltage equal to or greater than the maximum voltage limit of the power source. The controller is powered by the controlled voltage and operable to selectively couple the lighting module to the power source output.

In some embodiments, the control apparatus further comprises a switching element adapted to be coupled between the power source output and the lighting module. The switching element is operable to be activated and deactivated in response to a channel control signal and the controller is operable to generate the channel control signal. If the switching element is activated, the lighting module is coupled to the power source output and, if the switching element is deactivated, the lighting module is not coupled to the power source output.

In some embodiments, the lighting module comprises a first group of LEDs comprising one or more first LEDs coupled in series and a second group of LEDs comprising one or more second LEDs coupled in series. The controller can be operable to selectively couple the first and second groups of LEDs to the power source output at different time segments within a cycle. The control apparatus may further comprise a first switching element adapted to be coupled between the power source output and the first group of LEDs of the lighting module and a second switching element adapted to be coupled between the power source output and the second group of LEDs of the lighting module. The first switching element may be operable to be activated and deactivated in response to a first channel control signal and the second switching element may be operable to be activated and deactivated in response to a second channel control signal and the controller may be operable to generate the first and second channel control signals. In this case, if the first switching element is activated, the first group of LEDs is coupled to the power source output and, if the second switching element is activated, the second group of LEDs is coupled to the power source output. The first and second channel control signals may be substantially opposite; such that the second switching element is deactivated when the first switching element is activated and the first switching element is deactivated when the second switching element is activated.

In some embodiments, the controller is operable to couple the first group of LEDs to the power source output for a first time period within a cycle and to couple the second group of LEDs to the power source output for a second time period within the cycle, wherein the first and second time periods do not overlap and light emitted by the lighting module includes a mix of light emitted from the first and second groups of LEDs based upon a ratio of the first and second time periods within the cycle. In some implementations, the controller may be operable to receive a control signal with an indication of a desired color temperature and to determine the first and second time periods within the cycle to couple the first and second groups of LEDs to the power source output based at least partially in response to the indication of the desired color temperature. In other implementations, the controller may be operable to determine an indication of the constant current level maintained by the power source when the lighting module is coupled to the power source output and to determine the first and second time periods within the cycle to couple the first and second groups of LEDs to the power source output at least partially in response to the indication of the constant current level maintained by the power source. The controller may further be operable to determine a first ratio of the indication of the constant current level maintained by the power source to an indication of a maximum constant current level and to determine the first and second time periods within the cycle to couple the first and second groups of LEDs to the power source output at least partially in response to the first ratio.

According to a second broad aspect, the present invention is a system adapted to be coupled to a load module, the system comprising a power source a control apparatus. The power source is operable to generate an output voltage at a power source output. If the load module is coupled to the power source output, the power source is operable to generate a first output voltage to maintain a constant current level flowing through the load module and, if the load module is not coupled to the power source output, the power source is operable to generate a second output voltage at a maximum voltage limit for the power source. The control apparatus is operable to selectively couple the load module to the power source output. The control apparatus is powered by the first output voltage when the lighting module is coupled to the power source output and is powered by the second output voltage when the lighting module is not coupled to the power source output. The control apparatus has a maximum input voltage equal to or greater than the maximum voltage limit of the power source.

In some embodiments, the control apparatus comprises a voltage control module and a controller. The voltage control module is adapted to be coupled to the power source output and operable to convert the output voltage generated by the power source to a controlled voltage independent of whether the output voltage generated by the power source is the first output voltage or the second output voltage. The voltage control module has a maximum input voltage equal to or greater than the maximum voltage limit of the power source. The controller is powered by the controlled voltage and operable to selectively couple the load module to the power source output. Further, in some embodiments, the system further comprises a switching element adapted to be coupled between the power source output and the load module. The switching element is operable to be activated and deactivated in response to a channel control signal and the control apparatus is operable to generate the channel control signal. In this case, if the switching element is activated, the load module is coupled to the power source output and, if the switching element is deactivated, the load module is not coupled to the power source output.

In another aspect, the present invention is a lighting apparatus incorporating the system of the second broad aspect and further comprising a lighting module comprising a first group of LEDs comprising one or more first LEDs coupled in series and a second group of LEDs comprising one or more second LEDs coupled in series. In this case, the control apparatus is operable to selectively couple the first and second groups of LEDs to the power source output during different time segments within a cycle. In some embodiments, the control apparatus comprises a first switching element coupled between the power source output and the first group of LEDs of the lighting module and a second switching element coupled between the power source output and the second group of LEDs of the lighting module. The first switching element may be operable to be activated and deactivated in response to a first channel control signal and the second switching element may be operable to be activated and deactivated in response to a second channel control signal and the control apparatus may operable to generate the first and second channel control signals. In this case, if the first switching element is activated, the first group of LEDs is coupled to the power source output and, if the second switching element is activated, the second group of LEDs is coupled to the power source output. In some implementations, the first and second channel control signals are substantially opposite such that the second switching element is deactivated when the first switching element is activated and the first switching element is deactivated when the second switching element is activated.

In some implementations, the first and second groups of LEDs are implemented on a single physical element with the first group of LEDs intertwined with the second group of LEDs such that light emitted from the first and second groups of LEDs mix. Further, in some embodiments, the first group of LEDs comprise LEDs of a first color temperature and the second group of LEDs comprise LEDs of a second color temperature different than the first color temperature. In this case, the control apparatus may be operable to couple the first group of LEDs to the power source output for a first time period within a cycle and to couple the second group of LEDs to the power source output for a second time period within the cycle, such that the first and second time periods do not overlap and light emitted by the lighting module includes a mix of light emitted from the first and second groups of LEDs based upon a ratio of the first and second time periods within the cycle. In some implementations, the control apparatus is operable to receive a control signal with an indication of a desired color temperature and to determine the first and second time periods within the cycle to couple the first and second groups of LEDs to the power source output at least partially in response to the desired color temperature. In other implementations, the control apparatus is operable to determine an indication of the constant current level maintained by the power source if the load module is coupled to the power source output and to determine the first and second time periods within the cycle to couple the first and second groups of LEDs to the power source output at least partially in response to the indication of the constant current level maintained by the power source. In some embodiments, the control apparatus is operable to determine a first ratio of the indication of the constant current level maintained by the power source to an indication of a maximum constant current level and to determine the first and second time periods within the cycle to couple the first and second groups of LEDs to the power source output at least partially in response to the first ratio.

According to a third broad aspect, the present invention is a control apparatus adapted to be coupled between a power source and a lighting module. The power source is operable to generate an output voltage at a power source output; and, if the lighting module is coupled to the power source output, the power source is operable to generate a first output voltage to maintain a constant current level flowing through the lighting module; and, if the lighting module is not coupled to the power source output, the power source is operable to generate a second output voltage at a maximum voltage limit. The control apparatus comprises a buffer load module and a controller. The buffer load module has a forward voltage less than the maximum voltage limit if current at the constant current level is flowing through the buffer load module. The controller is operable to selectively couple the lighting module to the power source output. After a period of deactivation in which the lighting module is not coupled to the power source output and the power source is generating the second output voltage at the maximum voltage limit, the controller is operable to selectively couple the buffer load module to the power source output during a buffer mode and subsequently to couple the lighting module to the power source. The output voltage generated by the power source is reduced from the maximum voltage limit during the buffer mode.

In some embodiments, the control apparatus further comprises a voltage control module adapted to be coupled to the power source output and operable to convert the output voltage generated by the power source to a controlled voltage independent of whether the output voltage generated by the power source is the first output voltage or the second output voltage. In this case, the voltage control module has a maximum input voltage equal to or greater than the maximum voltage limit of the power source and the controller is powered by the controlled voltage.

In some embodiments, the control apparatus further comprises a first switching element adapted to be coupled between the power source output and the buffer load module and operable to be activated and deactivated in response to a buffer control signal; and a second switching element adapted to be coupled between the power source output and the lighting module and operable to be activated and deactivated in response to a channel control signal. In this case, the controller may be operable to generate the buffer control signal and the channel control signal; such that the controller is operable to activate the first switching element using the buffer control signal to couple the buffer load module to the power source output during the buffer mode. The controller may be operable to selectively couple the buffer load module to the power source output for a buffer time period in each of a plurality of cycles during the buffer mode, wherein the buffer time periods over the plurality of cycles during the buffer mode are controlled by a duty cycle of the buffer control signal. In some implementations, the duty cycle of the buffer control signal may increase over the plurality of cycles during the buffer mode; such that the buffer time periods increase over the plurality of cycles during the buffer mode. In other implementations, the duty cycle of the buffer control signal may increase over a plurality of cycles during a first phase of the buffer mode and the duty cycle of the buffer control signal may decrease over a plurality of cycles during a second phase of the buffer mode. In this case, the buffer time periods increase over the plurality of cycles during the first phase of the buffer mode and decrease over the plurality of cycles during the second phase of the buffer mode.

In some embodiments, the controller is operable to selectively couple the lighting module to the power source output for a channel time period in each of the plurality of cycles during the second phase of the buffer mode. In this case, the channel time periods over the plurality of cycles during the second phase of the buffer mode are controlled by a duty cycle of the channel control signal. The duty cycle of the channel control signal increases over the plurality of cycles during the second phase of the buffer mode; such that the channel time periods increase over the plurality of cycles during the second phase of the buffer mode. In some implementations, the buffer control signal and the channel control signal are substantially opposite during the second phase of the buffer mode; such that the second switching element is deactivated when the first switching element is activated and the first switching element is deactivated when the second switching element is activated.

In some embodiments, the second switching element is adapted to be coupled between the power source output and a first group of LEDs of the lighting module, the channel control signal is a first channel control signal, and the control apparatus further comprises a third switching element adapted to be coupled between the power source output and a second group of LEDs of the lighting module and operable to be activated and deactivated in response to a second channel control signal. In this case, the controller may be operable to select one of the first and second groups of LEDs to selectively couple to the power source output during the buffer mode and the controller may be operable to selectively couple the selected group of LEDs to the power source output for a channel time period in each of the plurality of cycles during the second phase of the buffer mode. The channel time periods over the plurality of cycles during the second phase of the buffer mode may be controlled by a duty cycle of the channel control signal corresponding to the selected group of LEDs. The duty cycle of the channel control signal corresponding to the selected group of LEDs may increase over the plurality of cycles during the second phase of the buffer mode; such that the channel time periods increase over the plurality of cycles during the second phase of the buffer mode. In some implementations, the controller may be operable to receive an indication of a desired color temperature for light emitted from the lighting module and the controller may use the indication of the desired color temperature to select one of the first and second groups of LEDs to selectively couple to the power source output during the buffer mode.

According to a fourth broad aspect, the present invention is a method of coupling a power source to a lighting module. The power source is operable to generate an output voltage at a power source output; and, if the lighting module is coupled to the power source, the power source is operable to generate a first output voltage to maintain a constant current level flowing through the lighting module; and, if the lighting module is not coupled to the power source, the power source is operable to generate a second output voltage at a maximum voltage limit. The method comprises, after a period of deactivation in which the lighting module is not coupled to the power source output and the power source is generating the second output voltage at the maximum voltage limit, selectively coupling a buffer load module to the power source output during a buffer mode. The buffer load module has a forward voltage less than the maximum voltage limit if current at the constant current level is flowing through the buffer load module. The method further comprises subsequently coupling the lighting module to the power source output. The output voltage generated by the power source is reduced from the maximum voltage limit during the buffer mode.

In some embodiments, the method further comprises generating a buffer control signal for controlling coupling between the power source output and the buffer load module and a channel control signal for controlling coupling between the power source output and the lighting module. In this case, the step of selectively coupling the buffer load module to the power source output may be for a buffer time period in each of a plurality of cycles during the buffer mode and the buffer time periods over the plurality of cycles during the buffer mode may be controlled by a duty cycle of the buffer control signal. In one implementation, the duty cycle of the buffer control signal may increase over the plurality of cycles during the buffer mode; such that the buffer time periods increase over the plurality of cycles during the buffer mode. In another implementation, the duty cycle of the buffer control signal may increase over a plurality of cycles during a first phase of the buffer mode and the duty cycle of the buffer control signal may decrease over a plurality of cycles during a second phase of the buffer mode; such that the buffer time periods increase over the plurality of cycles during the first phase of the buffer mode and decrease over the plurality of cycles during the second phase of the buffer mode.

In some embodiments, the method further comprises selectively coupling the lighting module to the power source output for a channel time period in each of the plurality of cycles during the second phase of the buffer mode. In this case, the channel time periods over the plurality of cycles during the second phase of the buffer mode may be controlled by a duty cycle of the channel control signal. The duty cycle of the channel control signal may increase over the plurality of cycles during the second phase of the buffer mode; such that the channel time periods increase over the plurality of cycles during the second phase of the buffer mode. In some implementations, the buffer control signal and the channel control signal are substantially opposite during the second phase of the buffer mode; such that the lighting module is not coupled to the power source output when the buffer load module is coupled to the power source output and the buffer load module is not coupled to the power source output when the lighting module is coupled to the power source output.

In some embodiments, generating a channel control signal for controlling coupling between the power source output and the lighting module comprises generating a first channel control signal for controlling coupling between the power source output and a first group of LEDs of the lighting module and generating a second channel control signal for controlling coupling between the power source output and a second group of LEDs of the lighting module. In this case, the method may further comprise selecting one of the first and second groups of LEDs to selectively couple to the power source output during the buffer mode; and selectively coupling the selected group of LEDs to the power source output for a channel time period in each of the plurality of cycles during the second phase of the buffer mode. The channel time periods over the plurality of cycles during the second phase of the buffer mode may be controlled by a duty cycle of the channel control signal corresponding to the selected group of LEDs. In this case, the duty cycle of the channel control signal corresponding to the selected group of LEDs may increase over the plurality of cycles during the second phase of the buffer mode; such that the channel time periods increase over the plurality of cycles during the second phase of the buffer mode. In one implementation, the method may further comprise receiving an indication of a desired color temperature for light emitted from the lighting module. In this case, the indication of the desired color temperature may be used in selecting one of the first and second groups of LEDs to selectively activate during the buffer mode.

According to a fifth broad aspect, the present invention is a system adapted to be coupled to a lighting module comprising a power source, a buffer load and a controller. The power source is operable to generate an output voltage at a power source output; and, if the lighting module is coupled to the power source output, the power source operable to generate a first output voltage to maintain a constant current level flowing through the lighting module; and, if the lighting module is not coupled to the power source output, the power source operable to generate a second output voltage at a maximum voltage limit. The buffer load module has a forward voltage less than the maximum voltage limit if current at the constant current level is flowing through the buffer load module. The controller is operable to selectively couple the lighting module to the power source output. After a period of deactivation in which the lighting module is not coupled to the power source output and the power source is generating the second output voltage at the maximum voltage limit, the controller is operable to selectively couple the buffer load module to the power source output during a buffer mode and subsequently to couple the lighting module to the power source. The output voltage generated by the power source is reduced from the maximum voltage limit during the buffer mode.

In another aspect, the present invention is a lighting apparatus incorporating the system according to the fifth broad aspect and further comprising the lighting module. The lighting module comprises a first group of LEDs comprising one or more first LEDs of a first type coupled in series and a second group of LEDs comprising one or more second LEDs of a second type different than the first type coupled in series. Subsequent to completion of the buffer mode, the controller is operable to selectively couple the first and second groups of LEDs to the power source output at different time segments within a cycle.

According to a sixth broad aspect, the present invention is a lighting apparatus comprising a power source, a lighting module and a control apparatus. The power source is operable to generate an output voltage across first and second output nodes to maintain a constant current level flowing between the first and second output nodes when a load is coupled. The lighting module comprises a first group of LEDs comprising one or more first LEDs coupled in series and a second group of LEDs comprising one or more second LEDs coupled in series. The control apparatus is coupled between the power source and the lighting module. The control apparatus is operable: to determine a first indication of the constant current level flowing between the first and second output nodes of the power source; to determine a first activation ratio in which to activate the first and second groups of LEDs each cycle period based upon the first indication of the constant current level; and to selectively couple the first and second groups of LEDs in series between the first and second output nodes of the power source each cycle period based upon the first activation ratio.

According to a seventh broad aspect, the present invention is a control apparatus adapted to be coupled between a power source and a lighting module. The power source is operable to generate a voltage across first and second output nodes to maintain a constant current level flowing between the first and second output nodes when a load is coupled. The lighting module comprises a first group of LEDs comprising one or more first LEDs coupled in series and a second group of LEDs comprising one or more second LEDs coupled in series. The control apparatus comprises a controller operable to determine a first indication of the constant current level flowing between the first and second output nodes of the power source; to determine a first activation ratio in which to activate the first and second groups of LEDs each cycle period based upon the first indication of the constant current level; and to selectively couple the first and second groups of LEDs in series between the first and second output nodes of the power source each cycle period based upon the first activation ratio.

In some embodiments, the controller is further operable: to determine a second indication of the constant current level flowing between the first and second output nodes of the power source, the first and second indications being different; to determine a second activation ratio in which to activate the first and second groups of LEDs each cycle period based upon the second indication of the constant current level; and to selectively couple the first and second groups of LEDs in series between the first and second output nodes of the power source each cycle period based upon the second activation ratio.

In some implementations, the control apparatus may comprise a voltage control module adapted to be coupled to the first and second output nodes and operable to generate a controlled voltage independent of the voltage generated by the power source across the first and second output nodes. In this case, the controller may be powered by the controlled voltage. In some implementations, the control apparatus may comprise a current sense resistor adapted to be coupled between one of the first and second output nodes of the power source and the lighting module and the control apparatus may be operable to sense a voltage across the current sense resistor to determine the first indication of the constant current level flowing between the first and second output nodes of the power source. In some cases, the first group of LEDs may comprise LEDs of a first color temperature and the second group of LEDs may comprise LEDs of a second color temperature different than the first color temperature. Based on the activation ratio, the control apparatus may be operable to couple the first group of LEDs in series between the first and second output nodes of the power source for a first time period within a cycle and to couple the second group of LEDs in series between the first and second output nodes of the power source for a second time period within the cycle, such that the first and second time periods do not overlap and light emitted by the lighting module includes a mix of light emitted from the first and second groups of LEDs based upon the first activation ratio.

In one implementation, the controller may be operable to look-up the first activation ratio from a storage location using the first indication of the constant current level flowing between the first and second output nodes of the power source. In another implementation, the controller may be operable to determine an indication of a maximum constant current level for the power source based upon indications of constant current levels flowing between the first and second output nodes of the power source determined over time. In this case, to determine the first activation ratio in which to activate the first and second groups of LEDs each cycle period, the controller may use the first indication of the constant current level and the indication of the maximum constant current level for the power source.

In some embodiments, the control apparatus may comprise a first switching element adapted to be coupled between the power source and the first group of LEDs of the lighting module and a second switching element adapted to be coupled between the power source and the second group of LEDs of the lighting module. In this case, the first switching element may be operable to be activated and deactivated in response to a first channel control signal and the second switching element may be operable to be activated and deactivated in response to a second channel control signal. The controller may be operable to generate the first and second channel control signals based upon the first activation ratio; such that, if the first switching element is activated, the first group of LEDs is coupled in series between the first and second output nodes of the power source and, if the second switching element is activated, the second group of LEDs is coupled in series between the first and second output nodes of the power source. In some implementations, the first and second channel control signals may be substantially opposite; such that the second switching element is deactivated when the first switching element is activated and the first switching element is deactivated when the second switching element is activated.

According to an eighth broad aspect, the present invention is a method for emitting a particular color temperature light from a lighting apparatus. The lighting apparatus comprises a power source and a lighting module. The power source is operable to generate a voltage across first and second output nodes to maintain a constant current level flowing between the first and second output nodes when a load is coupled. The lighting module comprises a first group of LEDs comprising one or more first LEDs coupled in series and a second group of LEDs comprising one or more second LEDs coupled in series. The method comprises: determining a first indication of the constant current level flowing between the first and second output nodes of the power source; determining a first activation ratio in which to activate the first and second groups of LEDs each cycle period based upon the first indication of the constant current level; and selectively coupling the first and second groups of LEDs in series between the first and second output nodes each cycle period based upon the first activation ratio. In some cases, the method further comprises: determining a second indication of the constant current level flowing between the first and second output nodes of the power source, the first and second indications being different; determining a second activation ratio in which to activate the first and second groups of LEDs each cycle period based upon the second indication of the constant current level; and selectively coupling the first and second groups of LEDs in series between the first and second output nodes each cycle period based upon the second activation ratio.

In some embodiments, determining the first activation ratio in which to activate the first and second groups of LEDs each cycle period may comprise looking up the first activation ratio from a storage location using the first indication of the constant current level flowing between the first and second output nodes of the power source. In other embodiments, the method may further comprise determining an indication of a maximum constant current level for the power source based upon indications of constant current levels flowing between the first and second output nodes of the power source determined over time. In this case, determining the first activation ratio in which to activate the first and second groups of LEDs each cycle period may comprise using the first indication of the constant current level and the indication of the maximum constant current level for the power source to determine the first activation ratio.

These and other aspects of the invention will become apparent to those of ordinary skill in the art upon review of the following description of certain embodiments of the invention in conjunction with the accompanying drawings.

BRIEF DESCRIPTION OF THE DRAWINGS

A detailed description of embodiments of the invention is provided herein below, by way of example only, with reference to the accompanying drawings, in which.

It is to be expressly understood that the description and drawings are only for the purpose of illustration of certain embodiments of the invention and are an aid for understanding. They are not intended to be a definition of the limits of the invention.

DETAILED DESCRIPTION OF EMBODIMENTS

The present invention is directed to circuit and apparatus for controlling an output of a constant current driver. A control apparatus is coupled between a constant current driver and a load, such as a lighting module, in order to add functionality to the overall system. The control apparatus is powered by the constant current driver and may control the dimming of the constant current driver by controlling the 0-10V dim input into the driver. The control apparatus may comprise one or more switching elements between the constant current driver and the load. The control apparatus may interface with external devices or communication networks in order to receive control commands or information that may be used for control purposes. Overall, the control apparatus is implemented into the system to enable added-value features that the constant current driver would otherwise not be able to implement.

The embodiments described are directed to implementations of constant current drivers that power lighting modules and lighting modules implemented with Light Emitting Diodes (LEDs) in particular. It should be understood that the addition of a control apparatus to a constant current driver as described could be implemented in other technology areas and the scope of the present invention should not be limited to lighting modules and LED lighting modules in particular. Other loads, including potentially other lighting components, that require a constant current input could benefit from the added control features that may be enabled with the control apparatus of the present invention.

Figure 1A:
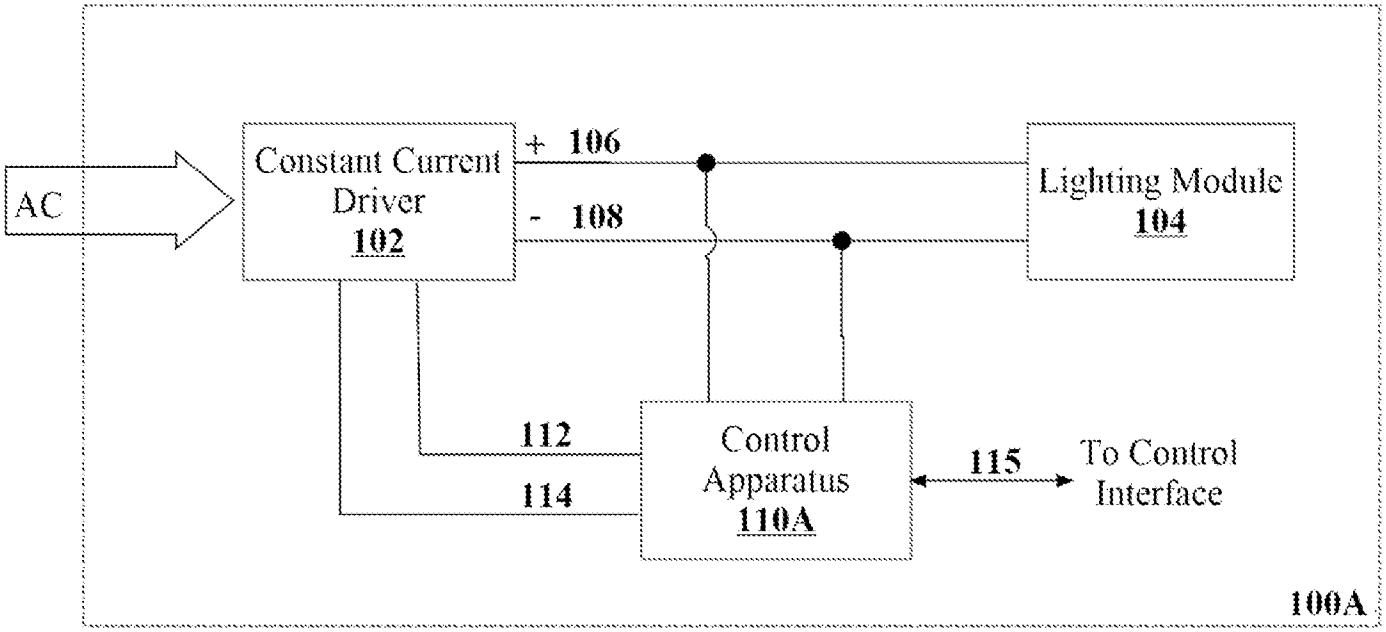
FIGS. 1A to 1E are block diagrams of a lighting apparatus including control apparatus according to various embodiments of the present invention.

FIGS. 1A to 1E are block diagrams of lighting apparatus 100A, 100B, 100C, 100D, 100E including control apparatus 110A, 110B, 110C, 110D, 110E respectively according to various embodiments of the present invention. As depicted in FIG. 1A, lighting apparatus 100A comprises a constant current driver 102 coupled to a lighting module 104 via positive and negative rails 106, 108. The lighting apparatus 100A further comprises a control apparatus 110A also coupled to the positive and negative rails 106, 108 and further coupled to dimming inputs 112, 114 of the constant current driver 102 and to a control interface via connection 115.

The constant current driver 102 may take many forms with various wattages, current settings or other technical specifications. Constant current drivers are well known and are utilized extensively in lighting apparatus. The constant current driver 102 of FIG. 1A has inputs connected to an AC power source such as the power grid and has positive and negative terminals that connect to positive rail 106 and negative rail 108 respectively. When the rails 106, 108 are coupled to a load, the constant current driver 102 adjusts the voltage across the positive and negative rails 106, 108 in order to attempt to maintain a particular current through the load. The constant current driver 102 will typically have a high and low voltage limit for adjusting the voltage to across the positive and negative rails 106, 108. The actual voltage across the positive and negative rails 106, 108 to achieve the particular current through the load depends upon the load. In some cases, even at the maximum voltage limit for the constant current driver 102, the load will not draw sufficient current to achieve the particular current for the constant current driver 102. In this case, the voltage across the positive and negative rails 106, 108 will be at the maximum voltage limit and the current through the load may be lower than the particular current for the constant current driver 102. In other cases, even at the minimum voltage limit for the constant current driver 102, the load would draw a higher current than the particular current for the constant current driver 102. In this case, the constant current driver 102 may go into a safety mode and turn off, thus preventing a short circuit condition across the positive and negative rails 106, 108. In an alternative implementation, the constant current driver 102 may be a DC-DC driver and may be connected to a DC power source such as an AC/DC constant voltage driver or a battery apparatus.

The constant current driver 102 further has two dimming terminals coupled to nodes 112, 114. The dimming terminals, in normal operation, could be standard 0-10V dimming terminals that typically would be used to connect to an off-the-shelf 0-10V dimming apparatus such as a wall mounted dimmer. In normal operation, the 0-10V dimming apparatus would be implemented between the dimming terminals and set a variable resistance between the dimmin terminals. The constant current driver 102 can measure the voltage drop across the dimming terminals and use this voltage drop as an indication of the setting of the 0-10V dimming apparatus and the desired dim level for the driver 102. The constant current driver 102 can then adjust the particular current output from the driver 102 based on the measured voltage drop across the dimming terminals. In this architecture, the dimming terminals may be associated with purple and grey wires. In other embodiments, other dimming architectures could be used that enable the driver 102 to receive indications of a dimming level from a user. In further embodiments, the constant current driver 102 may not be a dimmable driver and therefore the dimming terminals are not implemented.

The lighting module 104 may be implemented in a wide variety of different manners. In one case, the lighting module 104 may comprise a plurality of sets of LEDs coupled in parallel, each set of LEDs comprising a plurality of LEDs. In one particular implementation, the lighting module 104 may be designed to operate at 21-24V and comprise a plurality of parallel sets of seven LEDs in series. In another implementation, the lighting module 104 may be designed to operate at a different forward voltage such as 12V, 30V, 48V, 60V or any other voltage as may be preferred. For the constant current driver 102 to operate properly with the lighting module 104, the forward voltage of the lighting module 104 should be between the minimum and maximum voltage limits for the constant current driver 102. It should be understood that other architectures for a lighting module 104 may be implemented such as a lighting module not using LEDs or a lighting module that includes additional components than only LEDs. For instance, resistors, diodes and/or switches may be implemented within the lighting module 104.

Figure 2A:
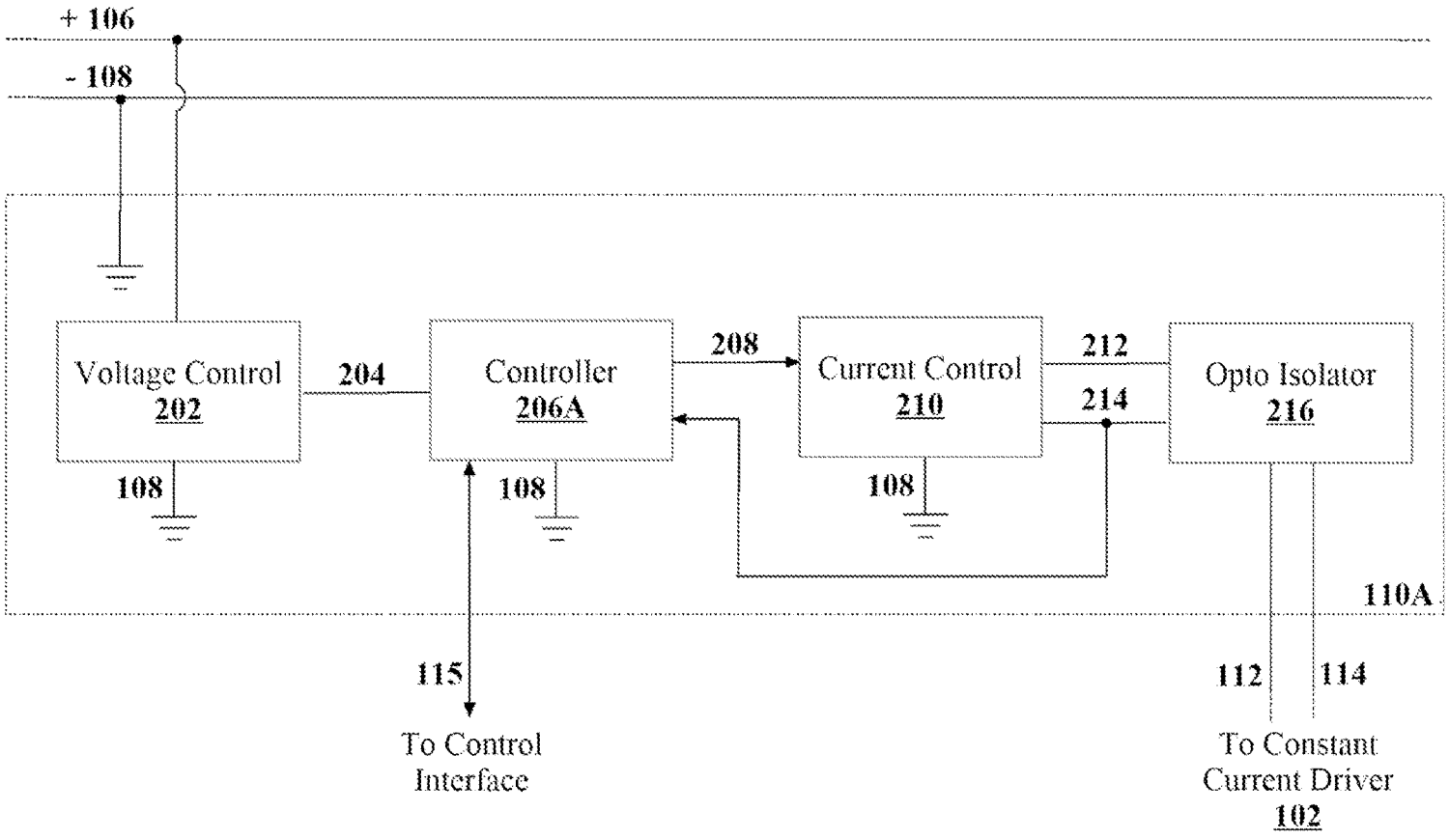
FIGS. 2A to 2E are block diagrams of the control apparatus of FIGS. 1A to 1D according to various embodiments of the present invention.

The control apparatus 110A according to one embodiment of the present invention is illustrated in FIG. 2A. As shown, the control apparatus 110A comprises a voltage control module 202 coupled to the positive and negative rails 106, 108 that outputs a controlled voltage on line 204 to a controller 206A. The controller 206A is grounded by the negative rail 108 and outputs a control signal on node 208 to a current control module 210. The controller 206A may further interface with a control interface via connection 115. The control apparatus 110A further comprises a current control module 210 that receives the control signal on node 208 and sets a particular current to flow from node 212 to node 214 and an opto isolator 216 that generates a virtual resistance between nodes 112, 114 based upon the current flowing from node 212 to node 214. The controller 206A further has a feedback input connected to node 214 in order to determine the particular current flowing from node 212 to node 214.

Figure 4B:
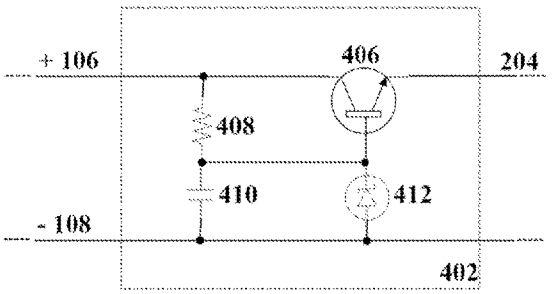
FIG. 4B is a sample circuit diagram of a voltage controller of the voltage control apparatus of FIG. 4A.
Figure 4A:
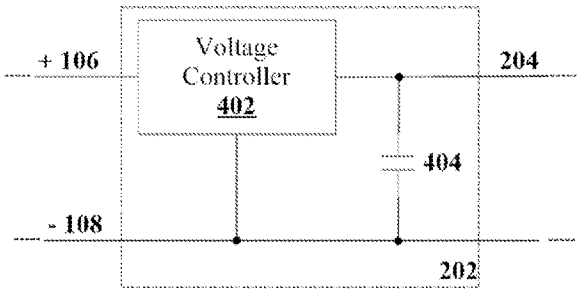
FIG. 4A is a sample circuit diagram of a voltage control apparatus of the control apparatus of FIGS. 2A to 2D.

The voltage control module 202 is operable to manage a wide range of input voltages across the positive and negative rails 106, 108 and outputs the controlled voltage on line 204 independent of the voltage across the positive and negative rails 106, 108. The voltage control module 202 in some embodiments may output a 5V output to the controller 206A. In one embodiment as depicted in FIG. 4A, the voltage control module 202 may comprise a voltage regulator 402 and a capacitor 404 coupled between the line 204 and the negative rail 108. The capacitor 404 is operable to stabilize the output of the voltage regulator 402 and ensure a more controlled voltage on line 204 independent of the voltage across the positive and negative rails 106, 108. In one embodiment, the capacitor 404 may be set to a value of 1 μF.

In the design of FIG. 1A, the voltage control module 202 may be designed to be input with voltages up to the maximum forward voltage of the lighting module 104. In other embodiments as will be described with FIG. 1B to 1E, it is important for the voltage control module 202 to be capable to input voltages up to the maximum limit of the voltage output from the constant current driver 102. If the lighting module 104 is disconnected from the constant current driver 102 and the only load on the constant current driver 102 is the control apparatus 110A or similar, the constant current driver 102 may output its maximum voltage limit in an attempt to output the particular current for the driver 102. The voltage control module 202 should be designed to be able to input this maximum voltage limit.

The voltage regulator 402 may comprise an LDO regulator though may be implemented in a different manner. For instance, the voltage regulator 402 may comprise a low loss buck converter (not shown). In some embodiments, the voltage regulator 402 may comprise discrete components. In the case depicted in FIG. 4B, the voltage regulator 402 comprises an NPN bipolar junction transistor 406 implemented with its collector coupled to the positive rail 106, its emitter coupled to the line 204, and its base coupled via a resistor 408 to the positive rail 106 and to the negative rail 108 via a capacitor 410. Further, the voltage regulator 402 of FIG. 4B comprises a zener diode 412 with its anode coupled to the negative rail 108 and its cathode coupled to the base of the transistor 406. Using the voltage regulator 402 of FIG. 4B may allow for a more flexible design than using an off-the-shelf voltage regulator chip. In particular, the values, power capacities, voltage limitations and/or tolerances of the discrete components utilized within the voltage regulator 402 of FIG. 4B may be selected to ensure the voltage control module 202 can manage the range of voltages potentially output from the constant current driver 102, including the maximum voltage limit for the constant current driver 102. In one implementation, the resistor 408 may have a value of 2 kΩ with a 1 W or higher power capacity and the capacitor 410 may be a 50V 1 μF ceramic capacitor. It should be understood that other values for components could be used and other architectures for a voltage regulator could be used to generate a particular voltage on line 204.

The controller 206A may be implemented as a microcontroller that operates at a controlled voltage such as 5V (or other voltages such as 3V) and outputs a variable Pulse Width Modulation (PWM) signal as the control signal on node 208. The controller 206A may receive information or commands from a control interface (not shown) via connection 115. Various different potential control interfaces will be described with reference to FIG. 5A. In various implementations, the controller 206A may receive information via the connection 115 including but not limited to: motion sense information, occupancy sense information, measured light level information, ambient light information, measured light color/color temperature information, humidity information, accelerometer information, geo-positioning information, audio information, infrared remote commands, dimming apparatus interfaces, signals over visible light, and data input from a communication protocol such as DMX, DALI, Zwave, ZigBee (including but not limited to ZigBee Home Automation and Zigbee Light Link), Bluetooth and Bluetooth Low Energy, WIFI, Ethernet, LoRa, or other protocols.

Figure 4C:
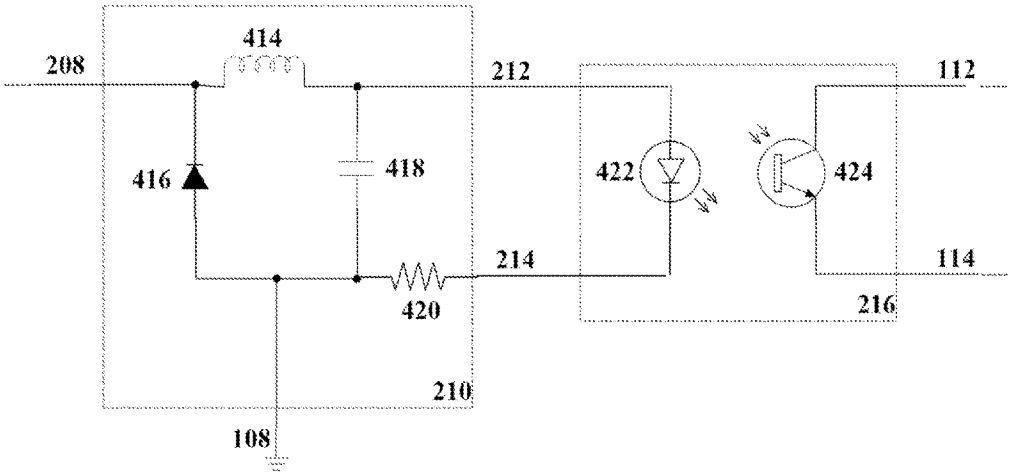
FIG. 4C is a sample circuit diagram of a current control apparatus and opto isolator apparatus of the control apparatus of FIGS. 2A to 2D.

The current control module 210 is operable to generate a particular current from node 212 to node 214 which the opto isolator 216 converts to a virtual resistance between nodes 112 and 114. FIG. 4C illustrates an implementation of the current control module 210 and the opto isolator 216 according to one embodiment of the present invention. As shown, the current control module 210 may comprise an inductor 414 coupled between node 208 and node 212, a diode 416 having its anode coupled to the negative rail 108 which acts as a reference ground and its cathode coupled to the node 208, a capacitor 418 coupled between the reference ground (negative rail 108) and the node 212 and a resistor 420 coupled between the reference ground (negative rail 108) and the node 214. In this implementation, the inductor 414 and capacitor 418 form a low pass filter and the diode 416 ensures continuity of current flowing through the cycle of the control signal output from the controller 206A. Effectively, the current control module 210 comprises a buck converter that outputs a particular voltage across nodes 212 and 214 based on the control signal on node 208. The controller 206A receives the voltage on node 214 which is an indication of the current flowing between nodes 212 and 214 as the voltage on node 214 is generated based upon the current flowing through the known resistor 420. In one particular implementation, the inductor 414 may have a value of 1 mH, the diode 416 may be of type 1N4148, the capacitor 418 may have a value of 1 μF and the resistor 420 may have a value of 500Ω. It should be understood that other values for components could be used and other architectures for a current module could be used to generate a particular current from node 212 to node 214.

As shown in FIG. 4C, the opto isolator 216 may comprise an LED 422 coupled between node 212 and node 214 and a phototransistor 424 coupled between node 112 and node 114. In operation, the phototransistor 424 generates a virtual resistance across the nodes 112, 114 proportional to the current flowing through the LED 422 which is the current flowing between nodes 212, 214. In other implementations, other designs for an isolation circuit may be used.

The virtual resistance generated by the opto isolator 216 may be designed to operate similar to a 0-10V dimming apparatus and thus allow for the constant current driver 102 with dimming terminals connected to nodes 112, 114 to be controlled by the controller 206A via the current control module 210 and the opto isolator 216. The use of the opto isolator ensures that the power within the control apparatus 110A or any components coupled to the control apparatus 110A (ex. a control interface coupled via connection 115) does not create any ground loops with the return path of the dimming terminal 114 to the constant current driver 102.

In operation, the control apparatus 110A that is powered by the constant current driver 102 can control the particular current output from the constant current driver 102 through the dimming terminals coupled to nodes 112, 114. This functionality enables considerable added value features to be implemented into the lighting apparatus 100A that a standard constant current driver 102 may not normally enable. Specific implementations will be described in detail. In one sample implementation, the control apparatus 110A may decrease or increase the particular current output by the constant current driver 102 and therefore the light output by the lighting module 104 in response to information received via connection 115. The information may include, but is not limited to, motion sense information, occupancy sense information, measured light level information, ambient light information, measured light color/color temperature information, accelerometer information, geo-positioning information and audio information. In another sample implementation, data via a communication protocol that is not enabled on the constant current driver 102 may be received by the control apparatus 110A and used to control the constant current driver 102. This may allow for infrared remote control of the constant current driver 102, protocols such as DMX, DALI, ZigBee to be implemented and/or interoperability with various building management systems. In another sample implementation, the control apparatus 110A may interoperate with a dimming apparatus that may not be enabled to interoperate with the constant current driver 102.

Figure 1B:
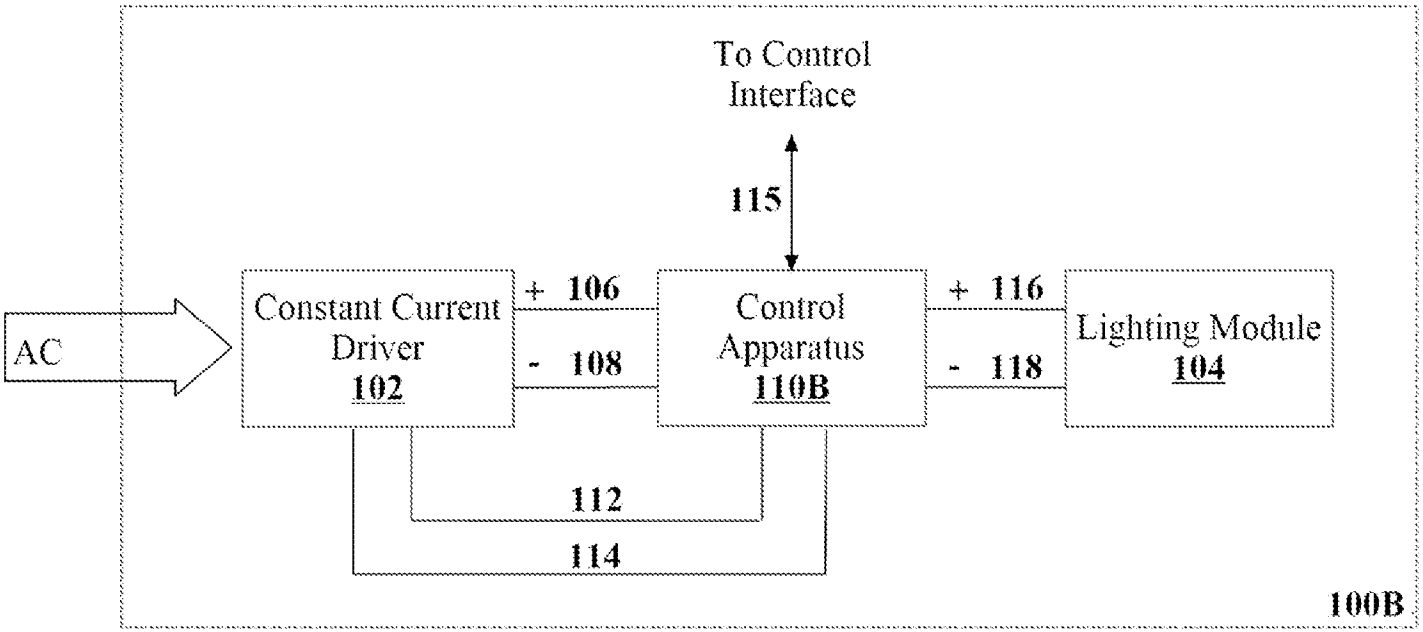

The lighting apparatus 100B of FIG. 1B is similar to lighting apparatus 110A of FIG. 1A but the control apparatus 110A is replaced by control apparatus 110B which is integrated between the constant current driver 102 and the lighting module 104. In this case, positive and negative rails 106, 108 are coupled between the driver 102 and the control apparatus 110B and positive and negative rails 116, 118 are coupled between the control apparatus 110B and the lighting module 104.

Figure 2B:
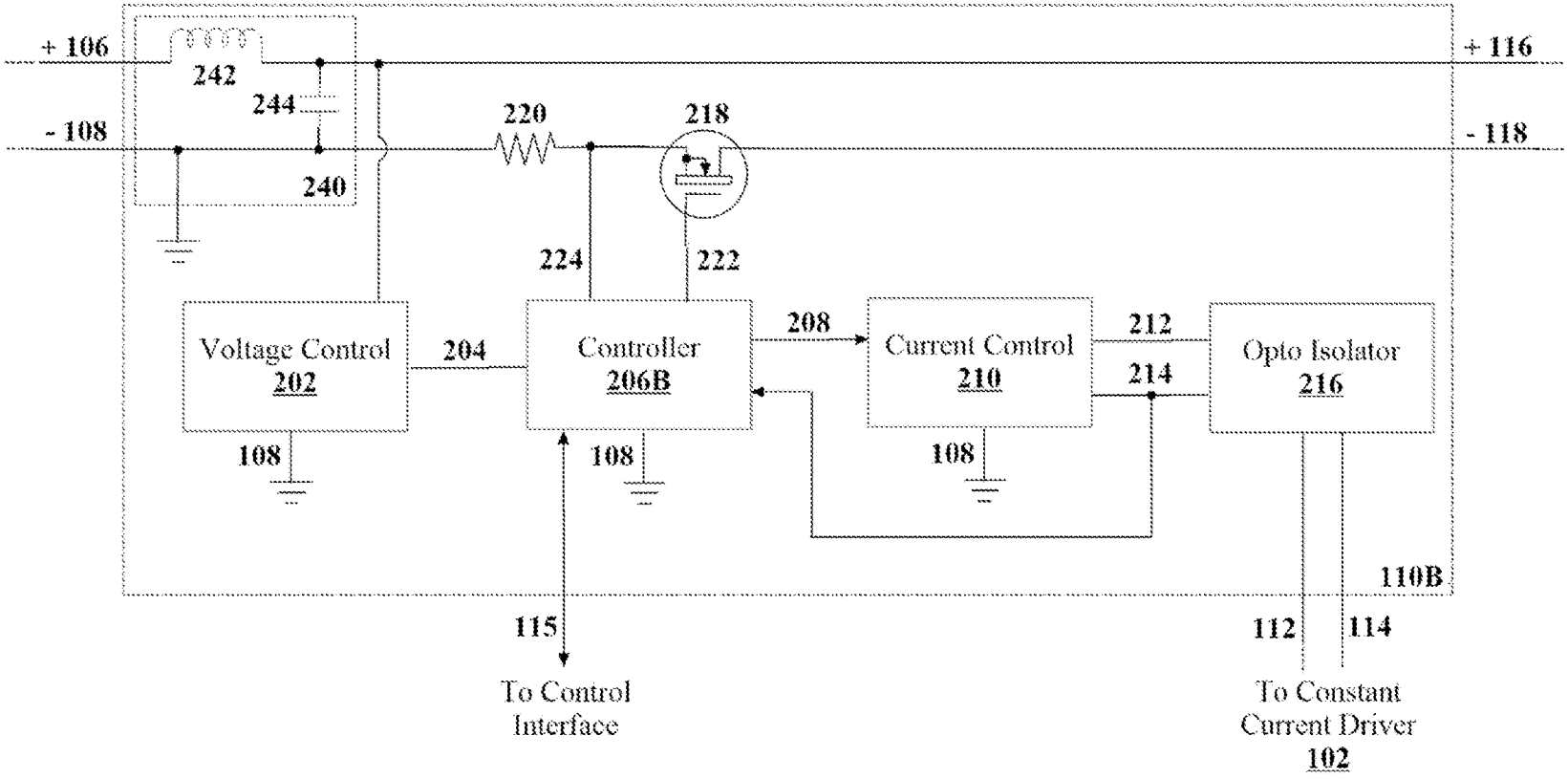

The control apparatus 110B according to one embodiment of the present invention is illustrated in FIG. 2B. As shown, the control apparatus 110B is similar to the control apparatus described with reference to FIG. 2A but the controller 206A is replaced with controller 206B and the control apparatus 110B further comprises a switching element 218 and a current sense resistor 220 coupled in series between the negative rail 118 and the negative rail 108. The controller 206B has an output terminal operable to output control signal 222 that controls the switching element 218 and an input terminal coupled to a node 224 coupled between the switching element 218 and the current sense resistor 220. The switching element 218 may comprise an N-channel transistor as shown in FIG. 2B or similar component. The current sense resistor 220 may have a value of 0.1Ω, though other values may be used. More sophisticated analog to digital sampling may also be used such as with other current sense resistors that can have lower resistances coupled to high gain amplifiers.

In operation, the controller 206B may activate or deactivate the switching element 218 and therefore enable or disable current from flowing through the lighting module 104. This control over the flow of current to the lighting module 104 may be used for various functions. In one implementation, the control of the switching element 218 may allow the controller 206B to fully turn off the lighting module 104. This is important in some applications as the full turning off a light fixture such that the energy used is below a minimum threshold in an off state is a requirement for Energy Star and other energy conservation standards. Typically, the use of dimming terminals to reduce the current output from a constant current driver 102 has a minimum current level (ex. 10% or 1% of total current) and typically a constant current driver 102 does not allow for dimming to zero. To allow for a full off state, a switch may be implemented on the AC side of the constant current driver 102 to turn off the AC power to the constant current driver 102. The use of switching element 218 allows for a full off without implementing a separate AC switch. Upon deactivating the switching element 218, the constant current driver 102 may detect the disconnection of the lighting module 104 and increase the voltage across the positive and negative rails 106, 108 to the maximum voltage limit. In this state, the voltage control module 202 should be adapted to manage the maximum voltage limit and maintain the controlled voltage input to the controller 206B.

In a second implementation, the control of the switching element 218 may allow the controller 206B to disable and then re-enable the current flow through the lighting module 104 for a small amount of time without affecting the constant current driver 102. If disabling and then re-enabling the current flow through the lighting module 104, the controller 206B should utilize a switching frequency sufficiently high to effectively be undetectable to the constant current driver 102. In this case, the constant current driver 102 may detect slightly higher average impedance across the load and increase the voltage across the positive and negative rails 106, 108 slightly to maintain the same average current flowing through the load due to the constant current driver 102. If the time period in which the switching element 218 is deactivated is too long and the constant current driver 102 detects the disconnection of the lighting module 104, the constant current driver 102 will significantly react to the removal of the lighting module 104. In some cases, the constant current driver 102 may adjust the voltage across the positive and negative rails 106, 108 to the maximum voltage limit as the impedance detected across the load will be significantly high and incapable to draw the particular current for the driver 102. In other cases, a safety mode may be enabled. Either of these situations will dramatically affect the visible light output by the lighting apparatus 100B. In some embodiments, once the switching element 218 is turned off for a period of time sufficient to be detected by the constant current driver 102, the switching element 218 should not be turned back on until the constant current driver 102 has adjusted for the removal of the load. In this case, deactivating and then activating the lighting module 104 may be used by the control apparatus 110B to provide acknowledgement to a command received, the command potentially being received via the connection 115. This case allows a person to directly observe a signal from the light as the signal has a duration sufficient to be seen by the human eye. In one embodiment, the controller 206B may be coupled to an infrared sensor via the connection 115 and the command may be in the form of a programming command from an infrared transmitter. Other uses for temporarily deactivating the lighting module 104 causing visible or non-visible effects may occur to one skilled in the art.

It should be noted that forcing the constant current driver 102 to consistently react to the disconnection and then reconnection of the load over and over again could cause strain on the constant current driver 102 and reduce the life of the constant current driver 102. It is not recommended to use the switching element 218 to perform significant PWM dimming of the lighting module 104. This could result in flicker due to the constant current driver 102 reacting quickly to the changes in the load and may result in strain or damage to the constant current driver 102. In addition, an LED light engine may suffer decreased longevity from being subject to a higher instantaneous voltage than that for which it is rated even though the average current is in fact within its rated requirement. In various embodiments of the present invention, dimming of the lighting module 104 is conducted as previously described through the controlling of the dimming terminals of the driver 102 coupled to nodes 112, 114.

In some embodiments, the controller 206B may detect a voltage at node 224, which is an indication of the current flowing through the current sense resistor 220 and therefore the current flowing through the lighting module 104. This indication may be used for various purposes in various implementations. In one case, the detection of the current flowing through the lighting module 104 may be used to ensure a desired current level is being output by the constant current driver 102 and potentially be used as a control variable in feedback to the constant current driver 102 through the control of the dimming terminals through nodes 112, 114. In other implementations in which the controller 206B does not require an indication of the current flowing through the lighting module 104, the current sense resistor 220 may not be implemented and/or the controller 206B may not have an input terminal coupled to node 224.

As depicted in FIG. 2B, the control apparatus 110B may also comprise an optional input filter circuit 240. The input filter circuit 240 may be beneficial depending upon the design of the constant current driver 102. In some cases, the constant current driver 102 may not include an output filter and therefore adjustments in the load coupled to the constant current driver 102 may result in unexpected outcomes. Adding an input filter circuit 240 may be able to mitigate this issue. In the example implementation of FIG. 4B, the filter circuit 240 comprises an inductor 242 coupled between the positive rail 106 and the positive rail 116 and a capacitor 244 coupled between the positive rail 116 and negative rail 108. The input filter 240 could also be implemented within the control apparatus 110A.

Figure 2C:
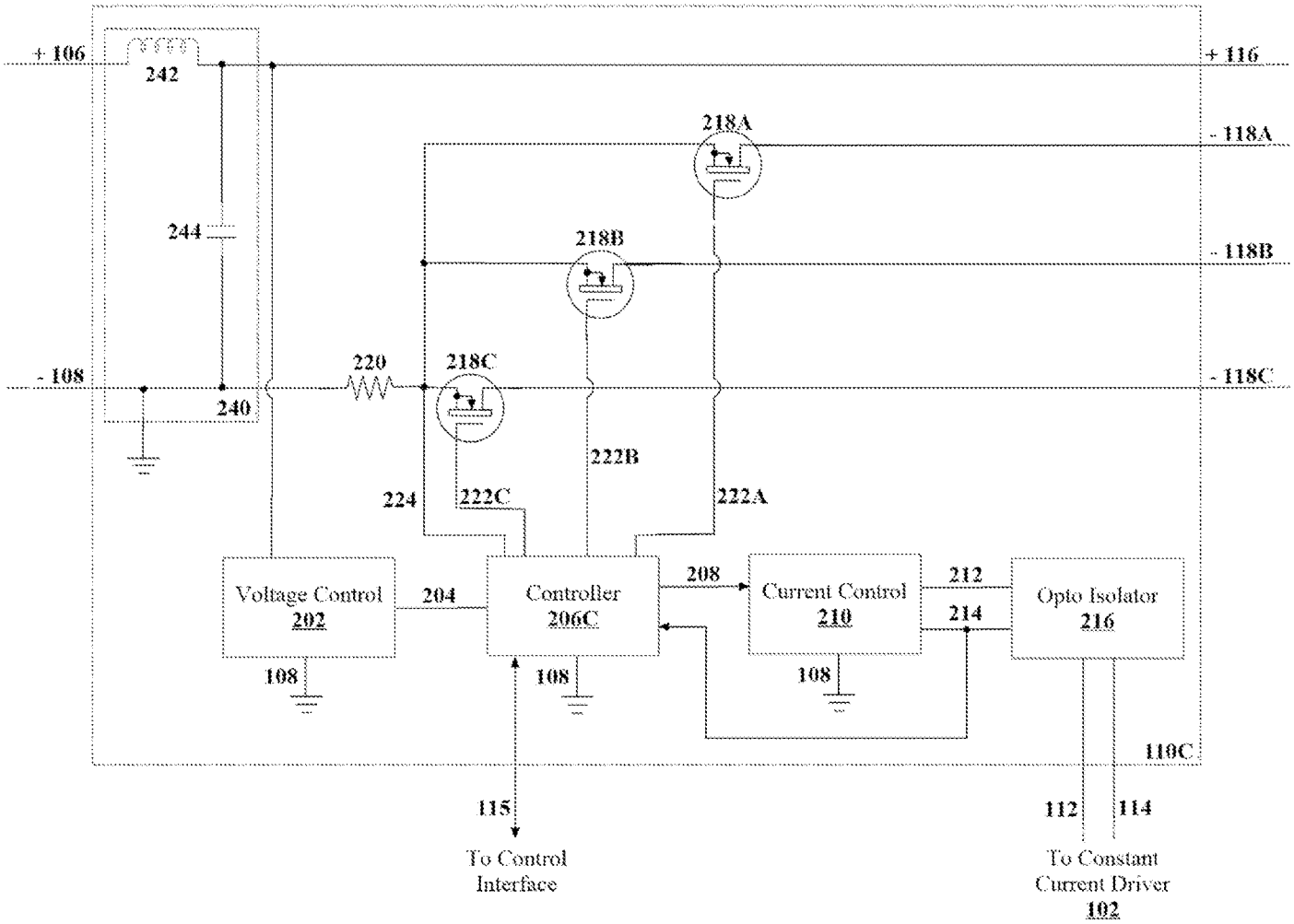
Figure 2D:
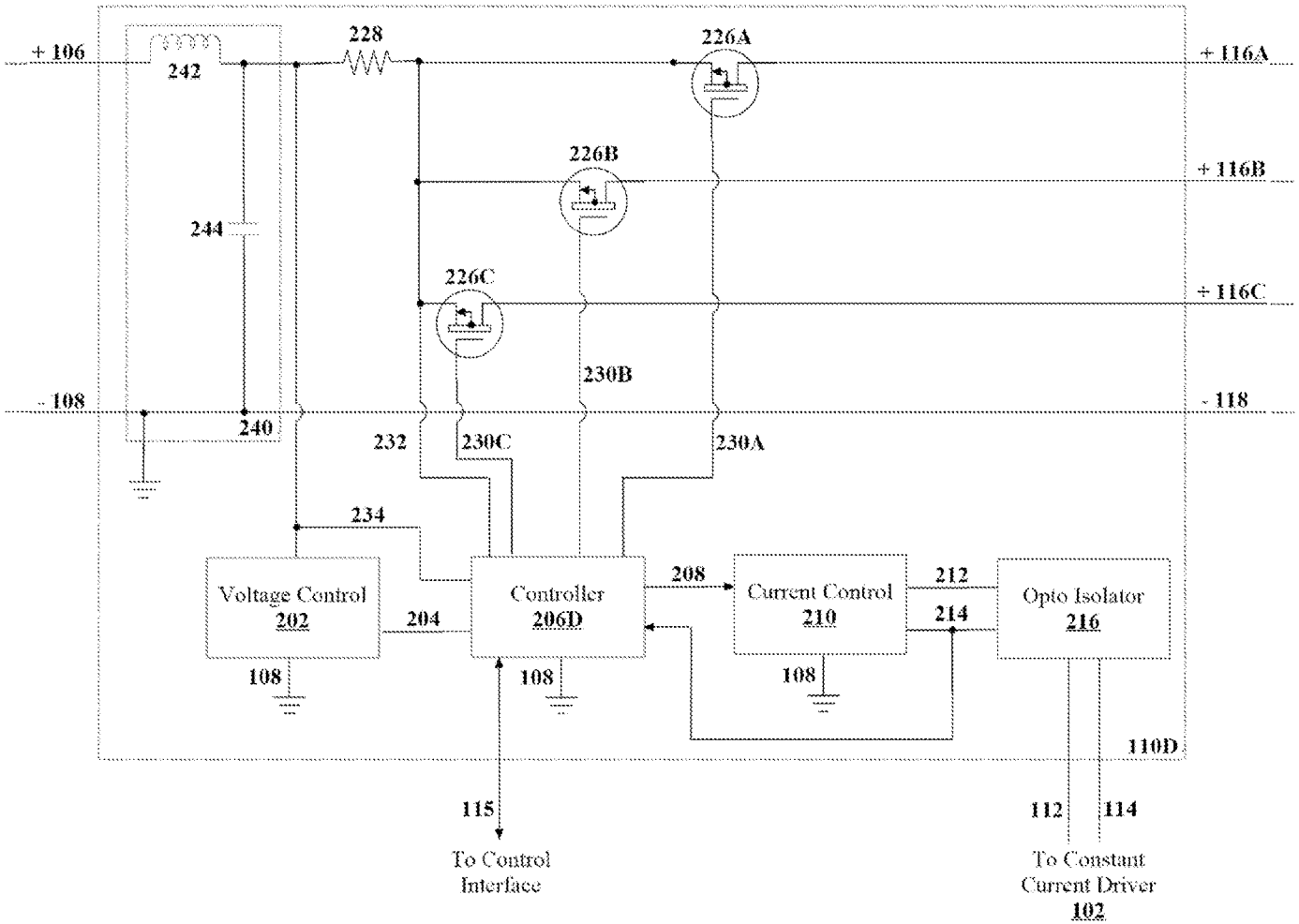
Figure 2E:
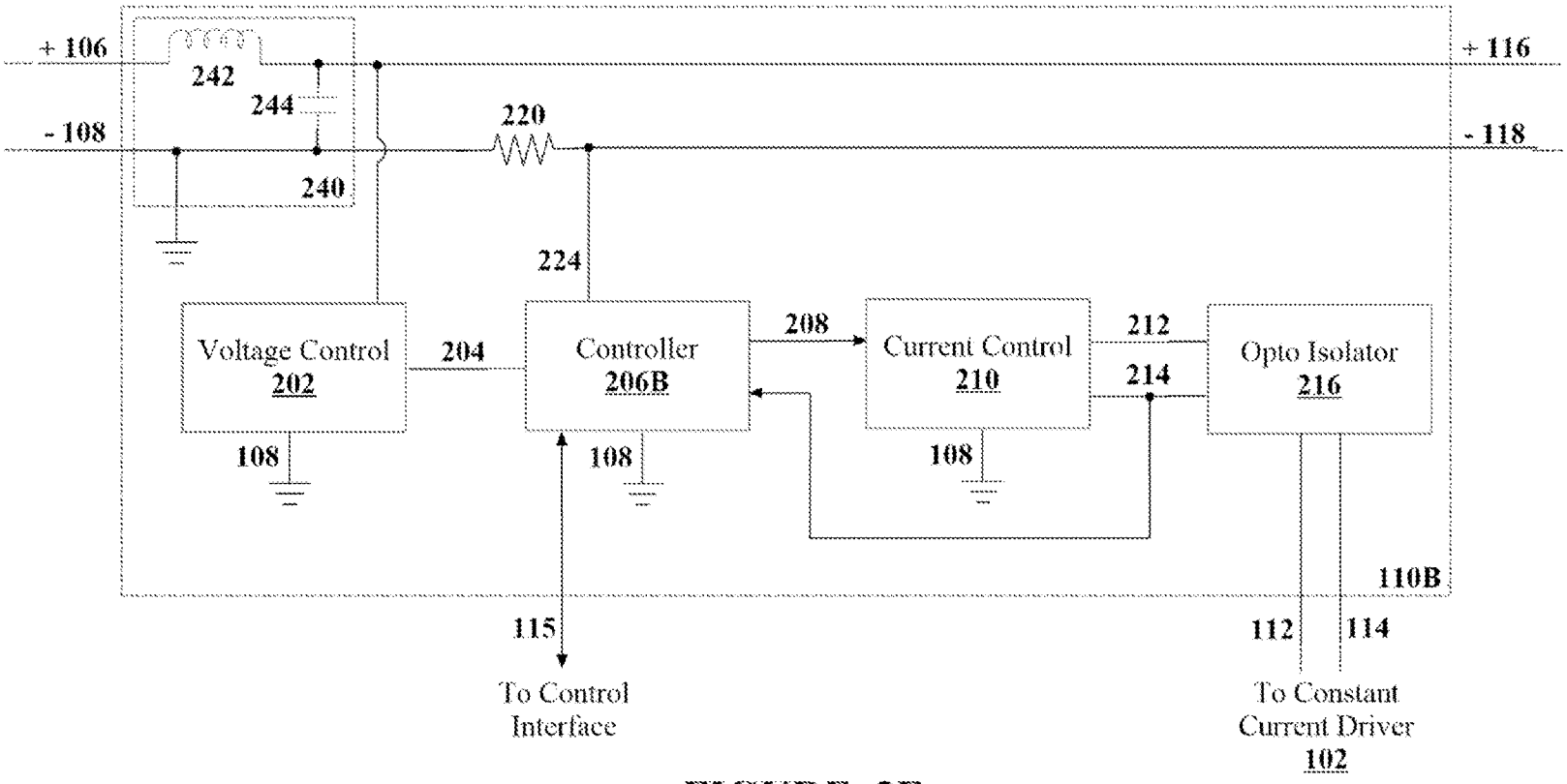

FIG. 2E depicts an alternative implementation of the control apparatus 110B in which the switching element 218 is removed. In this case, the controller 206B may still detect a voltage at node 224, which is an indication of the current flowing through the current sense resistor 220 and therefore the current flowing through the lighting module 104. This indication may be used to ensure a desired current level is being output by the constant current driver 102 and potentially be used as a control variable in feedback to the constant current driver 102 through the control of the dimming terminals through nodes 112, 114.

Figure 1C:
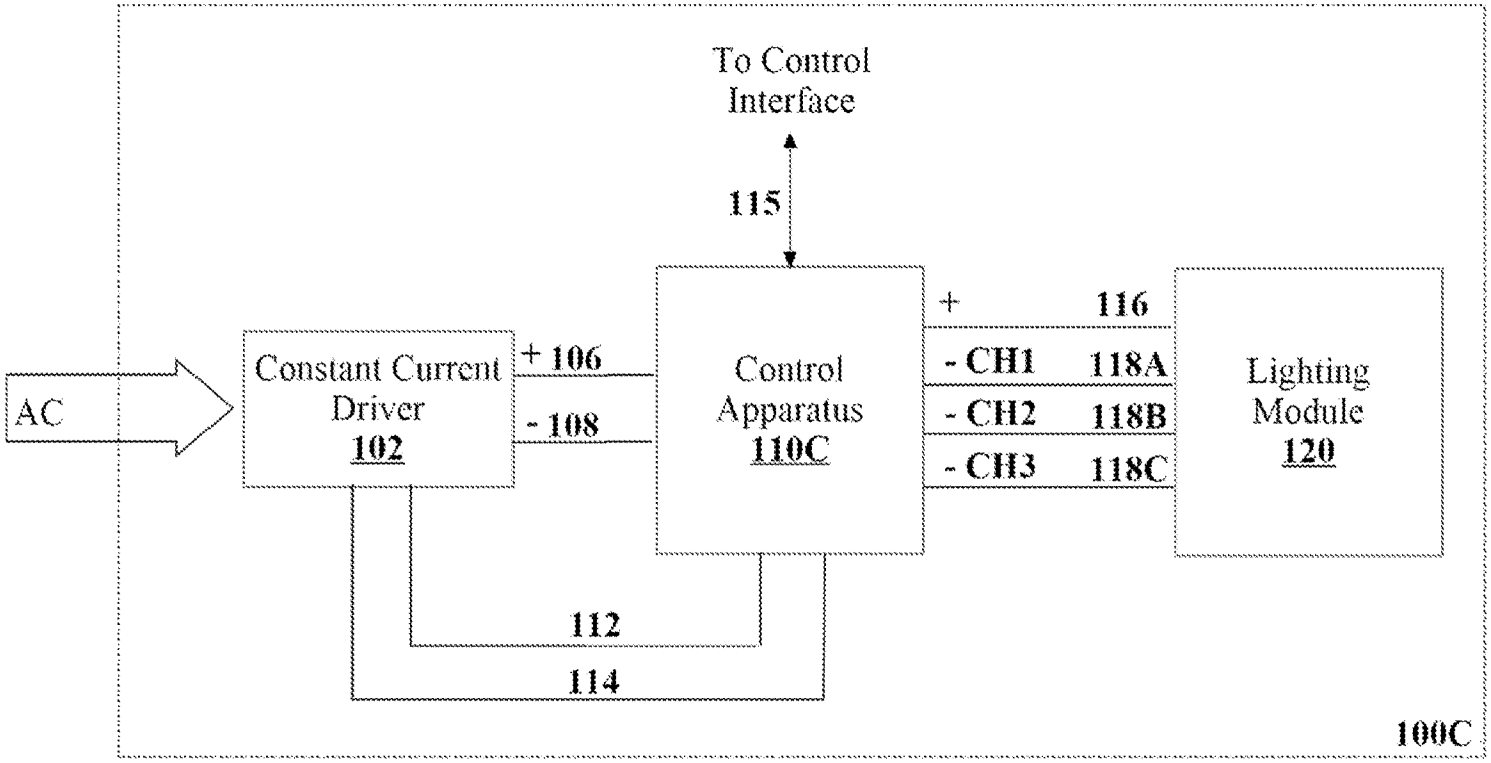

The lighting apparatus 100C of FIG. 1C is similar to lighting apparatus 110B of FIG. 1B but the lighting module 104 is replaced with a lighting module 120 with a plurality of sets of LEDs that can be controlled separately and the control apparatus 110B is replaced with control apparatus 110C which has the negative rail 118 replaced by a plurality of negative rails 118A, 118B, 118C for a plurality channels CH1, CH2, CH3. In this case, the positive rail 116 and the negative rail 118A is used for powering and control of a first set of the LEDs within the lighting module 120, the positive rail 116 and the negative rail 118B is used for powering and control of a second set of the LEDs within the lighting module 120 and the positive rail 116 and the negative rail 118C is used for powering and control of a third set of the LEDs within the lighting module 120. The separate sets of LEDs within the lighting module 120 may each be controlled by one of the channels CH1, CH2, CH3 output from the control apparatus 110C. In one implementation, the sets of LEDs within the lighting module 120 may comprise LEDs of different colors or white LEDs of different color temperatures. By controlling the different channels output from the control apparatus 110C and having the light from the LEDs mix within an optic within the lighting apparatus 100C, various colors and/or color temperatures of light can be output as controlled by the control apparatus 110C. The control apparatus 110C can determine when to activate and deactivate the various sets of LEDs within the lighting module 120 in order to dictate the color and/or color temperature of the light output from the lighting apparatus 100C.

FIG. 2C illustrates the control apparatus 110C according to one embodiment of the present invention. Control apparatus 110C is similar to control apparatus 110B but with controller 206B replaced by controller 206C and the control apparatus 110C comprises a plurality of switching elements; in this case, three N-channel transistors 218A, 218B, 218C instead of one transistor 218. As shown, node 224 is coupled to negative rail 118A via transistor 218A, is coupled; node 224 is coupled to negative rail 118B via transistor 218B; and node 224 is coupled to negative rail 118C via transistor 218C. The controller 206C can independently control the activation and deactivation of the transistors 218A, 218B, 218C with respective control signals 222A, 222B, 222C. In some embodiments, control signals 222A, 222B, 222C may be time multiplexed, each with a corresponding duty cycle within a cyclical period. In some embodiments, the controller 206C may detect a voltage at node 224 which is an indication of the current flowing through the current sense resistor 220 and therefore the current output from the constant current driver 102.

In operation, the controller 206C may coordinate the activation and deactivation of the transistors 218A, 218B, 218C to cause a particularly desired light output from the lighting module 120 by controlling the duty cycles of control signals 222A, 222B, 222C. In one scenario, each of the portions of the lighting module 120 may comprise LEDs of a different color or color temperature. Mixing of these LEDs in various ratios of intensity can allow for the light output from the lighting module 120 to appear different colors or color temperatures of white. Although depicted for the case in which there are three transistors controlling three portions of the lighting module 120, it should be understood in other implementations there may be two, three, four or more transistors controlling various portions of the lighting module 120. In one example, two transistors may be used to control two different color temperatures of LEDs. In other examples, four transistors may be used to control LEDs of red, green, blue and white colors or five transistors may be used to control LEDs of red, green, blue, a warm white color and a cool white color.

In the case that the controller 206C activates only one of the transistors 218A, 218B, 218C, the current output by the constant current driver 102 will power the one portion of the lighting module 120 connected to the activated transistor. In the case that the controller 206C activates two of the transistors 218A, 218B, 218C, the current output by the constant current driver 102 will be divided between the two portions of the lighting module 120 connected to the activated transistors. If the two portions have a similar forward voltage, the current could be divided relatively equally. In the case that the controller 206C activates all three of the transistors 218A, 218B, 218C, the current output by the constant current driver 102 will be divided between all three portions of the lighting module 120, potentially relatively evenly depending on the forward voltages of the portions of the lighting module 120.

In the usual case, exactly one transistor will be in the ON state whereas the others will be in the OFF state. The sum of percentages of the duty cycles of the more-than-one transistors will be normally 100%. The circuit may include some consideration for dead-band requirements between transistor switching in order to give a perceived load to the constant current driver as smooth as possible.

The amount of activation time within a cycle for each of the transistors 218A, 218B, 218C as controlled by the duty cycles of control signals 222A, 222B, 222C output by the controller 206C will dictate the average light intensity radiated from each of the portions of the lighting module 120. The relative ratio of activation times for the transistors 218A, 218B, 218C effectively dictates which portions of the lighting module 120 illuminate brighter and therefore aspects of the mixed light output, such as color or color temperature. Deactivating all three transistors 218A, 218B, 218C for a period of time within a limited period of time is not ideal since forcing the constant current driver 102 to consistently react to the disconnection and then reconnection of the entire load over and over again could cause strain on the constant current driver 102 and reduce the life of the constant current driver 102.

Figure 1D:
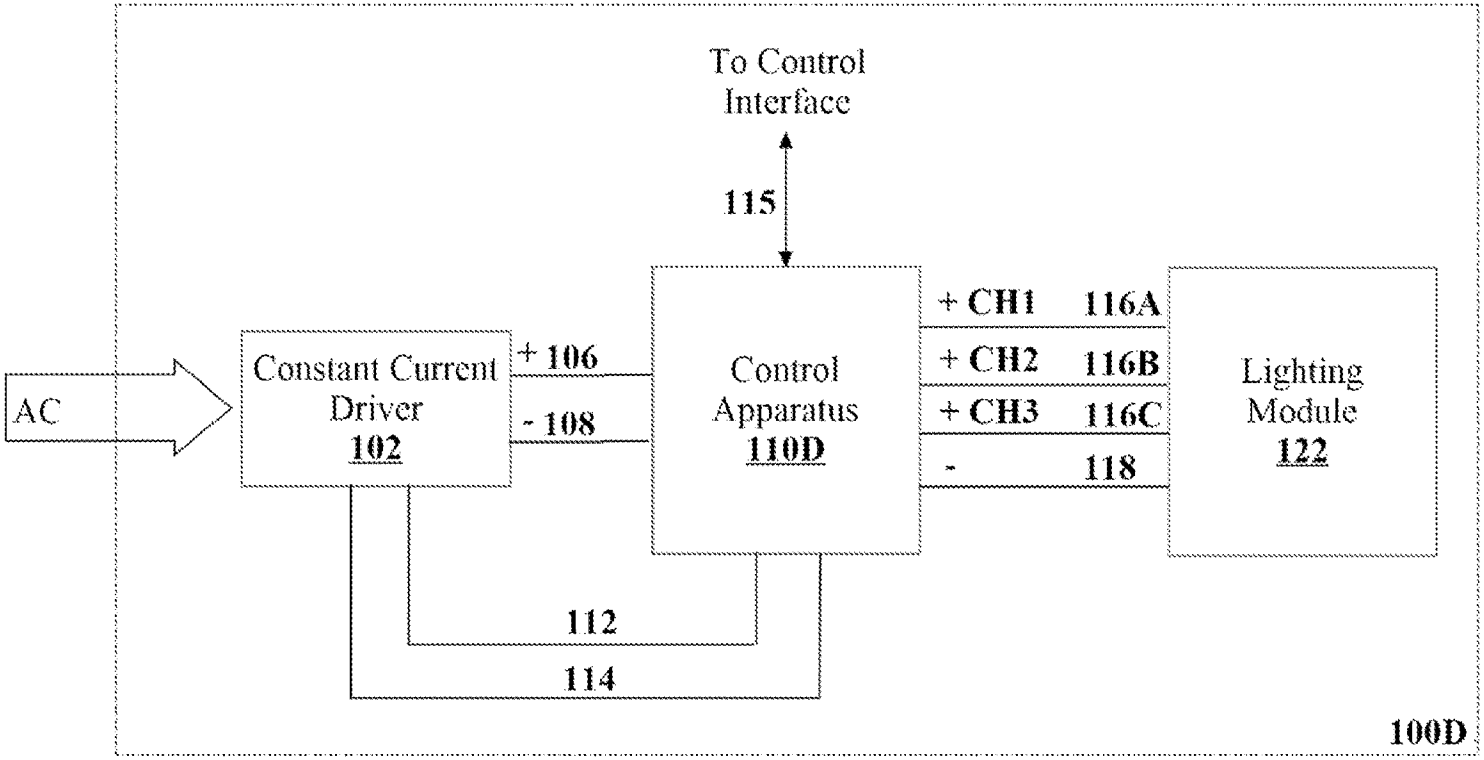

The lighting apparatus 100D of FIG. 1D is similar to lighting apparatus 110C of FIG. 1C but the control apparatus 110C is replaced by the control apparatus 110D which has the positive rail 116 replaced by a plurality of positive rails 116A, 116B, 116C for a plurality channels CH1, CH2, CH3 and the plurality of negative rails 118A, 118B, 118C are replaced by a single negative rail 118. In this case, the control of each portion of a lighting module 122 is being conducted by controlling the positive rails 116A, 116B, 116C rather than the negative rails 118A, 118B, 118C.

FIG. 2D illustrates the control apparatus 110D according to one embodiment of the present invention. Control apparatus 110D is similar to control apparatus 110C but controller 206C is replaced by controller 206D; the control apparatus 110D comprises a plurality of switching elements; in this case, three P-channel transistors 226A, 226B, 226C instead of the plurality of N-channel transistors 218A, 218B, 218C; and current sense resistor 228 coupled between the positive rail 106 (optionally through the input filter 240) and a node 232 is implemented instead of the current sense resistor 220. As shown, node 232 is coupled to positive rail 116A via transistor 226A; node 232 is coupled to positive rail 116B via transistor 226B; and node 232 is coupled to positive rail 116C via transistor 226C. The controller 206D can independently control the activation and deactivation of the transistors 226A, 226B, 226C with respective control signals 230A, 230B, 230C. In some embodiments, a drive circuit using a MOSFET may be implemented to trigger sufficient voltage to activate the transistors 226A, 226B, 226C as the outputs 230A, 230B, 230C from the controller 206D may be a low voltage. In some embodiments, the controller 206D may detect a voltage at node 232, which is an indication of the current output from the constant current driver 102 flowing through the current sense resistor 228 and therefore the current output from the constant current driver 102. Effectively, the embodiment depicted in FIGS. 1D and 2D is similar in function to the embodiment depicted in FIGS. 1C and 2C. The difference is that the control by the controller 106D is being done using the positive rails rather than the negative rails.

Although depicted for the case in which there are three transistors controlling three portions of the lighting module 120 in FIG. 2D, it should be understood in other implementations there may be two, three, four or more transistors controlling various portions of the lighting module 120. In one example, two transistors may be used to control two different color temperatures of LEDs. In other examples, four transistors may be used to control LEDs of red, green, blue and white colors or five transistors may be used to control LEDs of red, green, blue, a warm white color and a cool white color.

Figure 1E:
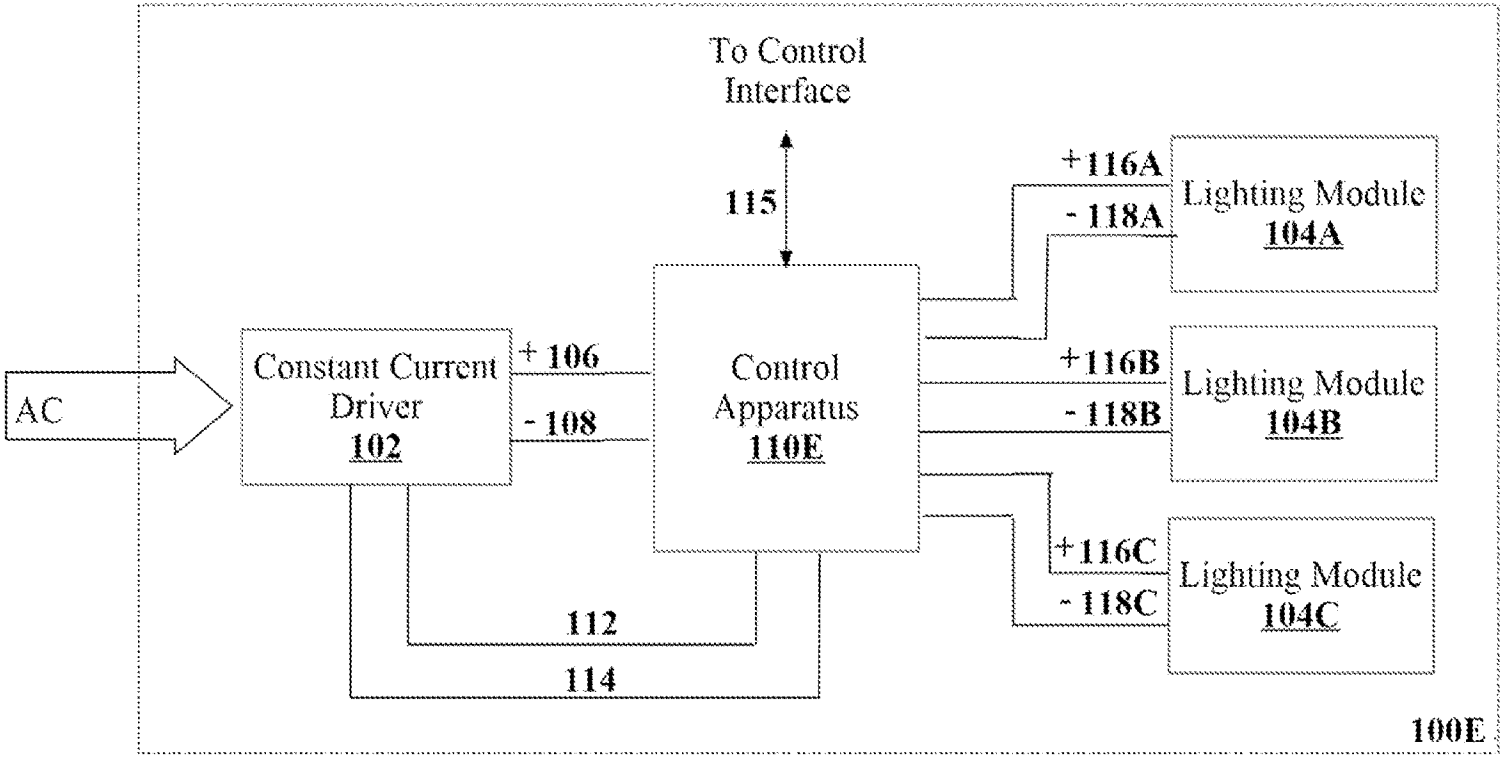

The lighting apparatus 100E of FIG. 1E is similar to lighting apparatuses 110C and 110D of FIGS. 1C, 1D but the control apparatus 110C/110D is replaced by the control apparatus 110E which has outputs of both a plurality of positive rails 116A, 116B, 116C and a plurality of negative rails 118A, 118B, 118C; and the lighting module 120 is replaced by a plurality of lighting modules 104A, 104B, 104C. As depicted, positive rail 116A and negative rail 118A are coupled to the lighting module 104A; positive rail 116B and negative rail 118B are coupled to the lighting module 104B; and positive rail 116C and negative rail 118C are coupled to the lighting module 104C. In one case, the plurality of positive rails 116A, 116B, 116C may be coupled together within the control apparatus 110E and therefore lighting apparatus 100E would be similar to lighting apparatus 100C and control the lighting modules 104A, 104B, 104C similar to controlling the three portions of the lighting module 120. In another case, the plurality of negative rails 118A, 118B, 118C may be coupled together within the control apparatus 110E and therefore lighting apparatus 100E would be similar to lighting apparatus 100D and control the lighting modules 104A, 104B, 104C similar to controlling the three portions of the lighting module 120. In yet another case, the control apparatus 110E may independently control both the positive rail and negative rail connected to each of the lighting modules 104A, 104B, 104C.

Figure 6A:
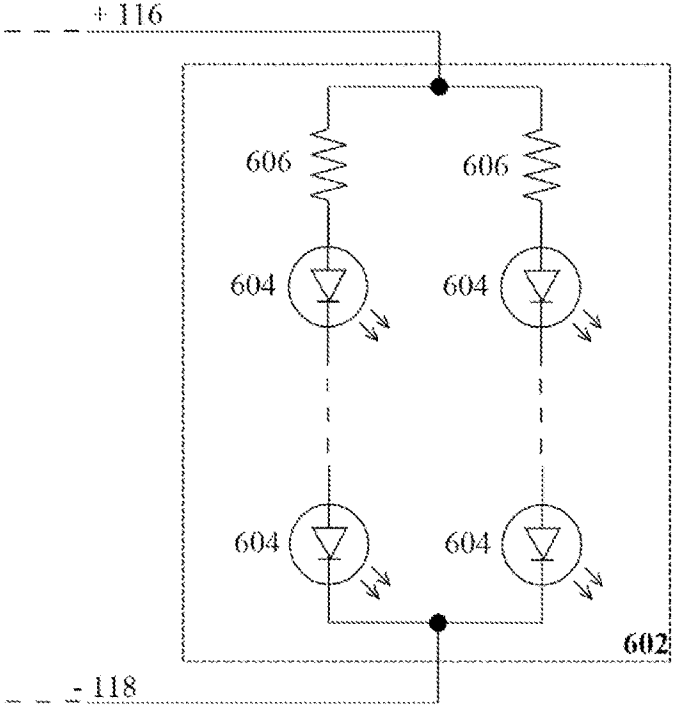
FIGS. 6A, 6B and 6C are block diagrams of lighting modules according to sample embodiments of the present invention.
Figure 6B:
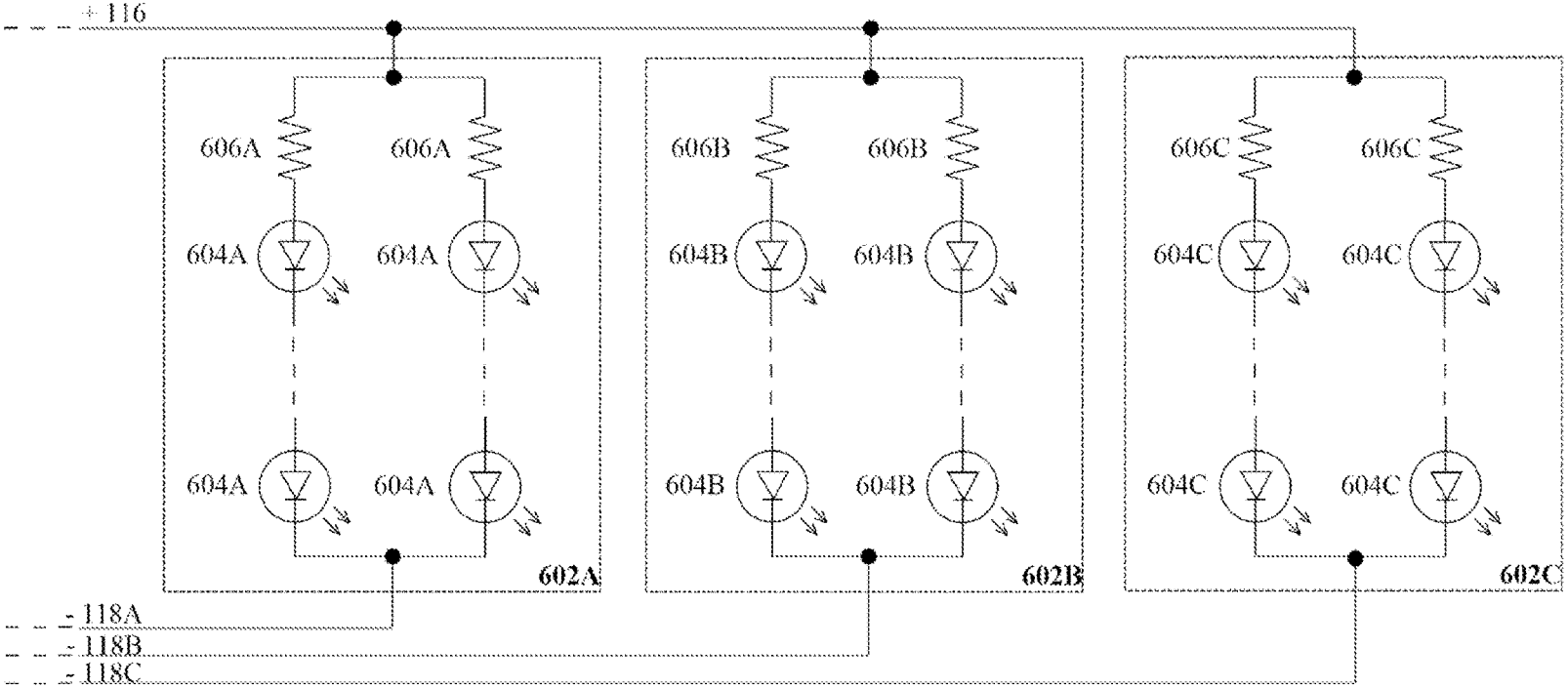
Figure 6C:
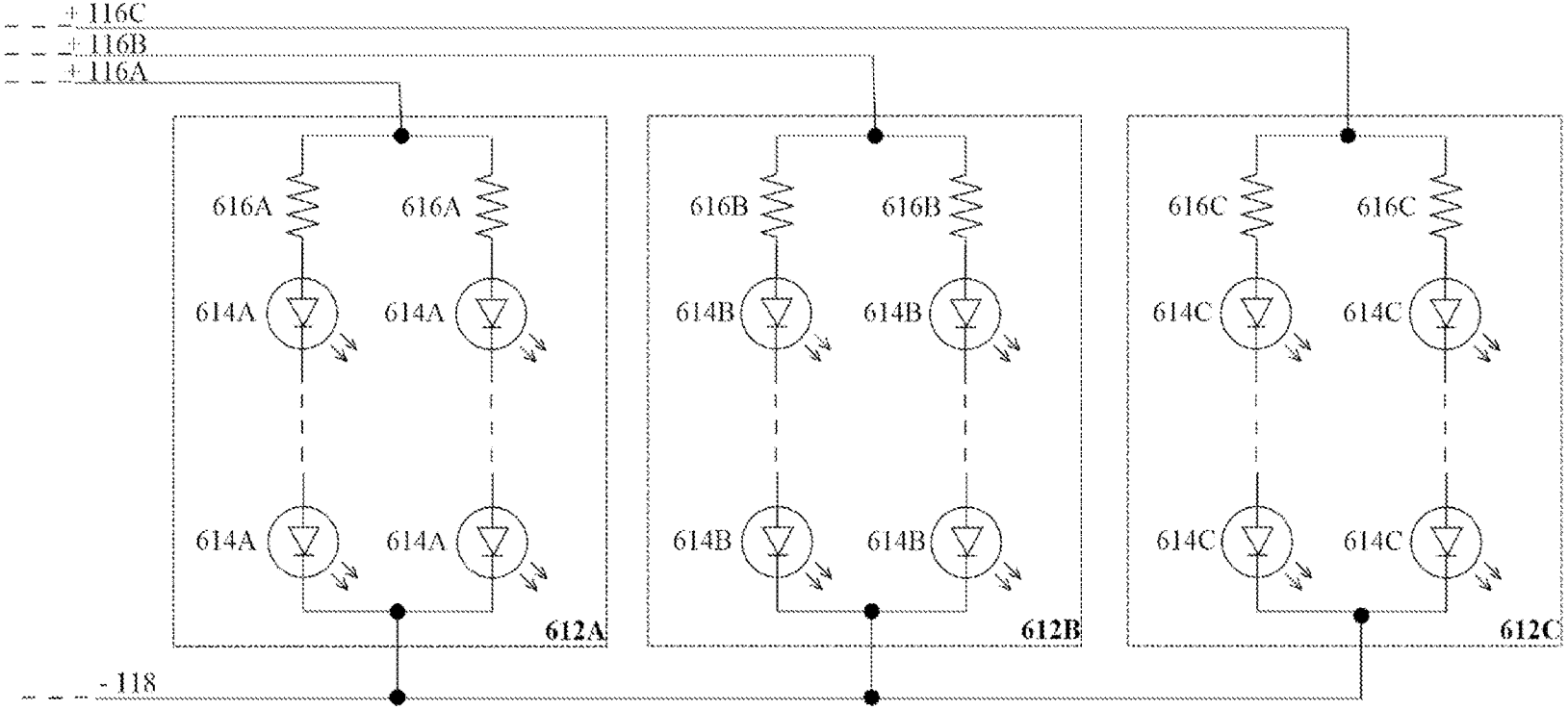

FIGS. 6A, 6B and 6C are block diagrams of lighting modules according to sample embodiments of the present invention. FIG. 6A depicts a sample implementation of lighting module 104 in which a single LED group 602 is coupled between the positive rail 116 and the negative rail 118. In this case, the LED group 602 comprises a plurality of sets of LEDs coupled in parallel, each set of LEDs comprising a plurality of LEDs 604 and a resistor 606 coupled in series. Although shown with two sets of LEDs within the LED group 602, it should be understood that only a single set of LEDs could be implemented or more than two sets of LEDs may be coupled in parallel within the LED group 602. Further, in some implementations, no resistors may be included in series with the LEDs. In one specific implementation, each set of LEDs may comprise seven LEDs and the forward voltage across the LED group 602 may be between 21-24V, depending upon the forward voltage of the LEDs, the current flowing through the LEDs 604 and the thermal temperature.

The lighting modules 104A, 104B, 104C of FIG. 1E may each be implemented similar to the lighting module depicted in FIG. 6A. In that case, each of the lighting modules 104A, 104B, 104C may be implemented with the same or different numbers of sets of LEDs; or the same or different color LEDs or LEDs with the same or different color temperatures of white LEDs. In the lighting apparatus of FIG. 1E, it is preferred that the forward voltages of the lighting modules 104A, 104B, 104C be relatively similar so that the constant current driver 102 is not required to dramatically adjust for the load when switching between the lighting modules 104A, 104B, 104C. Therefore, in some implementations, there may be the same number of LEDs in series within each set of LEDs in each of the lighting modules 104A, 104B, 104C. In cases where one type of LED has a significantly different forward voltage per LED (ex. red LEDs may have a forward voltage approx. 2V compared to most other LEDs having a forward voltage approx. 3V), a different number of LEDs may be in series within each set of LEDs in each of the lighting modules 104A, 104B, 104C to allow for the overall forward voltages to be relatively similar. For example, if blue and green LEDs have approx. 3V forward voltages and red LED have approx. 2V forward voltages, a lighting module 104A comprising red LEDs may comprise a 3:2 ratio of LEDs in series within each set of LEDs relative to lighting modules 104B, 104C comprising green and blue LEDs. In one particular implementation, the lighting module 104A may comprise 12 red LEDs in series in each set of LEDs and the lighting module 104B may comprise 8 green LEDs in series in each set of LEDs and the lighting module 104C may comprise 8 blue LEDs in series in each set of LEDs. In this particular implementation, each of the lighting modules 104A, 104B, 104C would have a forward voltage approximately 24V. It should be understood that other numbers of LEDs may be implemented in series within the lighting modules 104A, 104B, 104C that may result in other forward voltages that are relatively similar. Also, it should be understood that only two lighting modules may be used or more than three lighting modules may be implemented in the lighting apparatus 100E.

FIG. 6B depicts a sample implementation of lighting module 120 of FIG. 1C in which an LED group 602A is coupled between the positive rail 116 and the negative rail 118A; an LED group 602B is coupled between the positive rail 116 and the negative rail 118B; and an LED group 602C is coupled between the positive rail 116 and the negative rail 118C. In this case, the LED group 602A comprises a plurality of sets of LEDs coupled in parallel, each set of LEDs comprising a plurality of LEDs 604A and a resistor 606A coupled in series; the LED group 602B comprises a plurality of sets of LEDs coupled in parallel, each set of LEDs comprising a plurality of LEDs 604B and a resistor 606B coupled in series; and the LED group 602C comprises a plurality of sets of LEDs coupled in parallel, each set of LEDs comprising a plurality of LEDs 604C and a resistor 606C coupled in series. Although shown with two sets of LEDs within each of the LED groups 602A, 602B, 602C, it should be understood that only a single set of LEDs could be implemented or more than two sets of LEDs may be coupled in parallel within each of the LED groups 602A, 602B, 602C. In some embodiments, the LEDs 604A, 604B, 604C of the different LED groups 602A, 602B, 602C may comprise LEDs of different colors or white LEDs of different color temperatures or a combination of LEDs of different color and white LEDs of different color temperatures. Although depicted with three LED groups, it should be understood that the lighting module could comprise only two LED groups or may comprise more than three LED groups. Further, in some implementations, no resistors may be included in series with the LEDs.

FIG. 6C depicts a sample implementation of lighting module 122 of FIG. 1D in which an LED group 612A is coupled between the positive rail 116A and the negative rail 118; an LED group 612B is coupled between the positive rail 116 and the negative rail 118; and an LED group 612C is coupled between the positive rail 116C and the negative rail 118. In this case, the LED group 612A comprises a plurality of sets of LEDs coupled in parallel, each set of LEDs comprising a plurality of LEDs 614A and a resistor 616A coupled in series; the LED group 612B comprises a plurality of sets of LEDs coupled in parallel, each set of LEDs comprising a plurality of LEDs 614B and a resistor 616B coupled in series; and the LED group 612C comprises a plurality of sets of LEDs coupled in parallel, each set of LEDs comprising a plurality of LEDs 614C and a resistor 616C coupled in series. Although shown with two sets of LEDs within each of the LED groups 612A, 612B, 612C, it should be understood that only a single set of LEDs could be implemented or more than two sets of LEDs may be coupled in parallel within each of the LED groups 612A, 612B, 612C. In some embodiments, the LEDs 614A, 614B, 614C of the different LED groups 612A, 612B, 612C may comprise LEDs of different colors or white LEDs of different color temperatures or a combination of LEDs of different color and white LEDs of different color temperatures. Although depicted with three LED groups, it should be understood that the lighting module could comprise only two LED groups or may comprise more than three LED groups. Further, in some implementations, no resistors may be included in series with the LEDs.

Figure 3A:
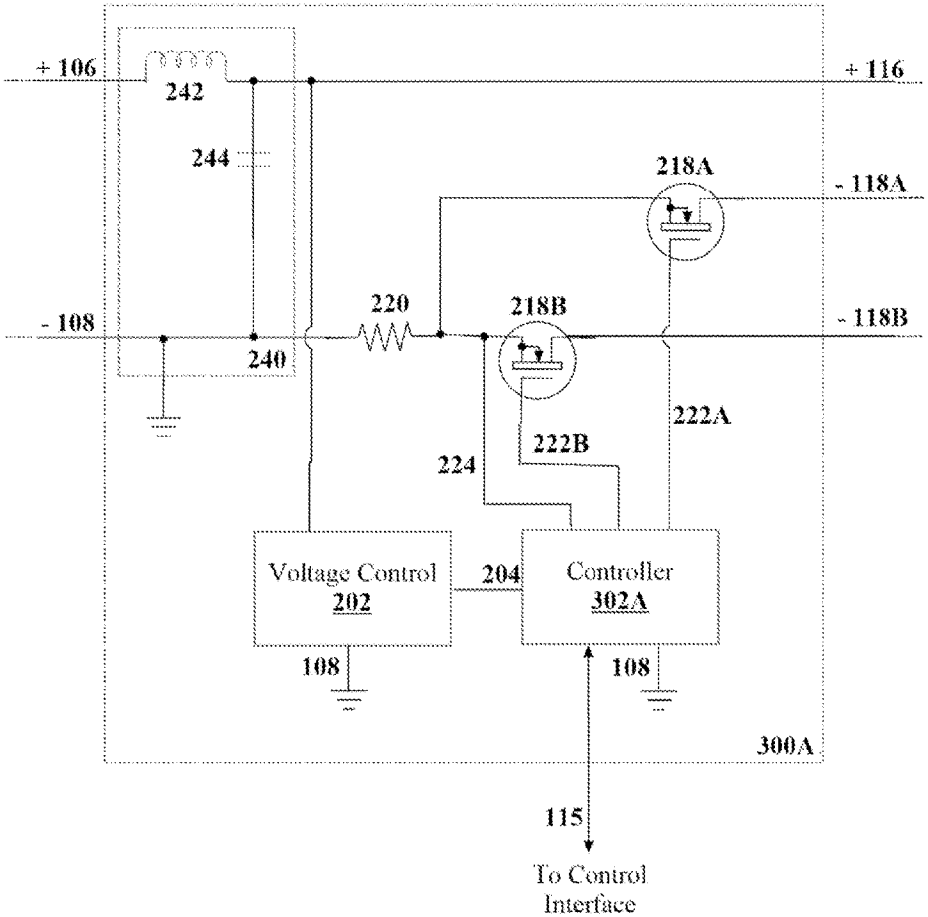
FIGS. 3A, 3B and 3C are alternative block diagrams of the control apparatus of FIGS. 1C and 1D with no feedback to the constant current driver.
Figure 3B:
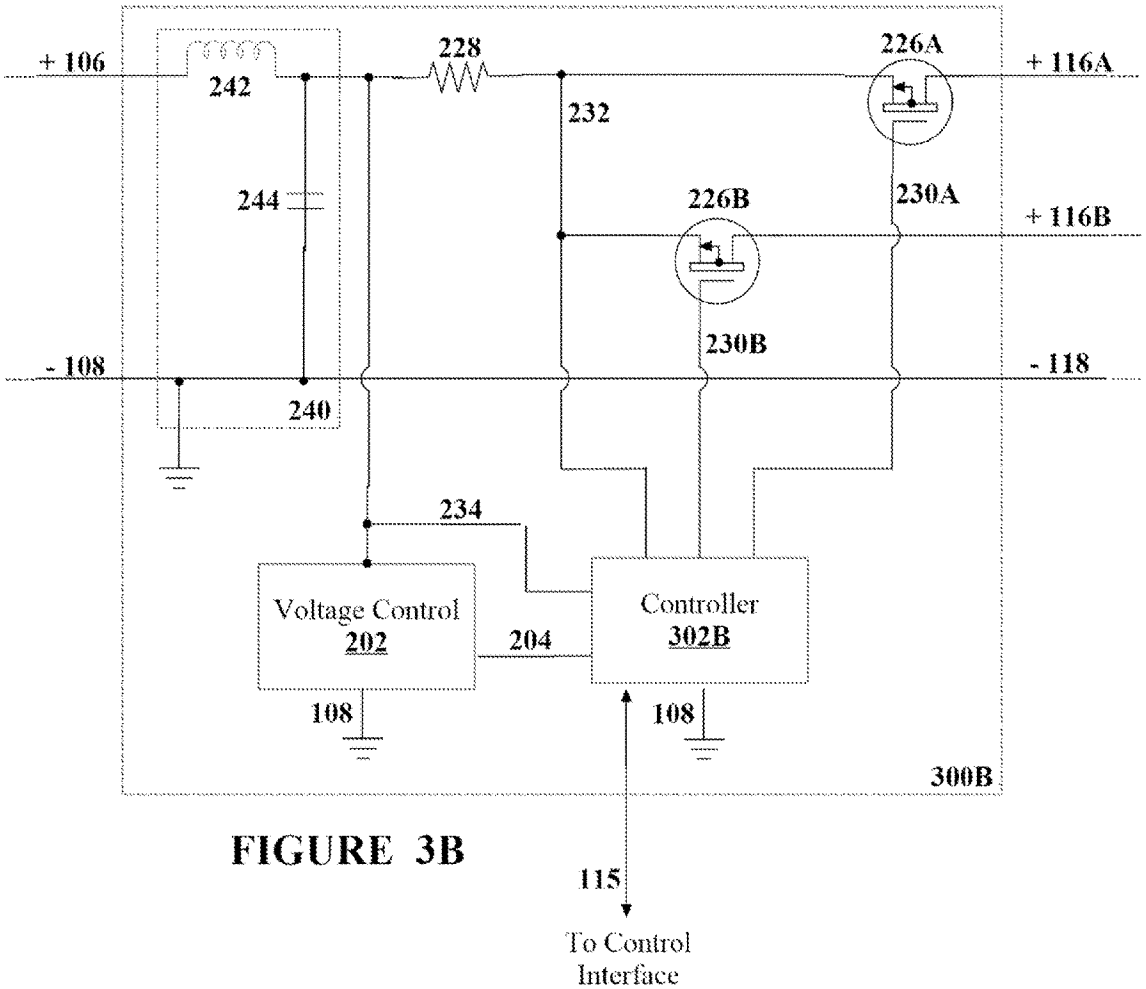

FIGS. 3A and 3B are alternative block diagrams of the control apparatus of FIGS. 1C and 1D respectively with no feedback to the constant current driver. In these cases, the control apparatus is powered from the constant current driver 102 as described but does not require the circuitry to control the dimming of the constant current driver 102. As depicted in FIG. 3A, the control apparatus 300A is similar to the control apparatus 110C but the current control module 210 and the opto isolator 216 have been removed. Also, for simplicity, only two transistors 218A, 218B are depicted, potentially used to control two LED channels comprising LEDs of different color temperatures. Similarly, as depicted in FIG. 3B, the control apparatus 300B is similar to the control apparatus 110D but the current control module 210 and the opto isolator 216 have been removed and, for simplicity, only two transistors 226A, 226B are depicted.

Figure 3C:
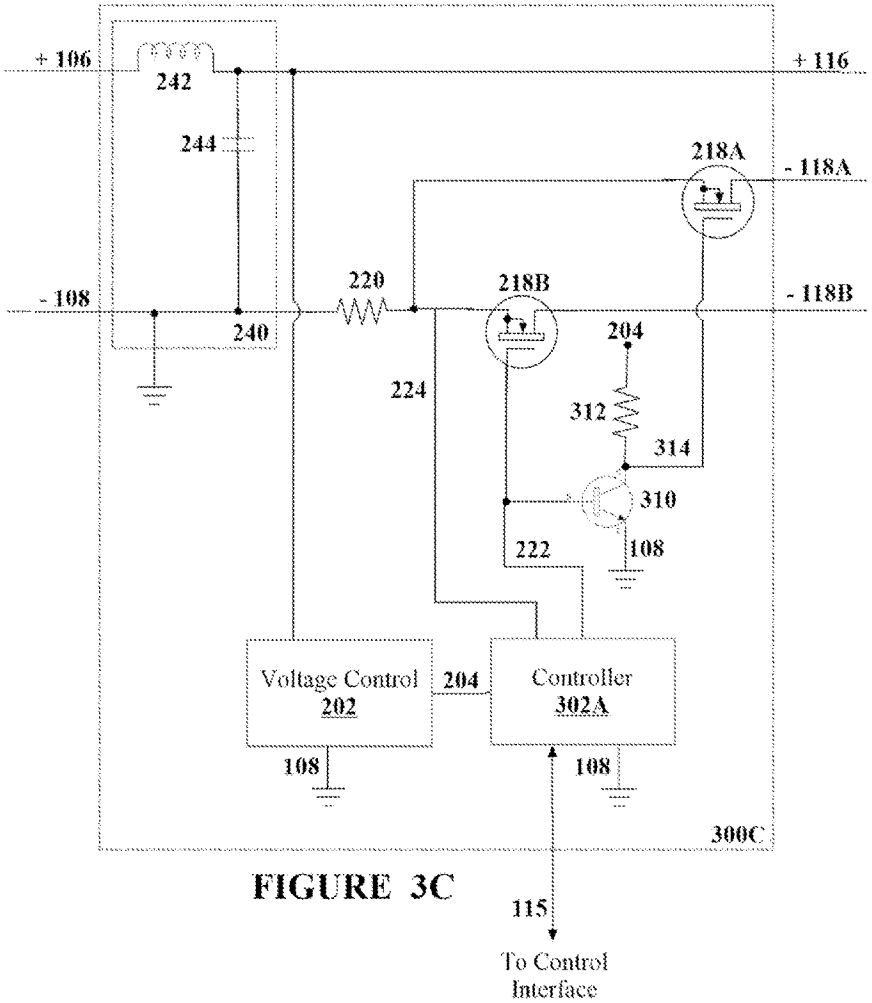

In some embodiments of the present invention, the control apparatus may be implemented with two switching elements that are designed to be controlled with opposite activation signals. In the case of opposite signals, a first signal is deactivated when a second signal is activated and the second signal is deactivated when the first signal is activated. The two opposite signals would have complementary pulses and complementary duty cycles. In this case, the controller may be implemented to output only a single control signal for both of the switching elements and an inverter circuit may be used to invert the control signal so that each switching element receives an opposite control signal. FIG. 3C depicts a sample implementation of a control apparatus 300C in which the controller outputs a single control signal and the control signal is inverted to control a second switching element. In FIG. 3C, the control apparatus is similar to the control apparatus 300A of FIG. 3A, though it should be understood that a similar implementation could be combined with the other embodiments of the control apparatus. In this case, the controller 302A outputs control signal 222 that controls activation of transistor 218B. As depicted, the control apparatus further comprises a transistor 310 with its emitter coupled to the negative rail 108, its collector coupled via a resistor 312 to the controlled voltage on line 204 and its base coupled to the control signal 222. A voltage on node 314 coupled to the collector of the transistor 310 controls transistor 218A. In operation, if the control signal 222 is high, transistor 310 is activated and the voltage on node 314 is low; therefore, transistor 318A is deactivated and transistor 318B is activated. If the control signal 222 is low, transistor 310 is deactivated and the voltage on node 314 is high; therefore, transistor 318A is activated and transistor 318B is deactivated. It should be understood that other implementations for an inverter could be used.

Although described for a single constant current driver implemented within the lighting apparatus of each of the various embodiments of the present invention, it should be understood that a plurality of constant current drivers may be utilized to power a single lighting module or plurality of lighting modules. The control apparatus may be implemented between a plurality of constant current drivers and the lighting module(s). Further, although depicted within the lighting apparatus, the constant current driver and/or the controller may be implemented separate from the lighting apparatus. In these cases, the driver and/or controller may be located local to the remaining portions of the lighting apparatus.

In other embodiments, the control apparatus may be integrated with the lighting module within the lighting apparatus. In particular, elements of the control apparatus 110A, 110B may be integrated with the lighting module 104. For instance, in some implementations, switching element 218 and/or resistor 220 may be implemented within the lighting module 104. In other embodiments, other elements within the control apparatus 110A, 110B, in whole or in part, may be implemented within the lighting module 104. Similarly, elements of the control apparatus 110C, in whole or in part, may be integrated with the lighting module 120; elements of the control apparatus 110D, in whole or in part, may be integrated with the lighting module 122; and elements of the control apparatus 110E, in whole or in part, may be integrated with one or more of the lighting modules 104A, 104B, 104C.

In other embodiments, the control apparatus may be integrated with the power source. In particular, elements of the control apparatus 110A, 110B may be integrated with the constant current driver 102. For instance, in some implementations, switching element 218 and/or resistor 220 may be implemented within the constant current driver 102. In other embodiments, other elements within the control apparatus 110A, 110B, 110C, 110D, 110E in whole or in part, may be implemented within the constant current driver 102. In some embodiments, a single physical component could be implemented with a constant current power module similar to constant current driver 102 and a control apparatus similar to control apparatus 110A, 110B, 110C, 110D, 110E. This module approach could allow for added intelligence to be added to a typical constant current driver. In some implementations, the constant current power module and the control apparatus may be pluggable within a larger entity that has a socket for coupling the two modules together. The socket may comprise two wires for connecting positive and negative rails 106, 108 and optionally comprise an additional two wires for connecting nodes 112, 114.

Figure 5A:
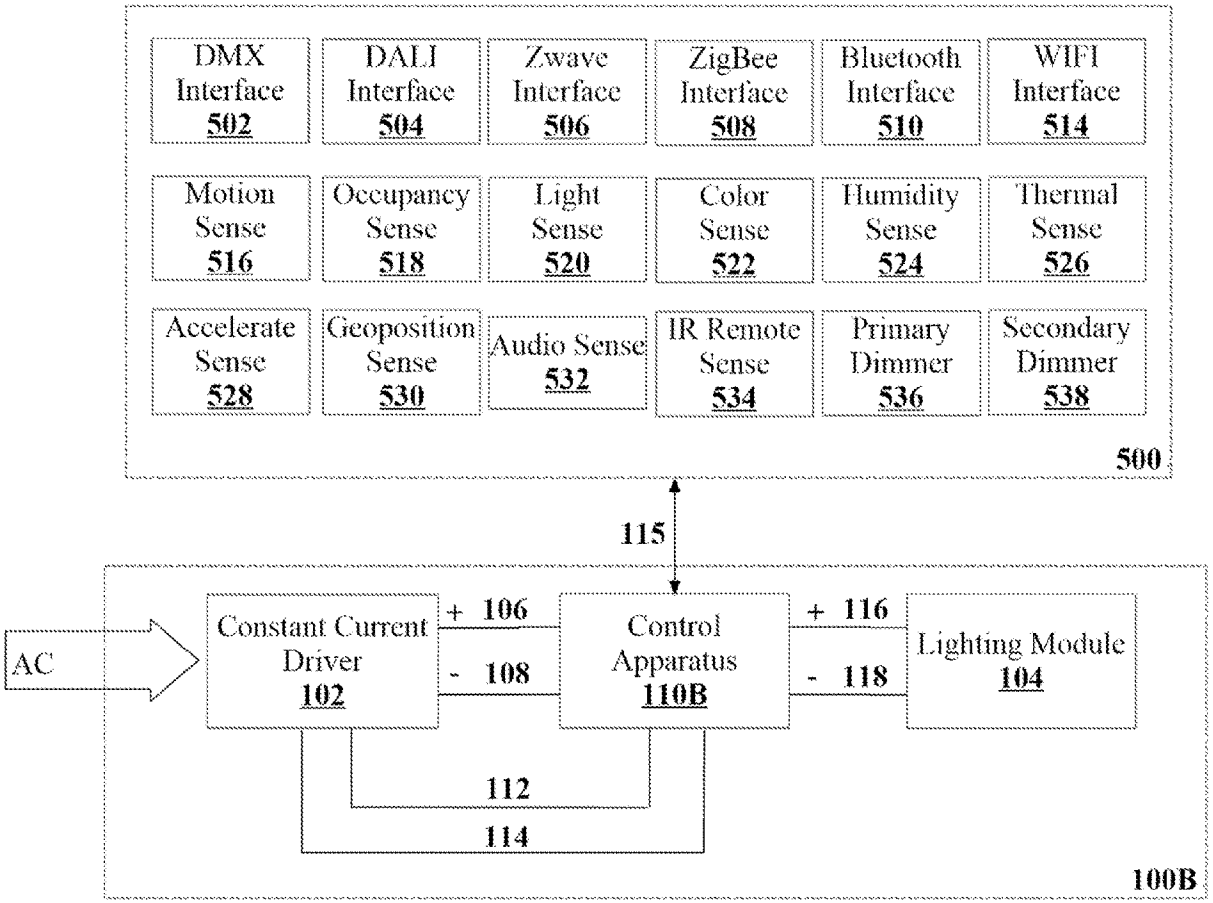
FIG. 5A is a block diagram of an embodiment of the lighting apparatus of FIG. 1B illustrating a plurality of accessory control components.

FIG. 5A is a block diagram of an embodiment of the lighting apparatus of FIG. 1B illustrating a plurality of accessory control components 500. The decisions made by the controller within each of the various embodiments of the present invention may be controlled at least in part by one or more of these accessory control components 500 that may connect to the controller 110B via connection 115. As illustrated in FIG. 5A, the components 500 could include, but are not limited to, a DMX interface 502, a DALI interface 504, a Zwave interface 506, a ZigBee interface 508, a Bluetooth interface 510, a WiFi interface 514, a motion sense module 516, an occupancy sense module 518, a light sense module 520, a color sense module 522, a humidity sense module 524, a thermal sense module 526, an accelerate sense module 528, a geo-position sense module 530, an audio sense module 532, an IR remote sense module 534, a primary dimmer such as a 0-10V dimmer that may indicate desired intensity, a secondary dimmer such as a 0-10V dimmer that may indicate another desired aspect such as color temperature or color. It should be understood that although FIG. 5A depicts the lighting apparatus of FIG. 1B, other embodiments of the present invention could also interface with one or more of the accessory control components shown. Further, although the accessory control components are depicted external to the lighting apparatus 100B, in some embodiments one or more of the accessory control components may be implemented within the lighting apparatus 100B.

Figure 5B:
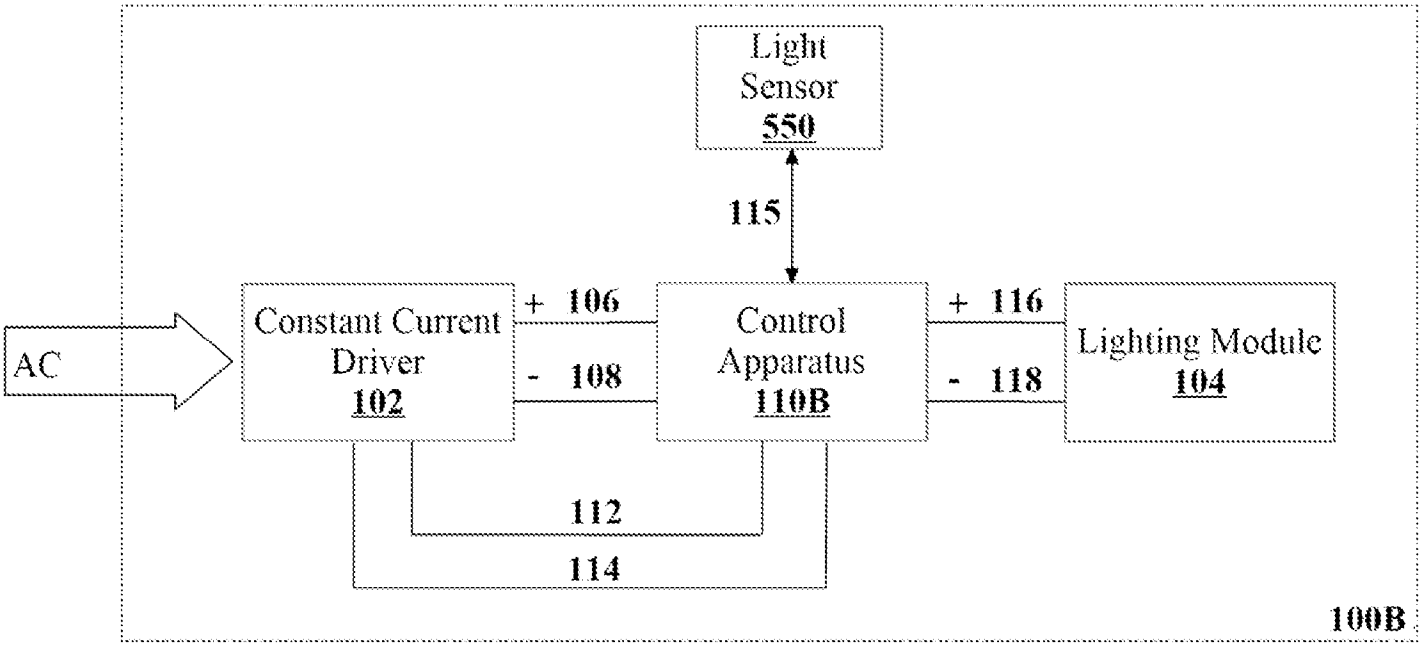
FIG. 5B is a block diagram of an embodiment of the lighting apparatus of FIG. 1B using a light sensor.

If the deactivating and activating of the switching element 218 is conducted sufficiently quickly to not be detected by the constant current driver 102, a variety of functions may be enabled using the control apparatus 110B (or other versions of the control apparatus that allow for control over a switching element). FIG. 5B is a block diagram of an embodiment of the lighting apparatus of FIG. 1B using a light sensor 550 for daylight harvest dimming. In one embodiment, the controller 206B may be coupled via the connection 115 to the light sensor 550 and the controller 206B may deactivate the switching element 218 for a small period of time (ex. 10 μs) sufficient to take a sample of ambient light levels without interference from the lighting module 104. This small period of time may be sufficiently short so as to not be visible to the human eye and not be detectable by the constant current driver 102. A more detailed description of a similar architecture is described within U.S. Pat. No. 8,941,308 by Briggs entitled "LIGHTING APPARATUS AND METHODS FOR CONTROLLING LIGHTING APPARATUS USING AMBIENT LIGHT LEVELS" issued on Jan. 27, 2015 and incorporated by reference in the present application.

In some states of operation of the control apparatus 110B of FIG. 2B, the switching element 218 may be turned off by the controller 206B for a period of time sufficient for the constant current driver 102 to detect a change in the load between the positive and negative rails 106, 108. In this scenario, the lighting module 104 would be disconnected from between the positive and negative rails 106, 108 and the load between the positive and negative rails 106, 108 would be limited to the voltage control module 202 that powers the controller 206B. Due to limited current requirements of the voltage control module 202, the constant current driver 102 will increase the output voltage across the positive and negative rails 106, 108 in an attempt to output the constant current output level that is preset in the driver. In the scenario in which the switching element 218 is turned off for sufficient time to limit the load across the positive and negative rails 106, 108 to the voltage control module 202, the constant current driver 102 will increase the voltage across the positive and negative rails 106, 108 to the maximum output voltage level for the constant current driver 102 and will not achieve the constant current output level preset in the driver. The maximum output voltage level for the constant current driver 102 may vary from driver to driver with the specific specifications being designed for various applications and conditions of use. In many Class 2 constant current drivers, the maximum output voltage level is set to be 60V, though other maximum output voltage levels may be designed into other drivers.

After the constant current driver 102 increases the voltage across the positive and negative rails 106, 108 to its maximum output voltage level due to the turning off of the switching element 218, the turning on of the switching element 218 can cause a high instantaneous voltage across the positive and negative rails 106, 108 to be applied to the lighting module 104. The constant current driver 102 will then detect the change in load across the positive and negative rails 106, 108 and lower the voltage across the positive and negative rails 106, 108 to bring the output current level to the constant current level preset in the driver. In a transitional time between when the switching element 218 is turned on and when the constant current driver fully lowers the voltage across the positive and negative rails 106, 108 to the level required to output the preset current level, a level of current will flow through the lighting module 104 based on the high voltage across the positive and negative rails 106, 108 rather than the specific voltage to output the preset current level from the driver 102. This difference in current levels for this limited transitional time can cause a difference in light level output from the lighting module 104 during the transitional time compared to the light level output from the lighting module 104 after the voltage across the positive and negative rails 106, 108 is set to the level required to output the preset current level from the driver 102. In some circumstances, this difference in light output from the lighting module 104 during the transitional time can appear like a bright flash of light at a high lumen level before a normal level of light is output from the lighting module 104.

This flash of light at a high lumen level may be considered undesirable to many users who may commonly control the lighting apparatus in manners that would turn on and off the switching element 218. For instance, some users may use an IR remote control (not shown) to control the lighting apparatus 100B through the IR remote sense 534 of the control interface 115. When turning off the lighting module 104, the user may select a button on the IR remote control that is detected at the IR remote sense 534 and a first control signal may then be transmitted to the controller 206B. In response to the first control signal, the controller 206B may then turn off the switching element 218. Subsequently, to turn on the lighting module 104, the user may select the same button or another button on the IR remote control that is detected at the IR remote sense 534 and a second control signal may then be transmitted to the controller 206B. In response to the second control signal, the controller 206B may then turn on the switching element 218. During this turn on process, the lighting module 104 may cause an undesirable flash of light at a high lumen level due to the high voltage level output from the constant current driver 102 during the time that the switching element 218 is turned off.

Similar to the control apparatus 110B of FIG. 2B, a high voltage level may be output from the constant current driver 102 during a period in which all of the switching elements 218A, 218B, 218C of the control apparatus 110C of FIG. 2C are turned off simultaneously or all of the switching elements 226A, 226B, 226C of the control apparatus 110D of FIG. 2D are turned off simultaneously or all of the switching elements 218A, 218B, 218C of the control apparatus 300A of FIG. 3A are turned off simultaneously or all of the switching elements 226A, 226B, 226C of the control apparatus 300B of FIG. 3B are turned off simultaneously. In these scenarios, similar to described for the control apparatus 110B of FIG. 2B, will effectively disconnect the corresponding lighting modules from being between the positive and negative rails 106, 108, leaving the voltage control module 202 as the load across the positive and negative rails 106, 108. As described, this change in the load coupled to the output of the constant current driver 102 can cause the constant current driver 102 to increase the voltage across the positive and negative rails 106, 108 up to a maximum output voltage level for the constant current driver 102. Subsequently, when any of the switching elements 218A, 218B, 218C of the control apparatus 110C of FIG. 2C are turned on or any of the switching elements 226A, 226B, 226C of the control apparatus 110D of FIG. 2D are turned on or any of the switching elements 218A, 218B, 218C of the control apparatus 300A of FIG. 3A are turned on or any of the switching elements 226A, 226B, 226C of the control apparatus 300B of FIG. 3B are turned on, an instantaneous high voltage level may be applied between the positive and negative rails 106, 108 that may result in current flowing through the corresponding lighting modules to be high and a flash of light at a high lumen level to be output from the corresponding lighting modules until the constant current driver 102 adjusts to the change in the load and reduces the voltage across the positive and negative rails 106, 108 to output the preset current level for the driver.

To address the issue of lighting modules potentially outputting flashes of light at a high lumen level for a limited transitional time after turning on switching elements within the control apparatus, in some embodiments, the lighting apparatus may be adapted to mitigate the high voltage output by the constant current driver 102 prior to reconnecting a lighting module to the positive and negative rails 106, 108. In some embodiments, a buffer apparatus is connected to the output of the constant current driver 102 prior to turning on a lighting module in order to cause the constant current driver 102 to reduce the voltage across the positive and negative rails 106, 108. This reduction in the voltage across the positive and negative rails 106, 108 may be significant or may be minimal but, in any case, will bring the voltage output by the constant current driver 102 closer to the voltage required to provide the preset output current level to the lighting modules once connected to the output of the constant current driver 102. In some cases, once the buffer apparatus is coupled between the positive and negative rails 106, 108, the constant current driver 102 may reduce the voltage output to a level below the voltage required to provide the preset output current level to the lighting modules once connected to the output of the constant current driver 102.

Once the buffer apparatus is coupled between the positive and negative rails 106, 108 for a particular period of time or until the voltage across the positive and negative rails is reduced to a particular voltage level, the buffer apparatus can be disconnected from between the positive and negative rails 106, 108 and a lighting module can be connected between the positive and negative rails 106, 108. This temporary load on the output of the constant current driver 102 will cause a temporary delay in turning on the lighting module but can mitigate the potential of a flash of light at a high lumen level from being emitted by the lighting modules. A transitional time in which the voltage across the positive and negative rails 106, 108 is adjusted by the constant current driver 102 in response to the change in the output load may still take place, but the required change in the voltage across the positive and negative rails 106, 108 will be reduced.

Figure 7B:
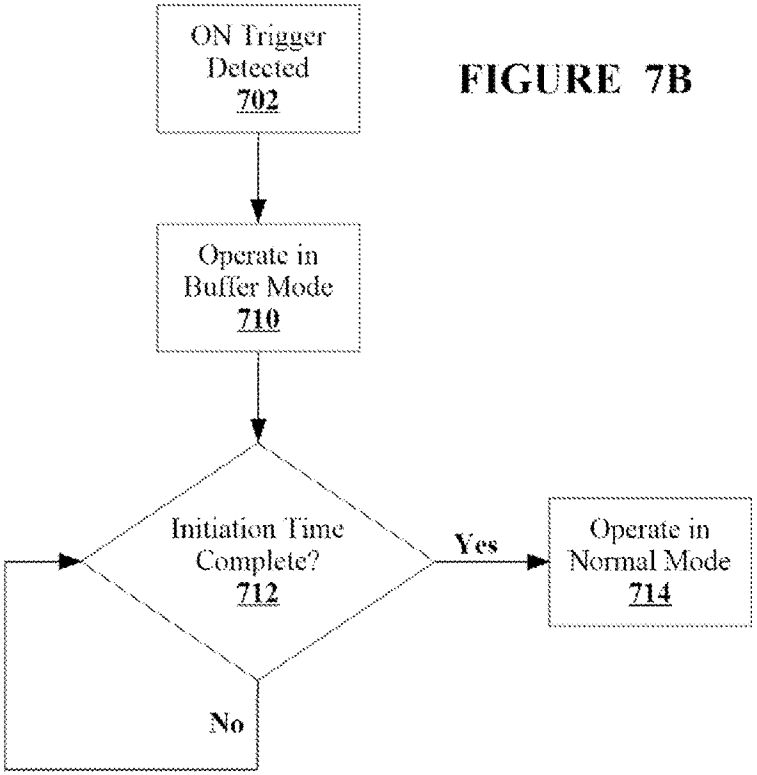
FIGS. 7A and 7B are flow charts illustrating processes initiated during activation of a lighting apparatus after a period of deactivation according to embodiments of the present invention.
Figure 7A:
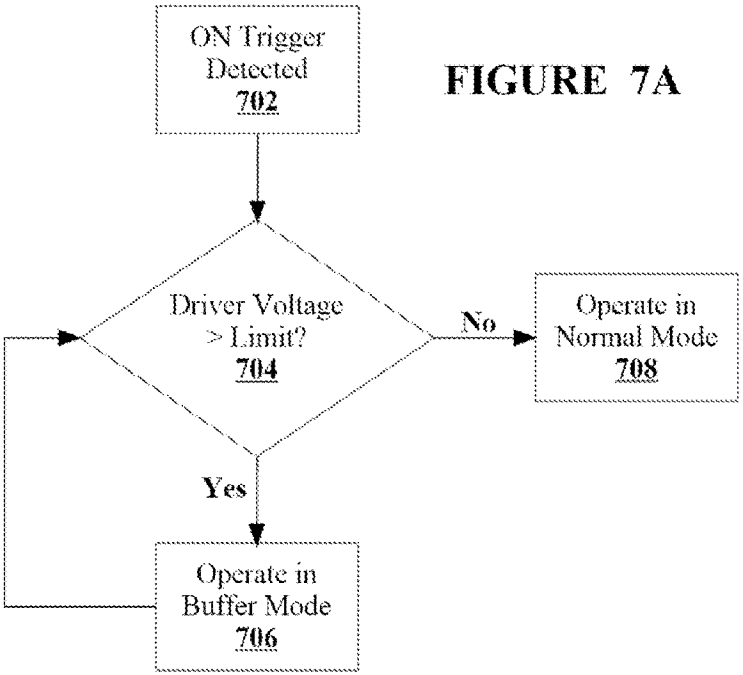

FIGS. 7A and 7B are flow charts illustrating processes initiated during activation of a lighting apparatus after a period of deactivation according to embodiments of the present invention. The processes of FIGS. 7A and 7B can be implemented by a controller, such as controller 206B, to determine whether to operate in a buffer mode or a normal mode. In the buffer mode, the controller directs the current from the driver to a buffer load module, either continuously until the driver voltage is no longer above the predetermined voltage limit or intermittently until the driver voltage is no longer above the predetermined voltage limit. In the normal mode, the controller does not direct the current from the driver to the buffer load module and instead modulates activation of channels within the lighting module as it would otherwise have done with a particular duty cycle of activation for each channel Specific implementations for the buffer mode and the normal mode are described in detail with reference to FIGS. 9A/10A and 9B/10B.

As shown in FIG. 7A, during activation of a lighting apparatus, the controller will detect an ON trigger at step 702. This may take the form of a direct wireless or wired signal via a control interface through connection 115 or may alternatively be triggered by any one of a series of processes as a result of the components 500. For instance, in some embodiments, an ON trigger may be detected if the motion sense module 516 detects motion, if the light sense module 520 detects insufficient ambient light levels or if the audio sense module 532 detects a particular audio indication. It should be understood that other processes could be used to detect an ON trigger as one skilled in the art would understand. In response to detection of the ON trigger, the controller determines whether the driver voltage across the positive and negative rails 106, 108 is above a predetermined voltage limit for the lighting module at step 704. The predetermined voltage limit could be a preprogrammed level which is stored within the controller at time of programming or could be a dynamic level that the controller bases off of previous experience. For instance, the controller may store a previous voltage level that the lighting module typically operates at and uses a voltage level substantially similar to this previous voltage level or a voltage level below the previous voltage level as the predetermined voltage limit. If the driver voltage is above the predetermined voltage limit in step 704, the controller operates in the buffer mode at step 706, while continuing to monitor whether the driver voltage remains above the predetermined voltage limit at step 704. If the driver voltage is not above the predetermined voltage limit at step 704, the controller operates in the normal mode.

FIG. 7B is directed to an alternative implementation of the process of FIG. 7A in which, rather than compare voltage levels, the controller adds a delay period during which the controller operates in the buffer mode. As shown, after an ON trigger is detected at step 702, the controller operates in the buffer mode at step 710 without necessarily measuring the voltage level output from the driver. The controller then waits for an initiation time to be completed at step 712 prior to then operating in the normal mode at step 714. In the embodiment of FIG. 7B, the controller is adding in a delay to ensure the voltage output from the driver is acceptable for the lighting module without specifically comparing the driver voltage to a predetermined voltage limit for the lighting module.

Figure 8A:
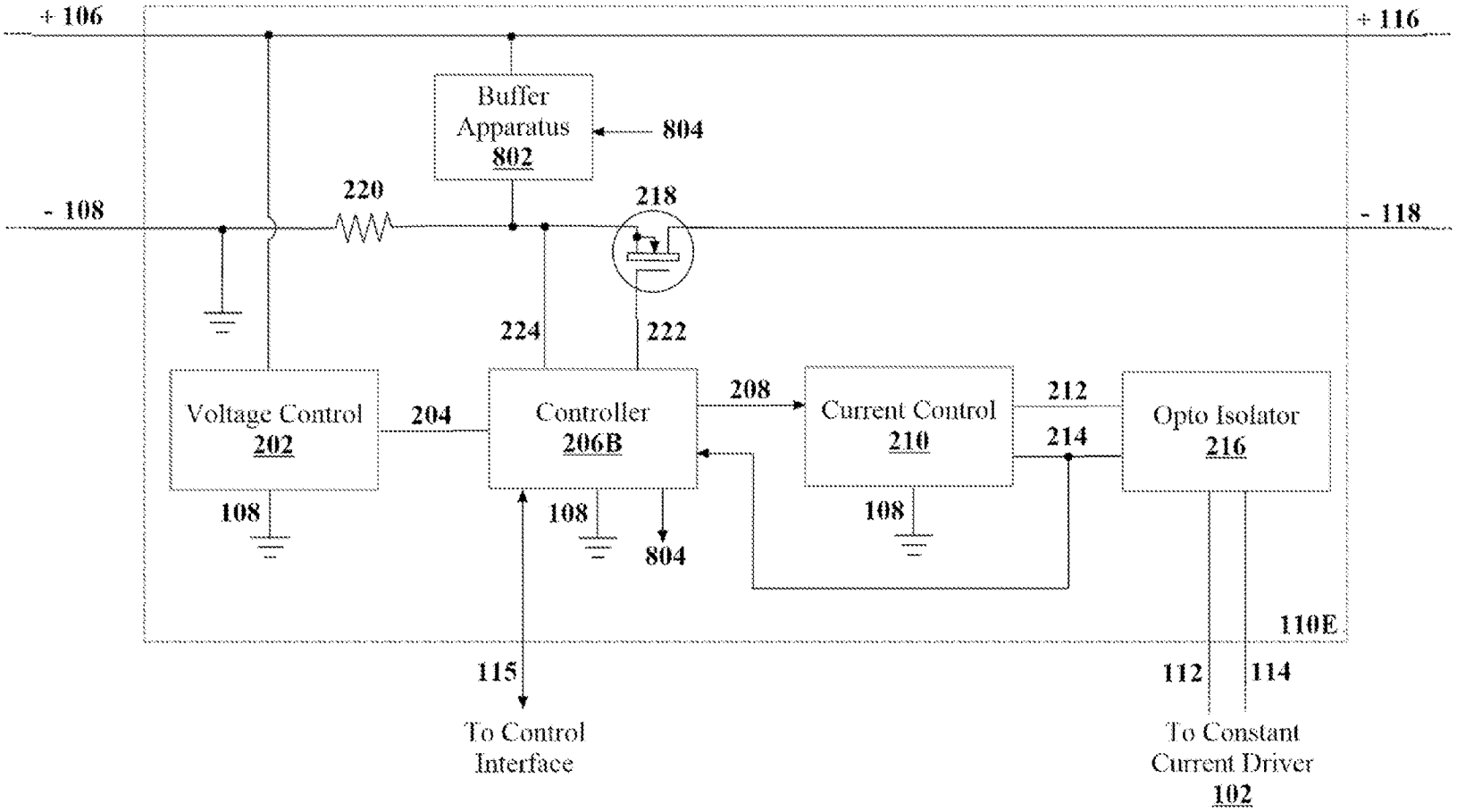
FIG. 8A is a block diagram of the control apparatus of FIGS. 2B to 2D with a buffer apparatus according to one embodiment of the present invention.
Figure 8C:
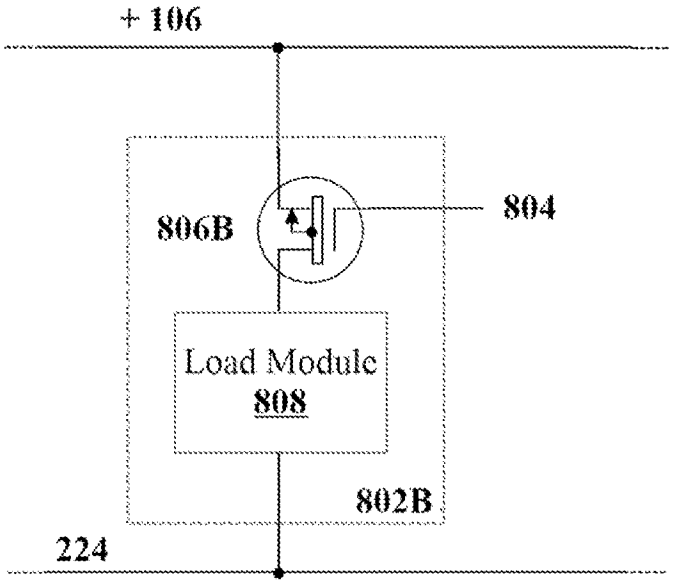
FIGS. 8B and 8C are circuit diagrams of implementations of buffer apparatus according to sample embodiments of the present invention.
Figure 8B:
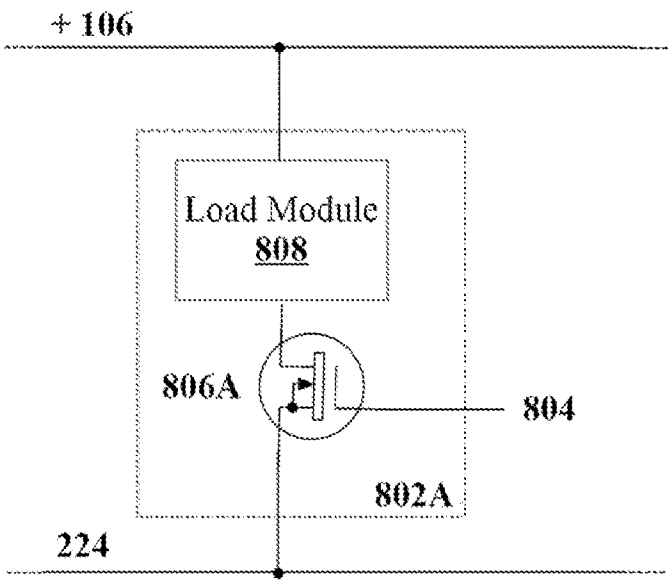

There are a wide range of potential architectures for implementing buffer modules within the lighting apparatus embodiments of the present invention. FIG. 8A is a block diagram of the control apparatus of FIGS. 2B to 2D with a buffer apparatus 802 according to one embodiment of the present invention. As shown, control apparatus 110E is similar to control apparatus 110B but with the buffer apparatus 802 implemented between the positive rail 106 and the node 224 and the input filter 240 removed for simplicity. The buffer apparatus 802 is controlled by buffer control signal 804 output from the controller 206B. FIGS. 8B and 8C are circuit diagrams of implementations of the buffer apparatus 802 according to sample embodiments of the present invention. As shown in FIG. 8B, buffer apparatus 802A comprises a switching element 806A coupled in series with a load module 808, wherein the switching element 806A is a transistor coupled between the load module 808 and a low voltage node such as the node 224 or the negative rail 108. In this configuration, the switching element 806A can be implemented as an N-channel transistor controlled by the buffer control signal 804. As shown in FIG. 8C, buffer apparatus 802B comprises a switching element 806B coupled in series with the load module 808, wherein the switching element 806B is a transistor coupled between a high voltage node such as positive rail 106 or positive rail 116. In this configuration, the switching element 806B can be implemented as a P-channel transistor controlled by the buffer control signal 804.

Figure 8D:
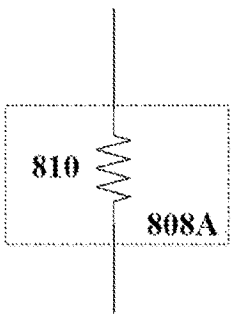
FIGS. 8D-8G are circuit diagrams of sample implementations of buffer load modules according to embodiments of the present invention.
Figure 8E:
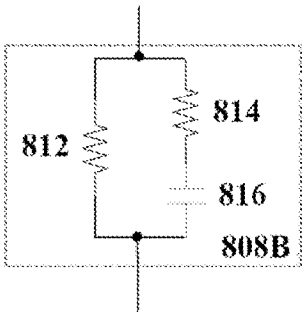
Figure 8F:
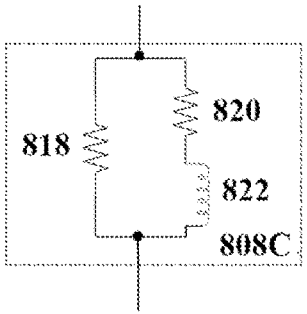
Figure 8G:
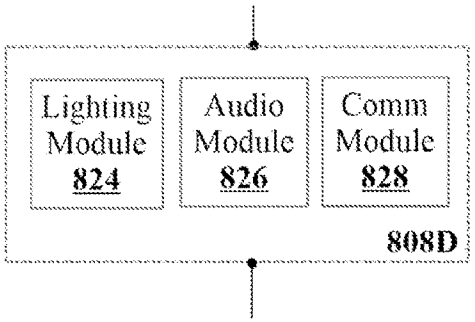

The implementation of the load module may take many forms. FIGS. 8D-8G are circuit diagrams of sample implementations of buffer load modules according to embodiments of the present invention. As shown in FIG. 8D, a load module 808A comprises a resistor 810. As shown in FIG. 8E, a load module 808B comprises a resistor 812 coupled in parallel with a second resistor 814 and a capacitor 816 coupled together in series. As shown in FIG. 8F, a load module 808C comprises a resistor 818 coupled in parallel with a second resistor 820 and an inductor 822 coupled together in series. Each of these implementations are modules designed to dissipate energy for a short period of time. Alternatively, the load module may comprise a functional element as shown in FIG. 8G. In this case, a load module 808D may be implemented that may comprise one or more functional elements such as a lighting module 824, an audio module 826 and a communications module 828. The lighting module 824 may be used to provide an indication light when activated. The audio module 826 may be used to provide an audio indication when activated. The communication module 828 may be used to send a communication signal when activated. Each of these load modules of FIGS. 8D-8G can be activated when the controller is in the buffer mode and be used to dissipate energy from the driver during the buffer mode.

The controller 206B can activate current to flow through the buffer apparatus 802 with the buffer control signal 804. If the controller 206B activates the switching element within the buffer apparatus 802 and deactivates the switching element 218, current will flow through the buffer apparatus 802. If the controller 206B activates the switching element 218 and deactivates the switching element within the buffer apparatus 802, current will flow through the attached lighting module 104 and not through the buffer apparatus 802.

Figure 8H:
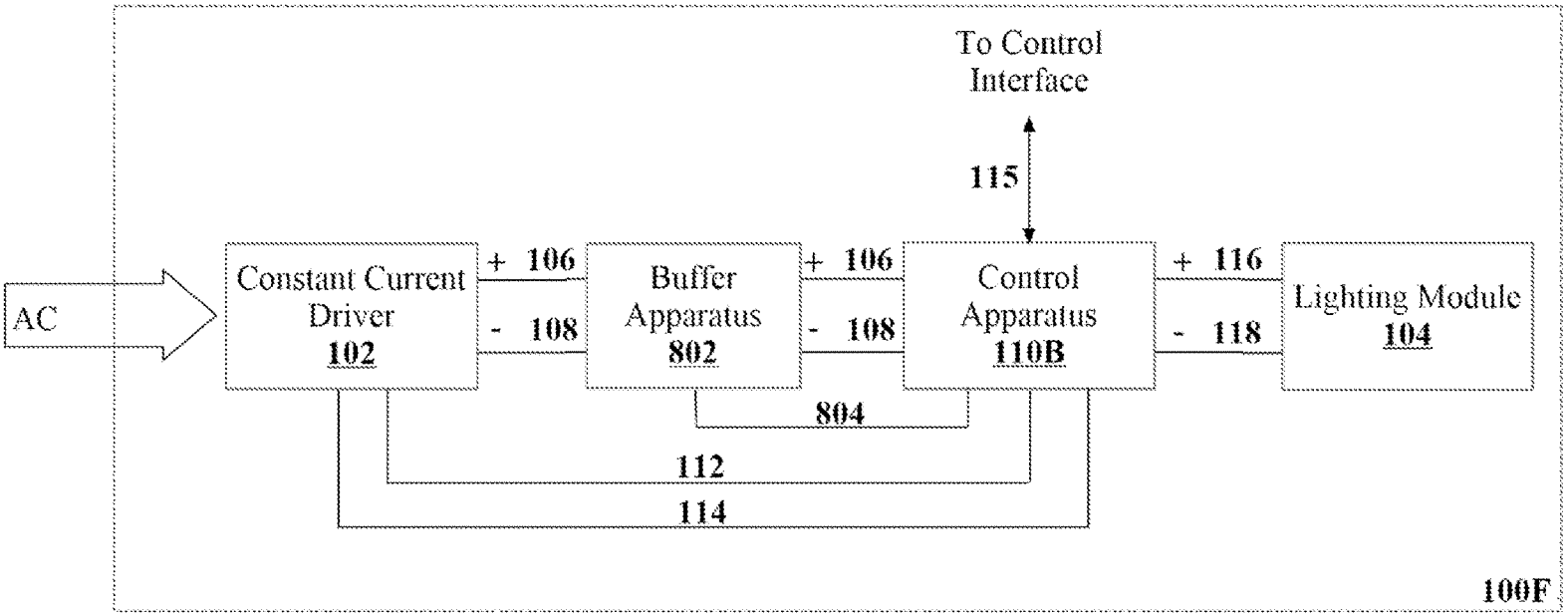
FIG. 8H is a block diagram of the lighting apparatus of FIG. 1B implemented with a buffer apparatus according to an embodiment of the present invention.

In some embodiments, the buffer apparatus may be implemented external to the control apparatus 110B. FIG. 8H is a block diagram of a lighting apparatus 100F similar to the lighting apparatus 100B of FIG. 1B but implemented with the buffer apparatus 802. In this case, the buffer apparatus 802 is coupled between the positive and negative rails 106, 108 and is controlled by the buffer control signal 804 output from the control apparatus 110B. When activated, the buffer apparatus 802 enables current to flow from the positive rail 106 through its load module to the negative rail 108, thus limiting current flow to the lighting module 104.

Figure 8I:
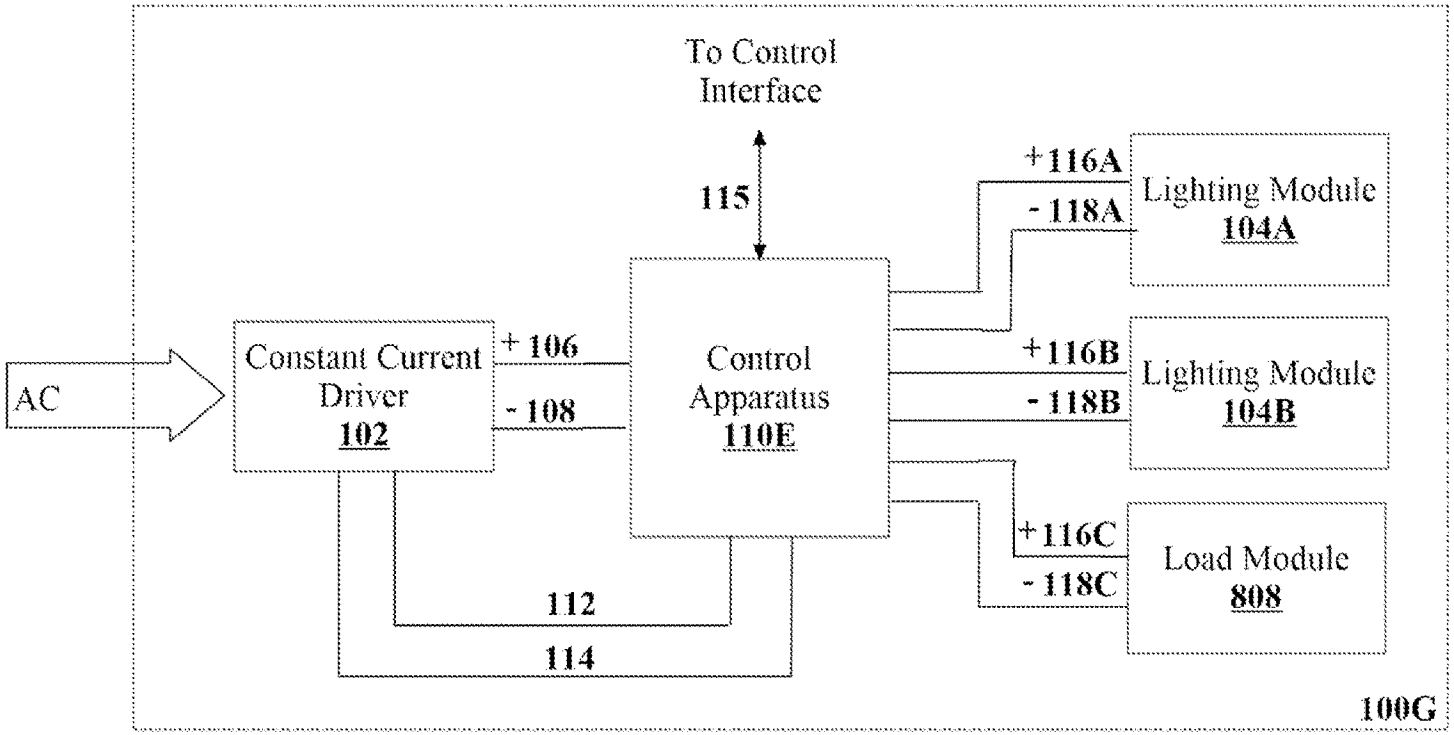
FIG. 8I is a block diagram of the lighting apparatus of FIG. 1E implemented with a buffer load module according to an embodiment of the present invention.

FIG. 8I is a block diagram of the lighting apparatus of FIG. 1E implemented with a buffer load module according to an embodiment of the present invention in which one of the lighting modules is replaced by a load module 808. In this case, the control apparatus 110E controls current flow to the load module 808 by controlling positive rail 116C and negative rail 118C. This may be based on controlling a switching element on the negative rail 118C similar to that described with reference to FIG. 2C. In this case, the control apparatus 110E may allow current flow to the load module 808 during the buffer mode and allow current flow to one of the lighting modules 104A, 104B during the normal mode.

Figure 8J:
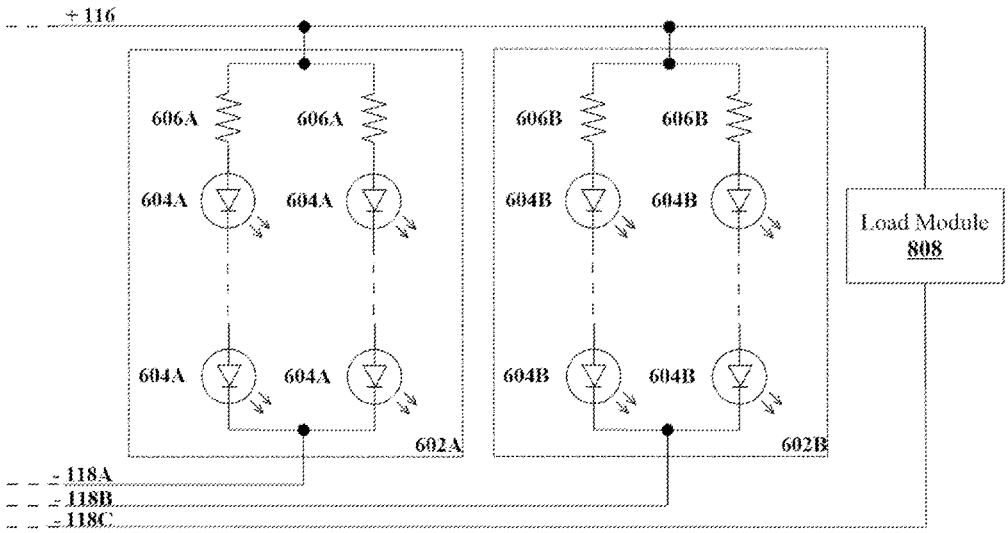
FIGS. 8J and 8K are block diagrams of lighting modules including buffer load modules external to the control apparatus according to various embodiments of the present invention.
Figure 8K:
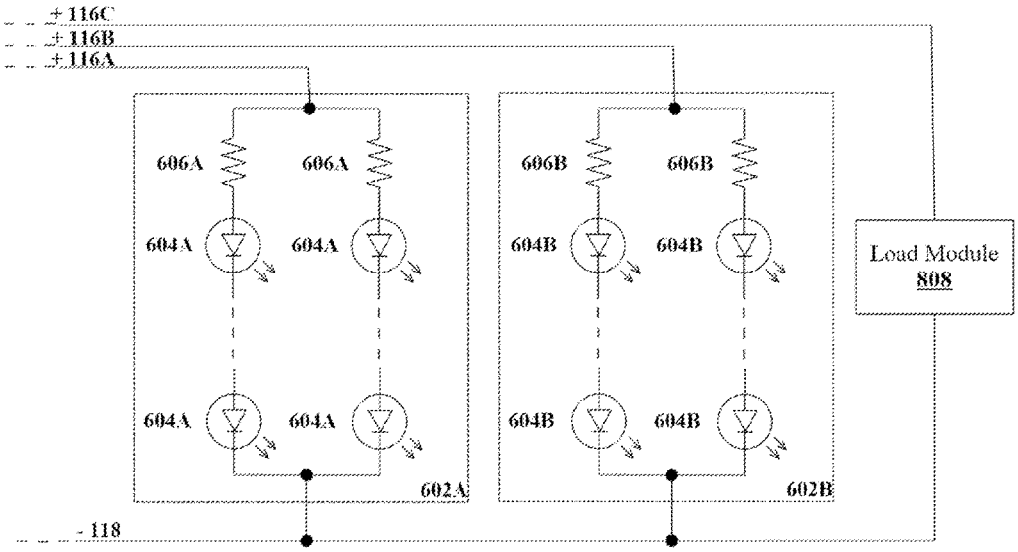

FIGS. 8J and 8K are block diagrams of lighting modules including buffer load modules external to the control apparatus. FIG. 8J is similar to FIG. 6B but with the LED group 602C replaced by the load module 808. FIG. 8K is similar to FIG. 6C but with the LED group 612C replaced by the load module 808. In both of these cases, the load module 808 may be implemented as an integral part of the lighting module. In the case of the implementation of FIG. 8J, the control apparatus 110C controls current flow to the load module 808 by controlling negative rail 118C. This may be based on controlling a switching element on the negative rail 118C similar to that described with reference to FIG. 2C. In this case, the control apparatus 110C may allow current flow to the load module 808 during the buffer mode and allow current flow to one of the LED groups 602A, 602B during the normal mode. In the case of the implementation of FIG. 8K, the control apparatus 110D controls current flow to the load module 808 by controlling positive rail 116C. This may be based on controlling a switching element on the positive rail 116C similar to that described with reference to FIG. 2D. In this case, the control apparatus 110D may allow current flow to the load module 808 during the buffer mode and allow current flow to one of the LED groups 612A, 612B during the normal mode.

Figure 9A:
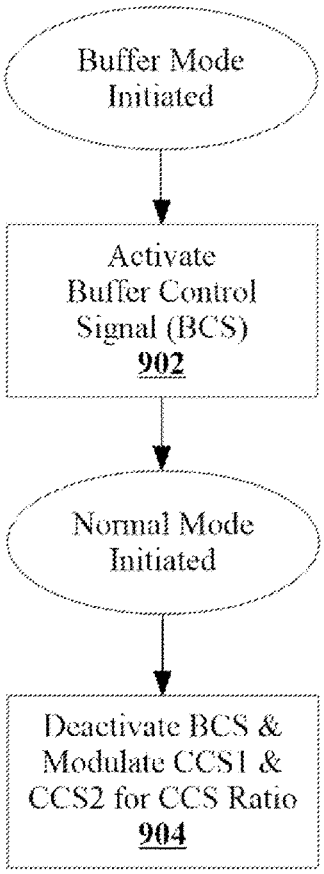
FIGS. 9A, 9B and 9C are flow charts illustrating buffer mode and normal mode processes implemented by a controller after a period of deactivation according to embodiments of the present invention.
Figure 10A:
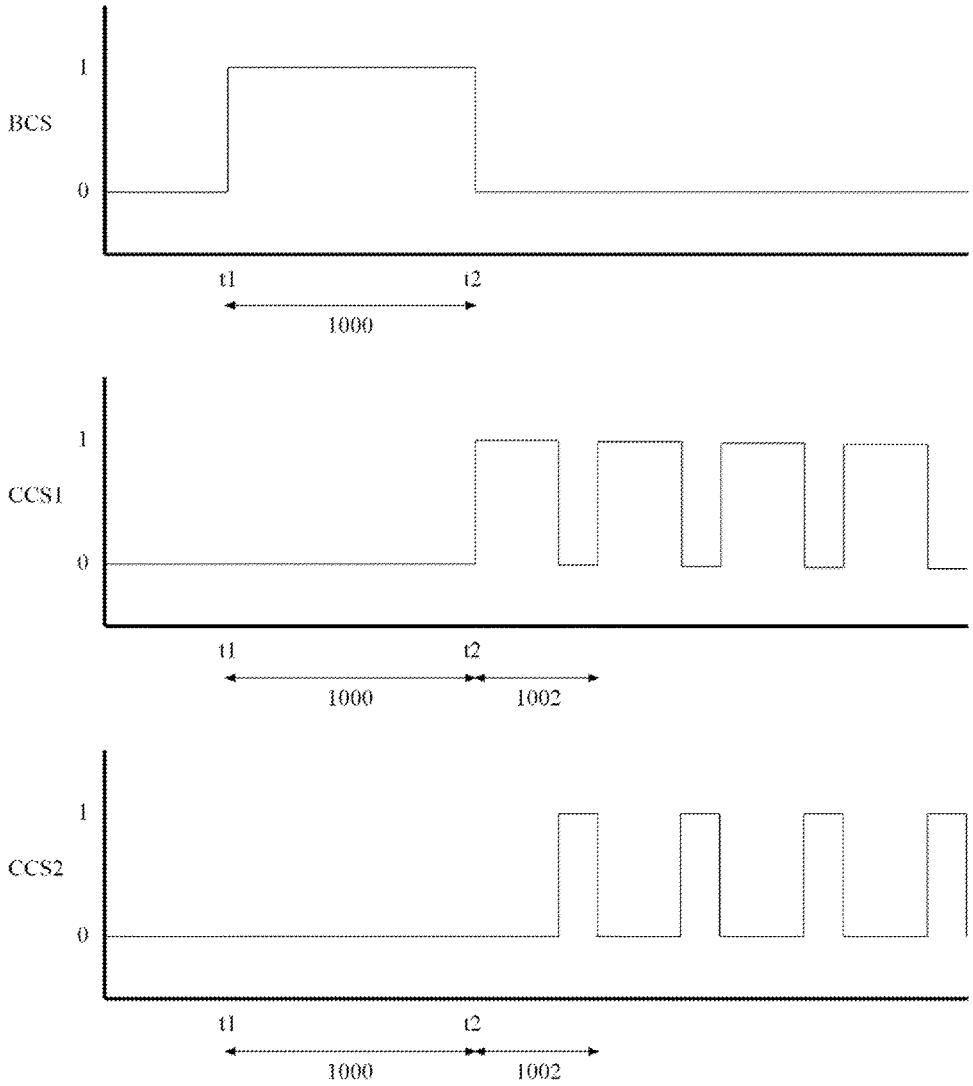
FIGS. 10A, 10B and 10C are signaling diagrams illustrating sets of sample control signals resulting from the processes of FIGS. 9A, 9B and 9D respectively.

FIG. 9A is a flow chart illustrating buffer mode and normal mode processes implemented by a controller after a period of deactivation according to an embodiment of the present invention and FIG. 10A is a signaling diagram illustrating a set of sample control signals resulting from the process of FIG. 9A. As shown in FIG. 9A, when a buffer mode is initiated, the controller activates a buffer control signal (BCS) at step 902. This is illustrated in FIG. 10A in the top chart in which the BCS signal is activated for a time period 1000 from time t1 to time t2. During the time period 1000, the controller activates the buffer apparatus to direct current from the driver to the buffer load module. The length of time period 1000 may be determined based upon the controller monitoring the driver voltage relative to a predetermined voltage limit as described with reference to FIG. 7A or may be a predefined time period as described with reference to FIG. 7B.

Subsequently, as shown in FIG. 9A, when the normal mode is initiated, the controller deactivates BCS and modulates activation of a first channel control signal (CCS1) and a second channel control signal (CCS2) at step 904. This is illustrated in FIG. 10A in the top chart in which BCS is deactivated after time t2 and in the middle and bottom chart in which CCS1 and CCS2 are alternately activated within a cyclical period 1002 after time t2. In the specific implementation illustrated in FIG. 10A, CCS1 is activated for a 75% duty cycle within the period 1002 and CCS2 is activated for a 25% duty cycle within period 1002, thus leading to a channel control signal (CCS) ratio of 75/25. It should be understood that other CCS ratios could be implemented and other modulation techniques could be implemented as will be described with reference to FIGS. 11A, 11B and 11C. Also, although depicted on a similar scale, it should be understood that the time period 1000 may be much different than the cyclical period 1002 in which CCS1 and CCS2 are modulated and may not be easily depicted on a chart together. In some instances, time period 1000 may be longer than the period 1002 by many magnitudes while, in other instances, time period 1000 may be shorter than the period 1002 by many magnitudes.

Figure 9B:
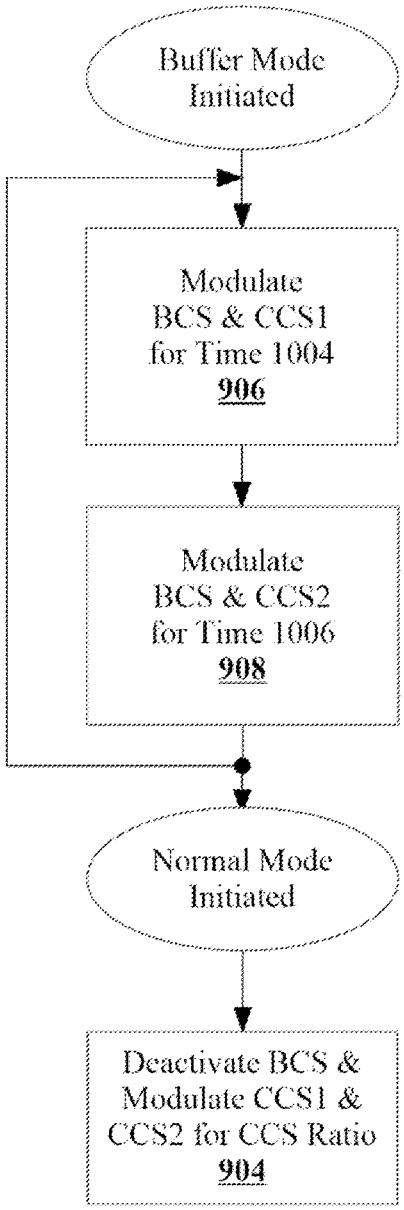
Figure 10B:
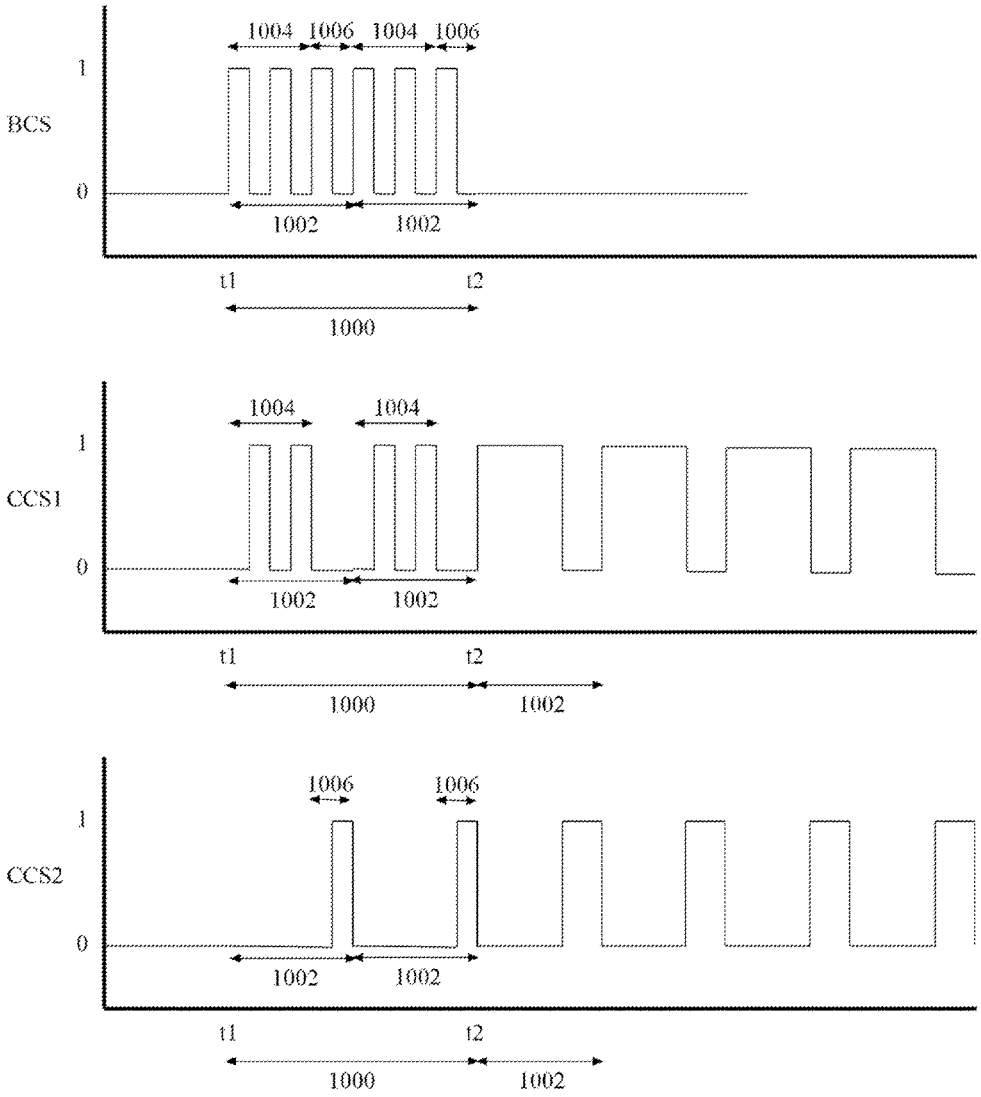

FIG. 9B is a flow chart illustrating alternative buffer mode and normal mode processes implemented by a controller after a period of deactivation according to an embodiment of the present invention and FIG. 10B is a signaling diagram illustrating a set of sample control signals resulting from the process of FIG. 9B. As shown in FIG. 9B, when the buffer mode is initiated, the controller modulates activation of BCS and CCS1 for a time period 1004 at step 906 and modulates activation of BCS and CCS2 for a time period 1006 at step 908. In this case, a cyclical period 1002 for the modulation of CCS1 and CCS2 is the sum of the time period 1004 and the time period 1006. This is illustrated in FIG. 10B in the top and middle charts in which BCS and CCS1 are alternately activated for a time period 1004 and in the top and bottom charts in which BCS and CCS2 are alternately activated for a time period 1006. The controller continues to modulate BCS with alternately CCS1 and then CCS2 for one or more cyclical periods 1002, until the time t2. In FIG. 10B, the signal diagrams illustrate two full cyclical periods 1002 within the buffer mode between time t1 and time t2. It should be understood that other quantities of cyclical periods may be implemented, including partial periods, while the controller is within the buffer mode between time t1 and time t2.

By modulating BCS with alternately CCS1 and then CCS2, the controller can partially activate the buffer apparatus while not significantly delaying the activation of light emitting from the light apparatus. Effectively, the ratio of BCS activation time to channel control signal (either CCS1 or CCS2) activation time is proportional to a reduction in intensity of the light emitted from the lighting apparatus. In the specific implementation of FIG. 10B, BCS has a duty cycle of 50%, CCS1 has a duty cycle of 33.3% and CCS2 has a duty cycle of 16.7% and the ratio of activation time between BCS and the channel control signals (CCS1 and CCS2) is 50%, which would result in approximately 50% reduction in intensity of light emitted from the lighting apparatus. It should be understood that other duty cycles for BCS, CCS1 and CCS2 and other ratios of activation of BCS and the channel control signals could be used. In some embodiments, the duty cycles and ratio could change over the buffer mode time period 1000. For instance, initially, BCS could have a high duty cycle and be activated for all or most of the time periods 1004 and 1006 and then the duty cycle could be decreased with the activation progressively less of a proportion of the time periods 1004 and 1006 in each subsequent cyclical period 1002. In this implementation, the controller could increase the duty cycle of one or both of CCS1, CCS2 and progressively increase the proportion of the time segments in which light is emitted by the lighting apparatus as the driver adjusts to the addition of the load and lowers its output voltage. Subsequently, as shown in FIG. 9B, when the normal mode is initiated, the controller deactivates BCS and modulates activation between CCS1 and CCS2 at step 904 similar to described for FIG. 9A based on particular duty cycles for CCS1 and CCS2. This is illustrated in FIG. 10B in the top chart in which BCS is deactivated after time t2 and in the middle and bottom chart in which CCS1 and CCS2 are alternately activated within period 1002 after time t2.

In some embodiments, depending upon the components used in the buffer load module, a maximum wattage can be adsorbed by the buffer load module before potentially having a thermal event such as burning. To address this issue, some algorithms may be developed to decrease the voltage across the constant current driver while ensuring the maximum wattage is not exceeded on the buffer load module. Further, in some embodiments, reducing the proportion of the time segments in which light is emitted initially is not sufficient to prevent a flash of light being perceived. To address this issue, some algorithms may be developed that delay activation of the lighting module until the voltage output from the constant current driver is sufficiently reduced to prevent a flash of light.

Figure 9C:
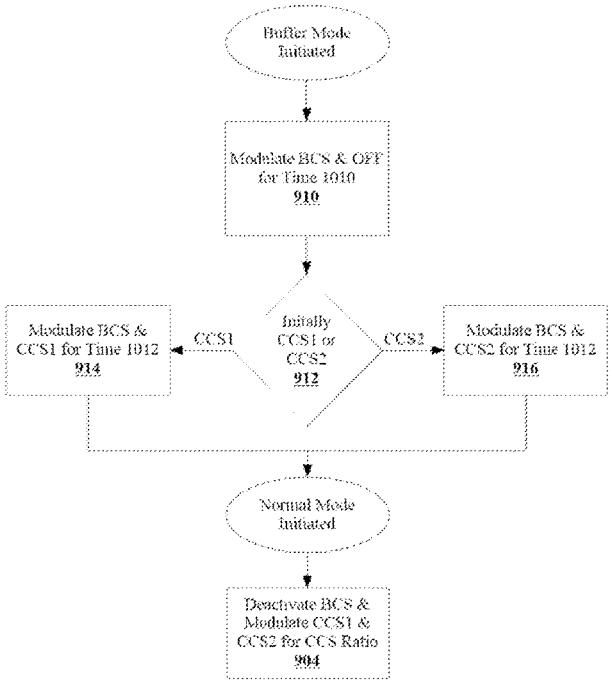

FIG. 9C is a flow chart illustrating alternative buffer mode and normal mode processes implemented by a controller after a period of deactivation according to an embodiment of the present invention. As shown at step 910 in this implementation, during a first initialization phase, the controller modulates activation of BCS with an off state in which all channels in the controller are deactivated and therefore the load detected by the constant current driver is in a high impedance state. Modulating between activation of BCS and the off-state results in the constant current driver detecting an average load lower than a high impedance state but also does not apply the full power of the constant current driver to the buffer load module consistently, which could cause thermal issues.

During a second initialization phase, the controller modulates activation of BCS with one of the channel control signals, CCS1 or CCS2. This is logically depicted in FIG. 9C, as a selection step 912 in which the controller determines which of CCS1 or CCS2 to activate during the second initialization phase followed by the controller modulating activation of BCS with CCS1 at step 914 if CCS1 was selected in step 912 or the controller modulating activation of BCS with CCS2 at step 916 if CCS2 was selected. In some embodiments, the selection of CCS1 or CCS2 may be done based upon the CCS ratio that is desired after initialization. For instance, if the CCS ratio indicates that CCS1 will be activated for a longer period of time than CCS2 in the normal mode, the controller may select CCS1 at step 912 while, if the CCS ratio indicates that CCS2 will be activated for a longer period of time than CCS1 in the normal mode, the controller may select CCS2 at step 912. The selection step 912 may also be completed prior to initialization and stored within the controller. In alternative embodiments, during the second initialization phase, the controller will modulate both CCS1 and CCS2 with BCS similar to that described with reference to FIGS. 9B and 10B, but with the first initialization phase being added prior to this second phase.

Subsequently, as shown in FIG. 9C, when the normal mode is initiated, the controller deactivates BCS and modulates activation between CCS1 and CCS2 at step 904 similar to described for FIG. 9A.

Figure 9D:
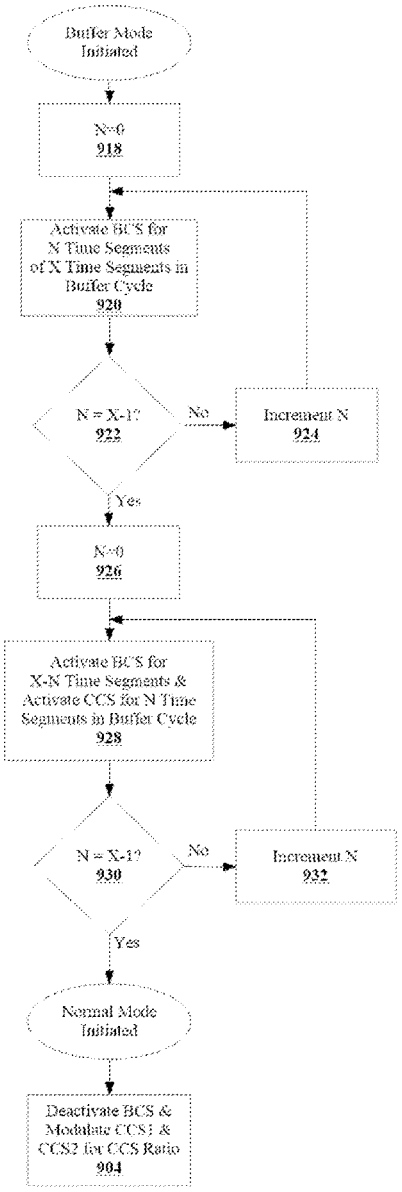
FIG. 9D is a flow chart illustrating a specific implementation of the embodiment of FIG. 9C according to an embodiment of the present invention.

FIG. 9D is a flow chart illustrating a specific implementation of the embodiment of FIG. 9C according to an embodiment of the present invention. In this specific implementation, a first phase of initialization is depicted in steps 918, 920, 922 and 924 which is one implementation for step 910 of FIG. 9C and a second phase of initialization is depicted in steps 926, 928, 930 and 932 which is one implementation for step 914 or 916 of FIG. 9C. As shown, in this specific implementation, the controller initially sets an integer N to zero at step 918 and activates BCS for N time segments within a buffer cycle of X time segments at step 920 which sets a duty cycle of BCS to N/X. At step 922, the controller determines if the variable N is equal to X−1, i.e. the number of time segments within the buffer cycle minus one. If the variable N is not equal to X−1, the controller increments N at step 924 and repeats steps 920 and 922 in the next buffer cycle. In this case, N is an integer variable initially set to zero that increases each buffer cycle with the resulting duty cycle for BCS increasing each subsequent cycle. Depending on implementation, the variable N may be increased by one or more than one each buffer cycle. For instance, in a case in which a 3-bit PWM is used, X may be eight and N may be incremented by one each buffer cycle but in higher PWM algorithms, N may be incremented by more than one each cycle.

If the variable N is equal to X−1 at step 922, the second phase of initialization is initiated and the controller resets N to zero at step 926. The resetting of the N variable may be performed by incrementing the N variable by 1 and having the variable reset to 0 as the counter overflows, though other means for resetting the variable could be implemented. Subsequently, the controller activates BCS for X−N time segments and a channel control signal (CCS) for N time segments in the X time segments of the buffer cycle at step 928, thus resulting in a duty cycle for BCS of (X−N)/X and a duty cycle for CCS of N/X. At this stage of this particular implementation, the first buffer cycle of the second phase would have BCS activated for the entire buffer cycle of X time segments (100% duty cycle). Subsequently, the controller determines if the variable N is equal to X−1 at step 930 (similar to previous step 922) and, if N is not equal to X−1, the controller increments the variable N at step 932 and repeats step 928 and 930 in the next buffer cycle. In this case, N is an integer variable initially set to zero that increases each buffer cycle with the resulting duty cycle for BCS decreasing each subsequent cycle and the resulting duty cycle for CCS increasing each subsequent cycle. Depending on implementation, the variable N may be incremented by one or more than one each buffer cycle. For instance, in a case in which a 3-bit PWM is used, X may be eight and N may be incremented by one each buffer cycle but in higher PWM algorithms, N may be incremented by more than one each cycle. If the variable N is equal to X−1 at step 930, the controller proceeds to the normal mode and deactivates BCS and modulates between CCS1 and CCS2 to implement the desired CCS ratio at step 904.

It should be understood that the specific algorithm of FIGS. 9C and 9D is only a sample implementation and firmware and/or software design could lead to use of different variables and buffer cycle lengths and duty cycles for BCS and CCS and specific equations/functions to achieve a similar end. For instance, although described with the buffer cycle during the first phase and the buffer cycle during the second phase being the same time period, the buffer cycles could comprise first and second buffer cycles that are of different number of cycles and/or time segments per cycle. For instance, in some embodiments, the controller may implement an A-bit PWM with $2^A$ time segments for the first phase and the controller may implement an B-bit PWM with $2^B$ time segments for the second phase, where A and B are integers that are different. Computational simplicity is an advantage of keeping the buffer cycle time period the same in the first and second phases.

In implementing the algorithm depicted in FIG. 9D, the duty cycle of BCS increases for a plurality of cycles within a first phase of the buffer time period and then the duty cycle of BCS decreases and the duty cycle of CCS increases for a plurality of cycles within a second phase of the buffer time period. It should be understood that the duty cycle of BCS and CCS could change differently or be constant in some implementations. For example, in some embodiments, the duty cycle of BCS or CCS may only be adjusted a defined number of times, such as once or twice, over the plurality of cycles in the first or second phase of the buffer time period and not adjusted each cycle. Further, in other embodiments, one of BCS or CCS may have a static duty cycle while the other signal has an increasing or decreasing duty cycle, potentially with time segments within the cycle in which there is an off-state in which both BCS and CCS are deactivated.

In some embodiments, other techniques for time multiplexing a signal such as BCS and an off-state may be used and other techniques for time multiplexing two or more signals such as BCS and CCS may be used. For instance, in some embodiments, a signal may be activated more than once within a cycle resulting in multiple pulses within the cyclical period. In some cases, delta-sigma modulation technique could be used which would generate a stream of pulses, rather a single pulse per cycle. More generally, a time period of activation within a cycle would comprise a duty cycle for the signal such as BCS or CCS, the duty cycle potentially comprising a plurality of pulses of consistent or varying pulse widths. Further, adjusting the time period for a cycle may also effectively adjust the activation time for a signal such as BCS or CCS. In this case, the duty cycle for the signals may stay constant or may be adjusted.

In some embodiments, only a single channel may be implemented and therefore the decision of which CCS to use in the process of FIG. 9C is not required and step 904 may be replaced with simply activation of the single channel control signal. In this embodiment, the benefits of implementing a buffer load as described may apply after a period of deactivation with only a modification to the normal mode.

Figure 10C:
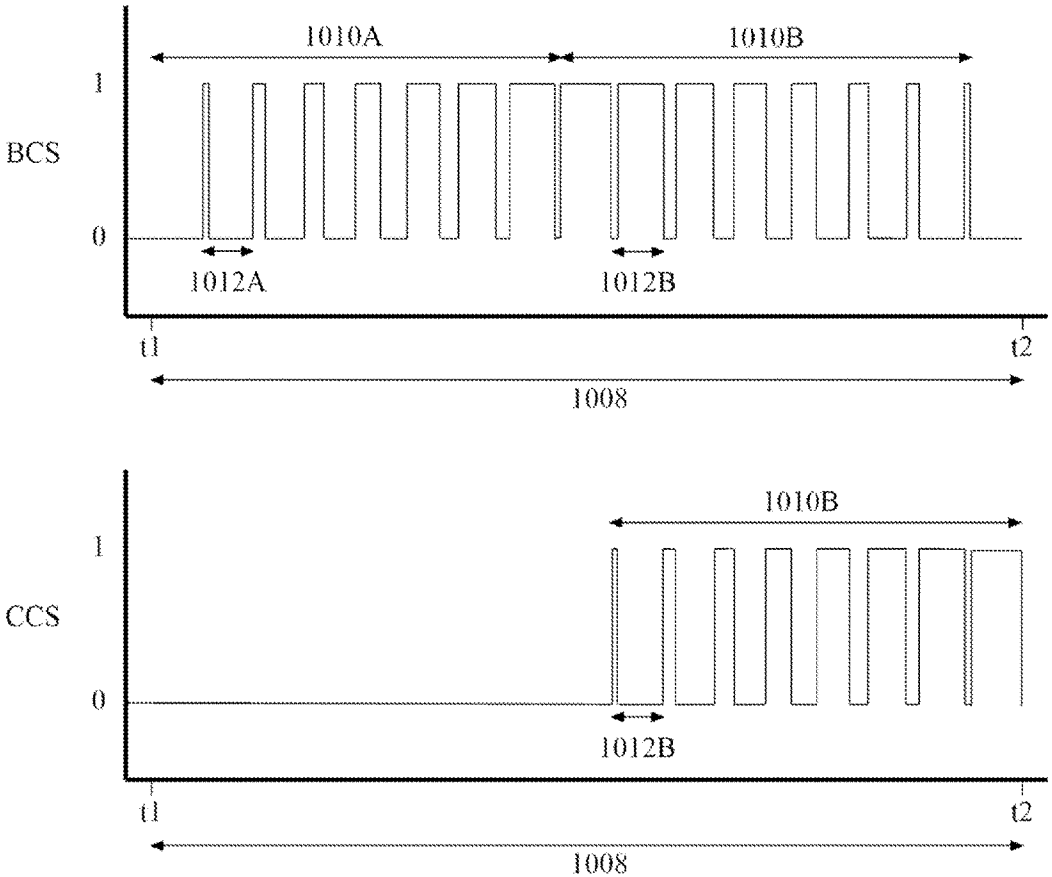

FIG. 10C is a signaling diagram illustrating a set of sample control signals resulting from the process of FIG. 9D. In this case, a buffer mode time period 1008 comprises a first phase 1010A and a second phase 1010B. The first phase 1010A comprises a plurality of first buffer cycles 1012A and the second phase 1010B comprises a plurality of second buffer cycles 1012B. In the implementation illustrated, during the first phase 1010A, BCS is modulated with an increasing duty cycle (or activation time period over the cycle) with each subsequent buffer cycle 1012A. Specifically, in this example, the activation time of BCS increases from 0 to 7 time segments of the 8 time segments within the first phase 1010A, resulting in an increase in duty cycle from 0% to 87.5%. During the second phase 1010B, BCS is modulated with a decreasing duty cycle (or activation time period over the cycle) and CCS is modulated with an increasing duty cycle (or activation time period over the cycle) with each subsequent buffer cycle 1012B. Specifically, in this example, the activation time of BCS decreases from 8 to 1 time segments of the 8 time segments, resulting in a decrease in duty cycle from 100% to 12.5%, and the activation time of CCS increases from 0 to 7 time segments within the second phase 1010B, resulting in an increase in duty cycle from 0% to 87.5%. The normal mode is not depicted in FIG. 10C for convenience. A similar normal mode could be implemented to that shown in FIGS. 10A and 10B or an alternative normal mode could be implemented in which only a single channel control signal is activated or a very different frequency of modulation is used in normal mode.

Figure 10D:
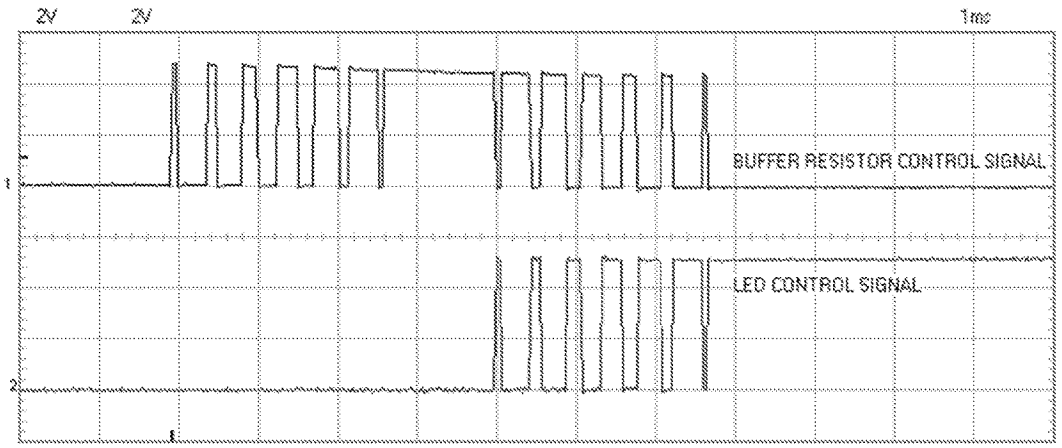
FIGS. 10D and 10E are charts depicting sample test data of a buffer control signal, a channel control signal and a voltage level output from a constant current driver according to one implementation.
Figure 10E:
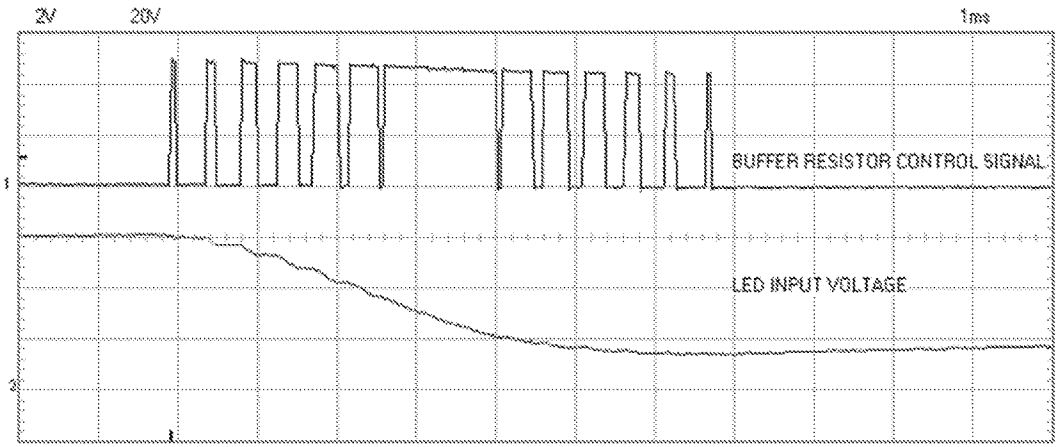

FIGS. 10D and 10E are charts depicting sample test data of a buffer control signal, a channel control signal and a voltage level output from a constant current driver according to one implementation. These charts depict readings measured in an implementation of the present invention in which a process similar to that described with reference to FIG. 9D is implemented. In this case, BCS (labelled as BUFFER RESISTOR CONTROL SIGNAL in FIGS. 10D and 10E) and CCS (labelled as LED CONTROL SIGNAL in FIG. 10D) are shown as 5V signals similar in pulse width to the chart of FIG. 10C. The chart of the constant current driver output voltage (labelled as LED INPUT VOLTAGE in FIG. 10E) illustrates a voltage initially at 60V that consistently decreases over the first and second phases of the buffer time period of BCS and CCS until it is below 20V in less than 5 ms. In this particular implementation, the lighting module has a forward voltage of approximately 18V and this is the eventual output voltage that the constant current driver provides once the initial adjustments occur after deactivation of the lighting module. It should be understood that the charts of FIGS. 10D and 10E are only one specific implementation and the results would be different depending upon the BCS and CCS modulation techniques selected, the lighting module used and the constant current driver used.

In some embodiments, CCS1 and CCS2 control activation of first and second LED groups respectively that comprise at least a subset of white LEDs of first and second color temperatures respectively. Further, in some embodiments of the present invention, only one of CCS1 and CCS2 are activated at a time and therefore all current output from the constant current driver flows to the LED group associated with the channel control signal that is activated at that particular time. By controlling CCS1 and CCS2 and selectively activating the first and second LED groups, a color temperature of the light emitted from the lighting apparatus as a whole can be adjusted if the light emitted by the first and second LED groups is mixed, either through an optic section of the lighting apparatus or an external mixing element. In one sample implementation, the first color temperature of the first LED group may be a low color temperature such as 1800K, 2000K, 2700K or 3000K while the second color temperature of the second LED group may be a higher color temperature such as 3500K, 4000K, 5000K or 6500K. It should be understood that any two different color temperatures could be used and the two color temperatures selected determine the maximum and minimum color temperatures of a color temperature range for the light that may be emitted by the lighting apparatus. A ratio of activation times or duty cycle between CCS1 and CCS2 determines the activation ratio between the first and second LED groups, which in turn determines the ratio of light emitted at a low color temperature and light emitted at a higher color temperature each cycle period.

In general, in this architecture, a resulting color temperature of the light emitted by the lighting apparatus will comprise a duty cycle for CCS1 multiplied by the first color temperature added to a duty cycle for CCS2 multiplied by the second color temperature. The result of this calculation is an estimate of the resulting color temperature of the lighting apparatus as different LEDs may have different flux outputs at the same current level. The best manner to determine the exact color temperature of the lighting apparatus at different activation ratios of CCS1 and CCS2 is to do either manual or automatic calibration in which a color temperature measurements device is used to measure a resultant color temperature as a result of a particular activation ratio of CCS1 and CCS2. For example, in a case that the first LED group comprises LEDs at 3000K and the second LED group comprises LEDs at 5000K, a ratio of activation between CCS1 and CCS2 can determine the color temperature of the light emitted by the lighting apparatus between 3000K and 5000K. If CCS1 has a duty cycle of 75% (i.e. is activated for 75% of the cycle period) and CCS2 has a duty cycle of 25% (i.e. is activated for 25% of the cycle period), a resulting color temperature for the lighting apparatus can be estimated to be substantially similar to 3500K. Similarly, if CCS1 has a duty cycle of 10% and CCS2 has a duty cycle of 90%, a resulting color temperature for the lighting apparatus can be estimated to be substantially similar to 4800K.

In some embodiments, there are a limited number of time segments within a cycle period that can be used for activation of CCS1 or CCS2. For instance, in some embodiments, the controller may have 256 time segments within a cycle period, though other number of time segments may be available. Within each time segment, the controller may activate either CCS1 or CCS2. Therefore, duty cycles for CCS1 and CCS2 and the activation ratio of CCS1 to CCS2 may be limited to dividing up the number of time segments available. To increase precision of the duty cycles and therefore the activation ratio between CCS1 and CCS2, the controller may implement a dithering scheme in which more than one duty cycle (i.e. number of time segments of activation per cycle) for each control signal is used over a fine control period. In this case, an average of the duty cycles for the control signals used over the fine control period can allow for additional activation ratios to be implemented which can result in additional granulation of the control over the color temperature of the light emitted by the lighting apparatus.

Figure 11A:
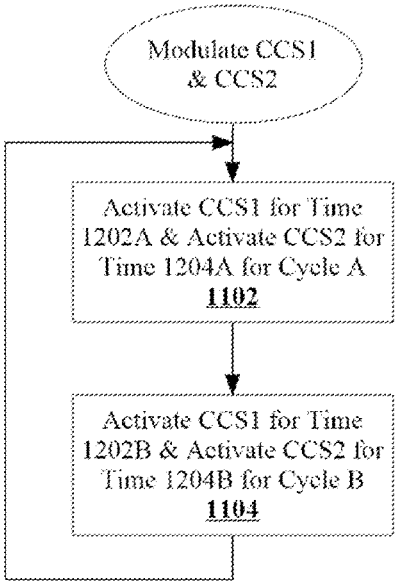
FIGS. 11A and 11B are flow charts illustrating processes implemented by a controller to modulate activation between control signals using ratio dithering according to embodiments of the present invention.
Figure 12A:
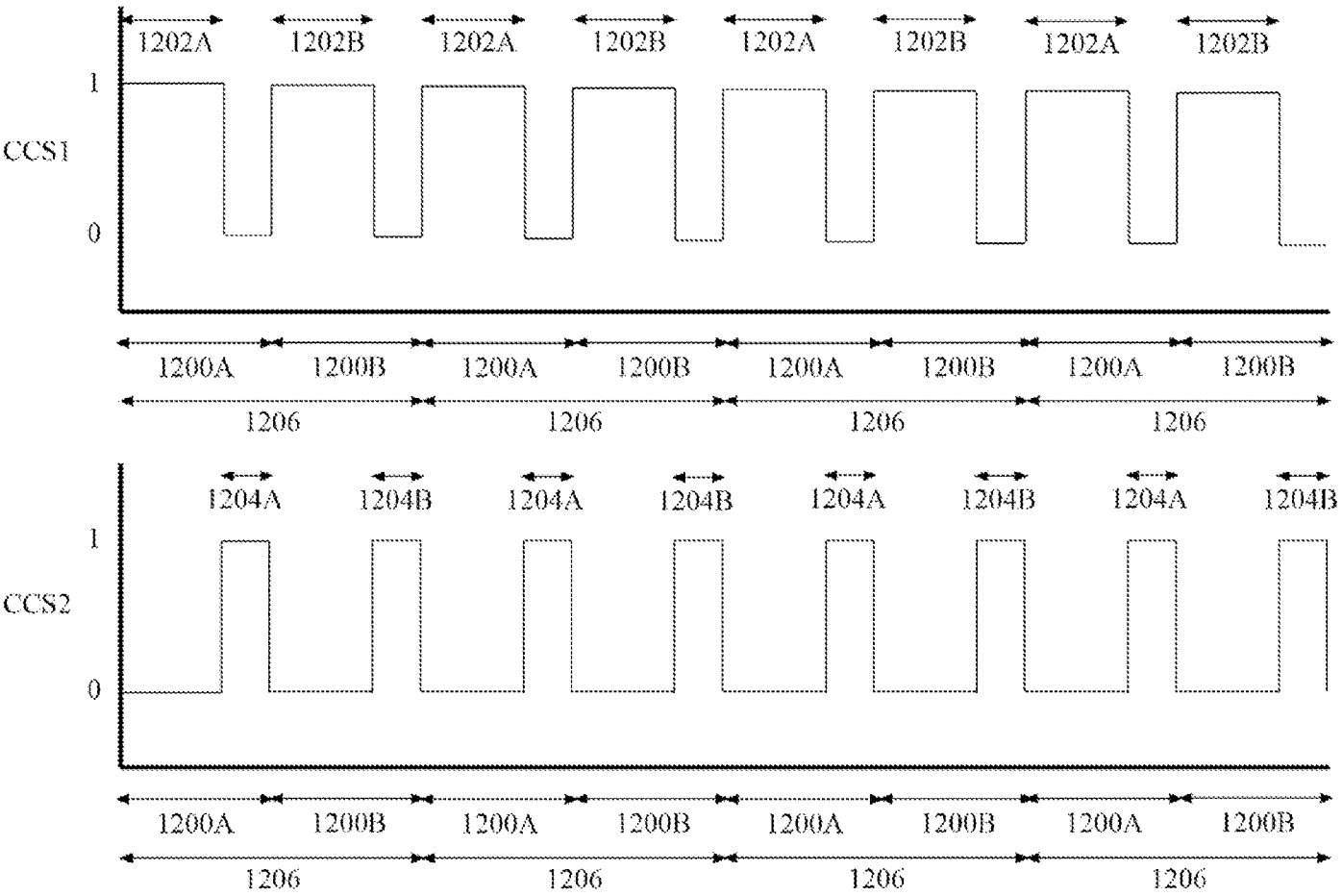
FIGS. 12A and 12B are signaling diagrams illustrating a set of sample control signals resulting from the processes of FIGS. 11A and 11B respectively.

FIG. 11A is a flow chart illustrating a process implemented by a controller to modulate activation between control signals using ratio dithering according to an embodiment of the present invention. FIG. 12A is a signaling diagram illustrating a set of sample control signals resulting from the process of FIG. 11A. As shown at step 1102, the controller activates CCS1 for time period 1202A and subsequently deactivate CCS1 and activates CCS2 for time period 1204A during Cycle 1200A. The controller then at step 1104 activates CCS1 for time period 1202B and subsequently deactivate CCS1 and activates CCS2 for time period 1204B during Cycle 1200B. The two cycles 1200A and 1200B can be considered together to be a fine control period 1206. In this case, the time period 1202A and 1202B may comprise different time segments that are substantially similar. For instance, in some implementations, time period 1202A may comprise one additional time segment than time period 1202B. Similarly, time period 1204A may comprise one less time segment than time period 1204B such that Cycle 1200A and Cycle 1200B comprise the same number of time segments. As shown in FIG. 12A, the fine control period 1206 may be repeated continuously. In this case, since there are an equal number of Cycle 1200A and Cycle 1200B, the average number of time segments of activation of CCS1 would be the average number of time segments of time periods 1202A and 1202B. Similarly, the average number of time segments of activation of CCS2 would be the average number of time segments of time periods 1204A and 1204B.

As shown in FIG. 12A, the duty cycle of CCS1 during Cycle 1200A would be the time period 1202A divided by the time period of Cycle 1200A and the duty cycle of CCS1 during Cycle 1200B would be the time period 1202B divided by the time period of Cycle 1200B, which would typically be the same as the time period of Cycle 1200A. The duty cycle of CCS2 during Cycle 1200A would be the time period 1204A divided by the time period of Cycle 1200A and the duty cycle of CCS2 during Cycle 1200B would be the time period 1204B divided by the time period of Cycle 1200B. Therefore, the duty cycle of CCS1 and CCS2 would be slightly changed from Cycle 1200A and Cycle 1200B.

In one specific example, during Cycle 1200A, time period 1202A is 192 time segments and the duty cycle of CCS1 is 75% (=192/256) and time period 1204A is 64 time segments and the duty cycle of CCS2 is 25% (=64/256). In this example, during Cycle 1200B, time period 1202B is 193 time segments and the duty cycle of CCS1 is 75.4% (=193/256) and time period 1204B is 63 time segments and the duty cycle of CCS2 is 24.6% (=63/256). In this specific case, the average activation time period for CCS1 is 192.5 time segments or a duty cycle of 75.2% and the average activation time period for CCS2 is 63.5 time segments or a duty cycle of 24.8%. Therefore, the activation ratio is 192.5/63.5 or approximately 75.195/24.805.

Figure 11B:
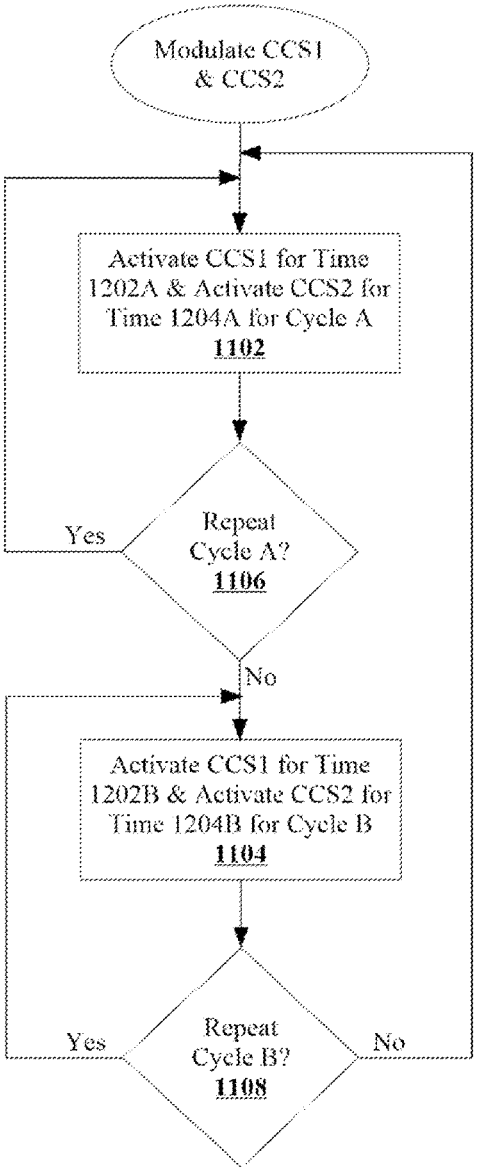
Figure 12B:
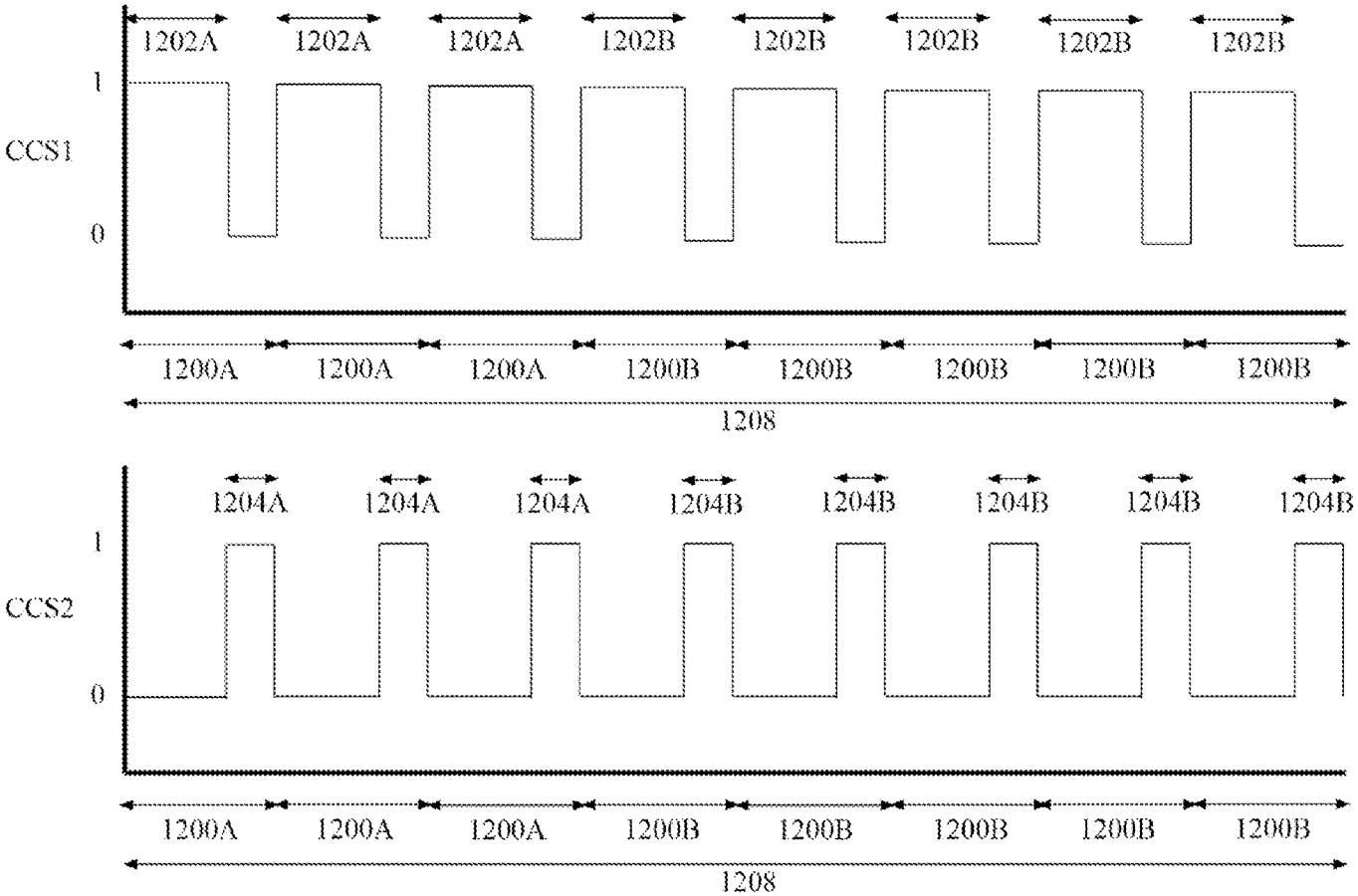

FIG. 11B is a flow chart illustrating a process similar to that of FIG. 11A but allowing for a plurality of a particular cycle within a fine control period. FIG. 12B is a signaling diagram illustrating a set of sample control signals resulting from the process of FIG. 11B. As shown in FIG. 11B, the controller controls CCS1 and CCS2 to complete Cycle 1200A at step 1102 and subsequently determines whether to repeat Cycle 1200A at step 1106. If the controller is to repeat Cycle 1200A, the controller repeats step 1102. If the controller is not to repeat Cycle 1200A, the controller controls CCS1 and CCS2 to complete Cycle 1200B at step 1104 and subsequently determines whether to repeat Cycle 1200B at step 1108. If the controller is to repeat Cycle 1200B, the controller repeats step 1104. If the controller is not to repeat Cycle 1200B, the controller returns to step 1102. In this embodiment, a fine control period comprises all of the Cycle 1200A and Cycle 1200B before a complete repeat of the full cycle. As shown in FIG. 12B, a fine control period 1208 may comprise a plurality of Cycle 1200A and a plurality of Cycle 1200B. In the specific example illustrated in FIG. 12B, the fine control period 1208 comprises three Cycle 1200A and five Cycle 1200B. The inclusion of multiples of each cycle within the fine control period allows for further increased precision. In this case, an average length of activation for CCS1 or average duty cycle is proportional to the number of time segments in each cycle and the number of each cycle. More generally, the activation period for CCS1 is equal to Number of $$AverageTS = \frac{a \times TS1 + b \times TS2}{c}$$

Where: a is the number of Cycle 1200A within the fine control period 1208;

TS1 is the number of time segments of activation in Cycle 1200A;

b is the number of Cycle 1200B within the fine control period;

TS2 is the number of time segments of activation in Cycle 1200B; and c is the total number of Cycles 1200A/1200B within the fine control period.

To calculate the average duty cycle, a similar formula can be used:

$$AverageDC = \frac{a \times DC1 + b \times DC2}{c}$$

Where: a is the number of Cycle 1200A within the fine control period 1208;

DC1 is the duty cycle for the signal in Cycle 1200A;

b is the number of Cycle 1200B within the fine control period;

DC2 is the duty cycle for the signal in Cycle 1200B; and c is the total number of Cycles 1200A/1200B within the fine control period.

In one specific example, during Cycle 1200A, time period 1202A is 192 time segments and the duty cycle of CCS1 is 75% and time period 1204A is 64 time segments and the duty cycle of CCS2 is 25%. In this example, during Cycle 1200B, time period 1202B is 193 time segments and the duty cycle of CCS1 is 75.4% and time period 1204B is 63 time segments and the duty cycle of CCS2 is 24.8%. In the specific case shown in FIG. 12B, the average activation time period for CCS1 would be (3×192+5×193)/8=192.625 and the average duty cycle would be (3×0.75+5×0.7539)/8=75.24% and the average activation time period for CCS2 would be (3×64+5×63)/8=63.375 and the average duty cycle would be (3×0.25+5×0.2461)/8=25.76%. Therefore, the activation ratio is 192.625/63.375 or approximately 75.24/24.76.

FIGS. 13A, 13B, 13C and 13D are flow charts illustrating processes implemented by a controller to set channel control signal (CCS) ratio values according to embodiments of the present invention. The determination of the CCS ratio could be directly provided to the controller in some embodiments but in most cases the controller receives other information and interprets the information and potentially looks up the CCS ratio based upon the interpreted information. In one embodiment depicted in FIG. 13A, the controller receives an indication of correlated color temperature (CCT) level desired for the lighting apparatus at step 1302. This information could be received in a wide variety of forms including, but not limited to, through a communication module coupled to connection 115 such as DMX interface 502, DALI interface 504, Zwave interface 506, ZigBee interface 508, Bluetooth interface 510, WiFi interface 514 or IR remote sense module 534. For instance, in the case of a DMX interface 502, a CCT level for the lighting apparatus may be indicated by a value on a particular DMX channel. Alternatively, a CCT level may be indicated using a color sense module 522 that feeds back information on the current CCT level in the vicinity of the lighting apparatus. In another embodiment, a dimmer may be used to provide a level indication that can be used by the controller as an indication of a desired CCT level. In one implementation, the primary dimmer 536 may indicate a CCT level for the lighting apparatus while, in some cases, the secondary dimmer 538 may indicate an intensity level for the lighting apparatus.

Based on the indication of the CCT level received by the controller at step 1302, the controller can look-up a CCS ratio that applies for that particular CCT level. In some implementations, the controller may comprise a look-up table with each indication of CCT level having a corresponding CCS ratio. In other cases, the look-up table may be contained within another element external to the controller that the controller can access. In some embodiments, the controller may not be aware of the particular CCT level that the indication of the CCT level corresponds to and simply looks up the CCS ratio in response to receiving the indication of the CCT level. In other cases, the controller may receive the CCT level as the indication of the CCT level and looks up the CCS ratio in response. Instead of looking up the CCS ratio, the controller may instead determine the CCS ratio based upon an internal algorithm using the CCT level indicated and knowledge of the particular CCT of white LEDs within each of the LED channels in the lighting module of the lighting apparatus. In this case, the controller may adjust the CCS ratio in response to feedback received from an outside indication of whether the desired CCT level is being output from the lighting apparatus. This feedback could be manual in which a user provides an indication of acceptability of the CCT level being output through connection 115. The feedback could also be automatic through a module such as color sense module 522 which could provide information corresponding to the CCT level of the lighting apparatus to the controller and the controller could interpret this information to determine whether the CCS ratio should be adjusted to achieve the desired CCT level for the lighting apparatus.

Once the controller determines the CCS ratio at step 1304, the controller can set the CCS ratio at step 1306. In this step, the controller can set the amount of time for activation of a first channel comprising white LEDs with a first color temperature by controlling the first channel control signal CCS1 compared to the amount of time for activation of a second channel comprising white LEDs of a second color temperature by controlling the second channel control signal CCS2. In essence, the controller can control the duty cycles of CCS1 and CCS2 to achieve the desired CCS ratio. Together, the activation time of CCS1 and CCS2 combined makes up the period of the channel control signals, which may be divided into a particular number of time segments as is previously described. In response to setting of the CCS ratio, the controller can cause a particular color temperature to be emitted from the lighting apparatus.

Although described as a CCS ratio, it should be understood that a CCS ratio may take many equivalent forms. In one case, the CCS ratio is a ratio between the time period of activation of a first channel control signal (CCS1) and a second channel control signal (CCS2) or a ratio between the duty cycle of CCS1 and the duty cycle of CCS2. In some embodiments, CCS1 and CCS2 are substantially opposite signals in which CCS1 is deactivated when CCS2 is activated and CCS2 is deactivated when CCS1 is activated. In some cases, the duty cycle of CCS1 and CCS2 total 100% or substantially close to 100%. In these cases, knowledge of the duty cycle of either CCS1 or CCS2 can lead to extrapolation of the other signals duty cycle and therefore the CCS ratio. Therefore, determining the CCS ratio may comprise determining a duty cycle for one or both of CCS1 and CCS2. The use of the indication of the CCT level could be used to determine a duty cycle for a duty cycle of one or both of CCS1 and CCS2 at step 1304 and the knowledge of the duty cycle of one of the signals can lead to the duty cycle of the other signal.

In some embodiments of the present invention, different channels in the lighting module may comprise LEDs with different lumen intensity characteristics. For instance, a first channel may comprise LEDs at a first color temperature that have a first flux binning level while a second channel may comprise LEDs at a second color temperature that have a second flux binning level, different than the first flux binning level. Different flux binning levels could result in different lumen levels output from the lighting apparatus when different CCS ratios are used. For instance, if the CCS ratio is a first CCS ratio that directs the controller to activate the first channel for more time than the second channel each cycle, a first lumen level may be output from the lighting apparatus; while, if the CCS ratio is a second CCS ratio that directs the controller to activate the second channel for more time than the first channel each cycle, a second lumen level may be output from the lighting apparatus. If the first flux binning level is higher than the second flux binning level, then the first lumen level associated with the first CCS ratio may be higher than the second lumen level associated with the second CCS ratio. In some implementations, a correction may be applied to the intensity level for the lighting apparatus so that consistent lumen levels can be output from the lighting apparatus independent of the CCS ratio that is used, and therefore the color temperature selected.

Figure 13A:
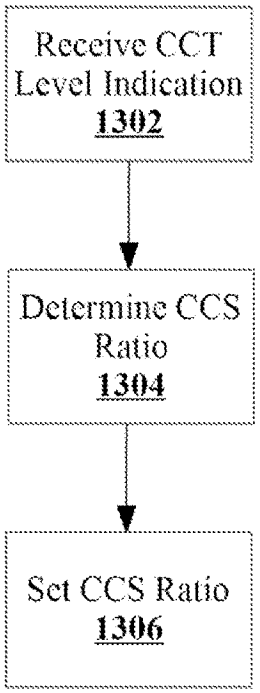
FIGS. 13A, 13B, 13C and 13D are flow charts illustrating processes implemented by a controller to set control signal ratio values according to embodiments of the present invention.
Figure 13B:
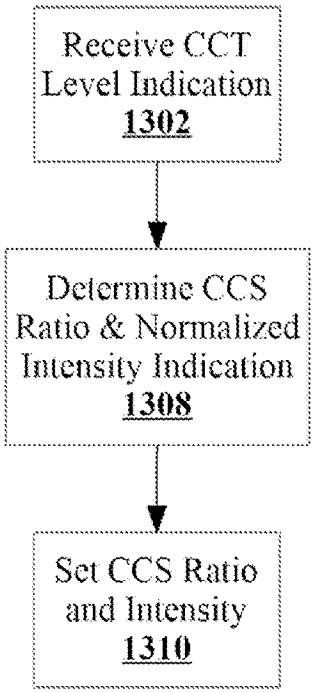

FIG. 13B depicts a flow chart illustrating a process that applies an intensity correction. As shown, the controller initially receives an indication of the CCT level at step 1302 similar to that of FIG. 13A. Subsequent to receiving the indication of the CCT level, the controller proceeds to look up a CCS ratio and intensity level that is associated with the indication of the CCT level at step 1308. The CCS ratio look up can be implemented similar to step 1304 described with reference to FIG. 13A and may be a look-up of a duty cycle for one or both of CCS1 and CCS2. The intensity level can be linked to the particular CCS ratio and indicate a normalized intensity indication. The normalized intensity indication may be a ratio between an intensity level desired for a particular CCT level relative to an intensity level desired for a reference CCT level. The reference CCT level may be any CCT level within the range of CCT levels possible for the lighting apparatus for which an intensity of light from the lighting apparatus is to be normalized and considered normal based on the intensity set for the lighting apparatus. The controller may use the normalized intensity indication to determine a CCT adjusted intensity level for the lighting apparatus, in some cases by multiplying the normalized intensity indication by an intensity level that has been set for the lighting apparatus. For example, at a first CCT level, the normalized intensity indication may be 0.98 while at a second CCT level, the normalized intensity indication may be 1.05. If the intensity level for the lighting apparatus is set to 60%, the controller may calculate a CCT adjusted intensity level of 58.8% if at the first CCT level and may calculate a CCT adjusted intensity level of 63% if at the second CCT level. Once the controller determines the CCS ratio and the normalized intensity indication at step 1308, the controller sets the CCS ratio as previously described at step 1306 in FIG. 13A and sets the intensity to the CCT adjusted intensity level at step 1310. The intensity may be set in a number of ways including, but not limited to, as described previously using opto isolator 216 to generate a virtual resistance across the dimming terminals connected to nodes 112, 114 of the constant current driver. In this case, the controller can determine the CCT adjusted intensity level and sets the virtual resistance across the dimming terminals connected to nodes 112, 114 to control the current output from the constant current driver to achieve the desired CCT adjusted intensity level. In some cases, the controller may detect the current output from the constant current driver and adjust the virtual resistance across the dimming terminals connected to nodes 112, 114 until the current output from the constant current driver is as expected to achieve the desired CCT adjusted intensity level. It should be understood that other techniques for adjusting the intensity level of the lighting apparatus may also be used.

In some embodiments of the present invention, the current output from the constant current driver may change based upon a control mechanism within the driver independent of the control apparatus. For instance, the constant current driver may have a 0-10V dim input such as dimming inputs 112, 114 that are coupled to a 0-10V dimmer and not to the control apparatus of the present invention. In this case, the voltage between the positive and negative rails 106, 108 may be adjusted to maintain a different constant current level depending on the detected 0-10V setting on the dimmer One skilled in the art would understand that there are numerous well-known dimming control mechanisms built into off-the-shelf constant current drivers including, but not limited to, interoperability with AC line dimmers such as TRIAC dimmers or Pulse Width Modulation (PWM) input dimmers or integration with building management systems deploying DMX, DALI, Zigbee, etc.

Figure 13C:
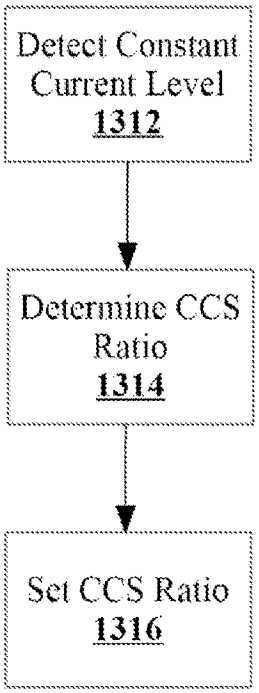

In some embodiments of the present invention as depicted in the flowchart of FIG. 13C, the controller may determine an indication of the current flowing from the constant current driver between the positive and negative rails 106, 108 at step 1312. This can be done in a number of manners. For instance, the controller could sample a voltage across a resistor such as current sense resistor 220 shown in FIG. 2C or current sense resistor 228 shown in FIG. 2D. The voltage across a known resistor can provide an indication of the current flowing through the resistor and therefore allow the controller to determine an indication of the input current to the control apparatus from the constant current driver. In some implementations of the present invention, the indication of the constant current level output by the constant current driver across the positive and negative rails 106, 108 may be used as an indication of the CCT level for the lighting apparatus to be output. In other embodiments, the indication of the constant current level may be a calculated value for the constant current level output by the driver or may be a representation of the constant current level or a voltage level across a resistor.

In some cases, the controller may use the indication of the constant current level output from the driver as a variable to look-up the CCS ratio at step 1314. In some implementations, the CCS ratio may be represented by a duty cycle for one or both of CCS1 and CCS2. In this case, the controller may access a table with indications of constant current levels corresponding to particular CCS ratios and the controller may use the indication of the constant current level output from the driver to determine a corresponding CCS ratio. In other cases, the indication of the constant current level output by the constant current driver may be used to look-up an indication of the CCT level for the lighting apparatus to be output. Subsequently, the indication of the CCT level derived from the indication of the constant current level output from the driver can be used to determine a corresponding CCS ratio. In some implementations, the CCS ratio may be represented by a duty cycle for one or both of CCS1 and CCS2. Once the CCS ratio is determined, the controller can set the CCS ratio by controlling the duty cycles of channel control signals CCS1, CCS2 at step 316, which may be implemented similar to that described with reference to step 1306.

A control apparatus implementing the steps depicted in FIG. 13C can be used as a dim-to-warm module within a lighting apparatus. In particular implementations, the table linking indications of constant current levels to CCS ratios (or duty cycles of channel control signals) can be configured to associate higher constant current levels to higher CCT levels and lower constant current levels to lower CCT levels. In one example case, a constant current driver may output up to a constant current level of 700 mA at maximum current and may be dimmed to a 10% dim level in which the constant current level would be 70 mA. In this case, the lighting module may comprise a first group of white LEDs at a high color temperature such as 5000K and a second group of white LEDs at a low color temperature such as 2000K. The controller may control activation of the first group of white LEDs with CCS1 and control activation of the second group of white LEDs with CCS2. In this case, the controller may A) associate an indication of a constant current level of 700 mA with a CCS ratio that activates the first group of white LEDs a majority of time during the cycle, potentially with a duty cycle of CCS1 of 90-100% and a duty cycle of CCS2 of 0-10%; B) associate an indication of a constant current level of 350 mA with a CCS ratio that activates both the first and second groups of white LEDs for approximately equal amounts of time during the cycle, potentially with a duty cycle of both CCS1 and CCS2 of 50%; and C) associate an indication of a constant current level of 70 mA with a CCS ratio that activates the second group of white LEDs a majority of time during the cycle, potentially with a duty cycle of CCS1 of 0-10% and a duty cycle of CCS2 of 90-100%. In these three particular scenarios, assuming light emitted from the first and second groups of white LEDs is configured to properly mix so the human eye combines the light, the lighting apparatus may emit light with mixed color temperatures approximately equal to 5000K, 3500K and 2000K respectively.

In the above example, a very simple linear curve was assumed linking constant current level with the CCS ratio and therefore the mixed color temperature emitted from the lighting apparatus. It should be understood that a wide selection of intensity/color temperature curves could be used and the rate at which the color temperature of a particular lighting apparatus goes lower or "warms" as the constant current level of the constant current driver is decreased may be faster or slower than a linear curve. Similarly, the rate at which the color temperature of a particular lighting apparatus goes higher or "cools" as the constant current level of the constant current driver is increased may be faster or slower than a linear curve. In some implementations, algorithms are used to provide logarithmic or exponential curves of constant current level to CCT level or CCS ratio.

Figure 13D:
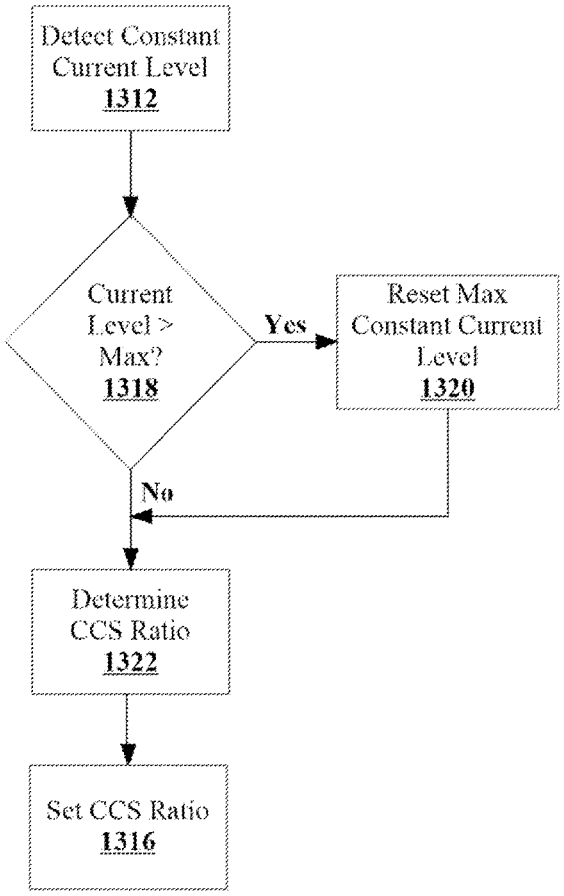

In some embodiments of the process of FIG. 13C, the controller compares the indication of the constant current level output from the driver determined at step 1312 to a reference value to determine a ratio of the determined constant current level output by the driver relative to the reference value. The reference value may be predetermined and may be an indication of a maximum constant current level for the constant current driver. In some cases, the ratio of the determined indication of the constant current level to the reference value may be used to look-up the CCS ratio rather than the actual value of the indication of the constant current level output by the driver. In some embodiments as illustrated in FIG. 13D, the controller may set the reference value as an indication of a maximum constant current level output from the driver based upon experience rather than from a preprogrammed condition. In this case, the maximum constant current level may be set to a maximum value for the indication of the constant current level that the controller has detected from the driver. If a higher constant current level is detected from the driver, the controller resets the reference value to an indication of the new maximum constant current level detected.

As shown in FIG. 13D, the controller determines an indication of the constant current level at step 1312 and subsequently, at step 1318, compares the indication of the constant current level currently being output by the driver to an indication of a maximum constant current level previously stored. If the constant current level currently being output by the driver is greater than the maximum constant current level previously stored, the controller resets the indication of the maximum constant current level to the indication of the constant current level currently being output by the driver at step 1320. Initially, an initial value for the previously stored value could be preprogrammed or, in some implementations, the indication of the maximum constant current level may be set with an initial determination of an indication of a constant current level output by the driver. Subsequent to steps 1318 and 1320, the controller determines a CCS ratio at step 1322 based upon the indication of the constant current level and the indication of the maximum constant current level. In one implementation, the controller determines a ratio of the indication of the constant current level and the indication of the maximum constant current level and uses this ratio to determine a corresponding CCS ratio. The controller may use the ratio in a look-up table to determine a corresponding CCS ratio (potentially represented by a duty cycle for one or both of CCS1 and CCS2 in some embodiments) or may apply an algorithm to convert the ratio of current levels to a CCS ratio.

For example, if the indication of the constant current level output by the driver is approximately 25% of the indication of the maximum constant current level, the controller may determine that the CCS ratio correspond to a duty cycle of 25% for CCS1 compared to a duty cycle of 75% for CCS2, therefore potentially causing the light emitted by the lighting apparatus to be a low CCT or "warm" color temperature relative to other color temperatures possible to be emitted by the lighting apparatus. In another example, if the indication of the constant current level output by the driver is approximately 95% of the indication of the maximum constant current level, the controller may determine that the CCS ratio correspond to a duty cycle of 95% for CCS1 compared to a duty cycle of 5% for CCS2, therefore potentially causing the light emitted by the lighting apparatus to be a high CCT or "cool" color temperature relative to other color temperatures possible to be emitted by the lighting apparatus.

Figure 13E:
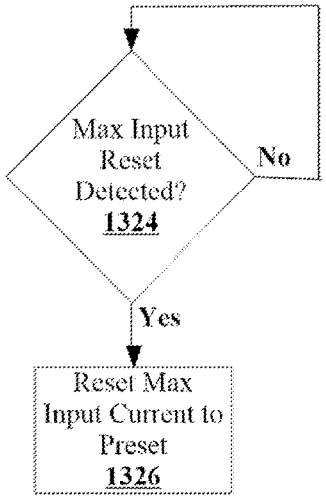
FIG. 13E is a flow chart illustrating a process implemented by a controller to reset a maximum current level set according to an embodiment of the present invention.

FIG. 13E is a flow chart illustrating a process implemented by a controller to reset a maximum constant current level set. As shown, in this process, the controller monitors for a reset indication for the indication of the maximum constant current level at step 1324 and, if a reset is detected, the controller resets the indication of the maximum constant current level to a preset or default level. In some cases, there are no preset initial levels but instead the controller utilizes the initial constant current level as the initial setting. The resetting of the indication of the maximum constant current level may be required especially if a user uses a control apparatus in a first lighting apparatus and then moves the control apparatus into a second lighting apparatus. If the constant current driver of the first lighting apparatus could operate at a higher maximum constant current level than the constant current driver of the second lighting apparatus, configuration errors could occur without a reset. If no reset was implemented, the controller could mistakenly consider the constant current level of the driver in the second lighting apparatus to be in a dimmed state even if operating at its maximum constant current level. As a result, the controller may determine an incorrect desired CCT level and/or CCS ratio using a reference value that is too high. Once the indication of the maximum constant current level is reset, the controller can set the reference value to the highest constant current level detected from the constant current driver of the second lighting apparatus, ignoring the previous information from when the controller was installed in the first lighting apparatus.

The reset of the indication of the maximum constant current level may take one of many forms. In one implementation, a button may be designed into the controller for a user to press to reset the reference value. In another implementation, two connector pins that are being monitored could be shorted together, indicating a reset mode to the controller. In other embodiments, the controller may receive a reset command via a control interface, for example an IR remote command. In yet further implementations, the controller may reset the reference value periodically, upon each controller activation or after a set period of not being activated. Other techniques for triggering a reset of the reference value by the controller may be contemplated.

In some embodiments of the present invention, a dim-to-warm module as described may be implemented within a simple encasement in which the positive and negative rails 106, 108 of the constant current driver are the only inputs to the module and the rails 116, 118A, 118B of FIG. 3A or rails 116A, 116B, 118 of FIG. 3B are the only outputs of the module. In this case, the control apparatus is powered by the positive and negative rails 106, 108 while the control apparatus monitors the constant current level flowing across the positive and negative rails 106, 108 and while the control apparatus is selectively coupling groups of LEDs to the positive and negative rails 106, 108 to activate the groups of LEDs to generate a particular color temperature of emitted light from the lighting apparatus. This module can be implemented without additional auxiliary power inputs or external control signaling for selecting the color temperature or setting the mixes of color temperatures.

Although the description of FIGS. 13C and 13D were focused on implementations of dim-to-warm modules, it should be understood that the processes described could be used for other purposes. For instance, the control apparatus could operate differently and adjust the CCS ratio to cause the lighting apparatus to output a particular color temperature of emitted light that is cooler as the constant current level output by the constant current driver decreases (i.e. dim-to-cool). This change can be adjusted by simply coupling a different group of LEDs to each output terminals of the control apparatus. Another implementation could allow for a plurality of different lighting modules implemented in a plurality of different lighting apparatus to be coupled to the output terminals of the control apparatus. In this case, as the CCS ratio is adjusted in response to monitoring of the constant current level output from the constant current driver, intensity of light output by the plurality of lighting apparatus could shift from one lighting apparatus to another lighting apparatus. This transition could be in combination with a shift in color temperature but could also take place while maintaining the color temperature consistent. For instance, as a constant current level of the constant current driver is decreased, the control apparatus could shift the ratio of the current from one light fixture to another light fixture. For example, in one application, illumination in an area could adjust from a light illuminating an ambient area to a light used for specific tasks as the constant current level of the constant current driver is decreased. In another application, illumination in an area could adjust from a task light to a night light as the constant current level of the constant current driver is decreased. One skilled in the art would understand that many other applications for controlling a plurality of channels in response to changes in the constant current level of a driver could be implemented using the present invention.

Although the embodiments of the present invention described are directed to the use of a lighting module as the load module, in some cases, the present invention could be implemented in other technology areas outside of lighting. The embodiments of the present invention generally are applicable to any technology in which a constant current driver is utilized to power a load module that is selectively coupled to the driver. The control apparatus may be used to selectively couple a wide selection of load modules to constant current drivers. These load modules may include, but are not limited to, audio modules, video modules, computing modules, sensing modules, geo-positioning modules, household appliance modules, and gaming modules.

Although various embodiments of the present invention have been described and illustrated, it will be apparent to those skilled in the art that numerous modifications and variations can be made without departing from the scope of the invention, which is defined in the appended claims.

The invention claimed is:

1. A control apparatus adapted to be coupled between a power source and a lighting module; wherein the power source is operable to generate an output voltage at a power source output; and, if the lighting module is coupled to the power source output, the power source is operable to generate a first output voltage to maintain a constant current level flowing through the lighting module; and, if the lighting module is not coupled to the power source output, the power source is operable to generate a second output voltage at a maximum voltage limit; the control apparatus comprising:

a buffer load module with a forward voltage less than the maximum voltage limit if current at the constant current level is flowing through the buffer load module; and a controller operable to selectively couple the lighting module to the power source output; wherein, after a period of deactivation in which the lighting module is not coupled to the power source output and the power source is generating the second output voltage at the maximum voltage limit, the controller is operable to selectively couple the buffer load module to the power source output during a buffer mode and subsequently to couple the lighting module to the power source; wherein the output voltage generated by the power source is reduced from the maximum voltage limit during the buffer mode.

2. A control apparatus according to claim 1 further comprising a voltage control module adapted to be coupled to the power source output and operable to convert the output voltage generated by the power source to a controlled voltage independent of whether the output voltage generated by the power source is the first output voltage or the second output voltage; wherein the voltage control module has a maximum input voltage equal to or greater than the maximum voltage limit of the power source; and wherein the controller is powered by the controlled voltage.

3. The control apparatus according to claim 1 further comprising a first switching element adapted to be coupled between the power source output and the buffer load module and operable to be activated and deactivated in response to a buffer control signal; and a second switching element adapted to be coupled between the power source output and the lighting module and operable to be activated and deactivated in response to a channel control signal; and wherein the controller is operable to generate the buffer control signal and the channel control signal; whereby the controller is operable to activate the first switching element using the buffer control signal to couple the buffer load module to the power source output during the buffer mode.

4. The control apparatus according to claim 3, wherein the controller is operable to selectively couple the buffer load module to the power source output for a buffer time period in each of a plurality of cycles during the buffer mode, wherein the buffer time periods over the plurality of cycles during the buffer mode are controlled by a duty cycle of the buffer control signal.

5. The control apparatus according to claim 4, wherein the duty cycle of the buffer control signal increases over the plurality of cycles during the buffer mode; whereby the buffer time periods increase over the plurality of cycles during the buffer mode.

6. The control apparatus according to claim 4, wherein the duty cycle of the buffer control signal increases over a plurality of cycles during a first phase of the buffer mode and the duty cycle of the buffer control signal decreases over a plurality of cycles during a second phase of the buffer mode; whereby the buffer time periods increase over the plurality of cycles during the first phase of the buffer mode and decrease over the plurality of cycles during the second phase of the buffer mode.

7. The control apparatus according to claim 6, wherein the controller is operable to selectively couple the lighting module to the power source output for a channel time period in each of the plurality of cycles during the second phase of the buffer mode, wherein the channel time periods over the plurality of cycles during the second phase of the buffer mode are controlled by a duty cycle of the channel control signal; wherein the duty cycle of the channel control signal increases over the plurality of cycles during the second phase of the buffer mode; whereby the channel time periods increase over the plurality of cycles during the second phase of the buffer mode.

8. The control apparatus according to claim 7, wherein the buffer control signal and the channel control signal are substantially opposite during the second phase of the buffer mode; whereby the second switching element is deactivated when the first switching element is activated and the first switching element is deactivated when the second switching element is activated.

9. The control apparatus according to claim 6, wherein the second switching element is adapted to be coupled between the power source output and a first group of LEDs of the lighting module; the channel control signal is a first channel control signal; and the control apparatus further comprises a third switching element adapted to be coupled between the power source output and a second group of LEDs of the lighting module and operable to be activated and deactivated in response to a second channel control signal; and wherein the controller is operable to select one of the first and second groups of LEDs to selectively couple to the power source output during the buffer mode; and wherein the controller is operable to selectively couple the selected group of LEDs to the power source output for a channel time period in each of the plurality of cycles during the second phase of the buffer mode; wherein the channel time periods over the plurality of cycles during the second phase of the buffer mode are controlled by a duty cycle of the channel control signal corresponding to the selected group of LEDs; wherein the duty cycle of the channel control signal corresponding to the selected group of LEDs increases over the plurality of cycles during the second phase of the buffer mode; whereby the channel time periods increase over the plurality of cycles during the second phase of the buffer mode.

10. The control apparatus according to claim 9, wherein the controller is operable to receive an indication of a desired color temperature for light emitted from the lighting module and the controller uses the indication of the desired color temperature to select one of the first and second groups of LEDs to selectively couple to the power source output during the buffer mode.

11. A method of coupling a power source to a lighting module, wherein the power source is operable to generate an output voltage at a power source output; and, if the lighting module is coupled to the power source, the power source is operable to generate a first output voltage to maintain a constant current level flowing through the lighting module; and, if the lighting module is not coupled to the power source, the power source is operable to generate a second output voltage at a maximum voltage limit; the method comprising:

after a period of deactivation in which the lighting module is not coupled to the power source output and the power source is generating the second output voltage at the maximum voltage limit, selectively coupling a buffer load module to the power source output during a buffer mode, the buffer load module with a forward voltage less than the maximum voltage limit if current at the constant current level is flowing through the buffer load module; and subsequently coupling the lighting module to the power source output; wherein the output voltage generated by the power source is reduced from the maximum voltage limit during the buffer mode.

12. The method according to claim 11 further comprising generating a buffer control signal for controlling coupling between the power source output and the buffer load module and a channel control signal for controlling coupling between the power source output and the lighting module; and wherein selectively coupling the buffer load module to the power source output is for a buffer time period in each of a plurality of cycles during the buffer mode, wherein the buffer time periods over the plurality of cycles during the buffer mode are controlled by a duty cycle of the buffer control signal.

13. The method according to claim 12, wherein the duty cycle of the buffer control signal increases over the plurality of cycles during the buffer mode; whereby the buffer time periods increase over the plurality of cycles during the buffer mode.

14. The method according to claim 12, wherein the duty cycle of the buffer control signal increases over a plurality of cycles during a first phase of the buffer mode and the duty cycle of the buffer control signal decreases over a plurality of cycles during a second phase of the buffer mode; whereby the buffer time periods increase over the plurality of cycles during the first phase of the buffer mode and decrease over the plurality of cycles during the second phase of the buffer mode.

15. The method according to claim 14 further comprising selectively coupling the lighting module to the power source output for a channel time period in each of the plurality of cycles during the second phase of the buffer mode, wherein the channel time periods over the plurality of cycles during the second phase of the buffer mode are controlled by a duty cycle of the channel control signal; wherein the duty cycle of the channel control signal increases over the plurality of cycles during the second phase of the buffer mode; whereby the channel time periods increase over the plurality of cycles during the second phase of the buffer mode.

16. The method according to claim 15, wherein the buffer control signal and the channel control signal are substantially opposite during the second phase of the buffer mode; whereby the lighting module is not coupled to the power source output when the buffer load module is coupled to the power source output and the buffer load module is not coupled to the power source output when the lighting module is coupled to the power source output.

17. The method according to claim 14, wherein generating a channel control signal for controlling coupling between the power source output and the lighting module comprises generating a first channel control signal for controlling coupling between the power source output and a first group of LEDs of the lighting module and generating a second channel control signal for controlling coupling between the power source output and a second group of LEDs of the lighting module;

wherein the method further comprises selecting one of the first and second groups of LEDs to selectively couple to the power source output during the buffer mode; and selectively coupling the selected group of LEDs to the power source output for a channel time period in each of the plurality of cycles during the second phase of the buffer mode, wherein the channel time periods over the plurality of cycles during the second phase of the buffer mode are controlled by a duty cycle of the channel control signal corresponding to the selected group of LEDs; wherein the duty cycle of the channel control signal corresponding to the selected group of LEDs increases over the plurality of cycles during the second phase of the buffer mode; whereby the channel time periods increase over the plurality of cycles during the second phase of the buffer mode.

18. The method according to claim 17 further comprising receiving an indication of a desired color temperature for light emitted from the lighting module; and wherein the indication of the desired color temperature is used in selecting one of the first and second groups of LEDs to selectively activate during the buffer mode.

19. A system adapted to be coupled to a lighting module comprising:

a power source operable to generate an output voltage at a power source output; and, if the lighting module is coupled to the power source output, the power source operable to generate a first output voltage to maintain a constant current level flowing through the lighting module; and, if the lighting module is not coupled to the power source output, the power source operable to generate a second output voltage at a maximum voltage limit;

a buffer load module with a forward voltage less than the maximum voltage limit if current at the constant current level is flowing through the buffer load module; and a controller operable to selectively couple the lighting module to the power source output; wherein, after a period of deactivation in which the lighting module is not coupled to the power source output and the power source is generating the second output voltage at the maximum voltage limit, the controller is operable to selectively couple the buffer load module to the power source output during a buffer mode and subsequently to couple the lighting module to the power source; wherein the output voltage generated by the power source is reduced from the maximum voltage limit during the buffer mode.

20. A lighting apparatus incorporating the system according to claim 19 further comprising the lighting module, the lighting module comprising a first group of LEDs comprising one or more first LEDs of a first type coupled in series and a second group of LEDs comprising one or more second LEDs of a second type different than the first type coupled in series; and wherein, subsequent to completion of the buffer mode, the controller is operable to selectively couple the first and second groups of LEDs to the power source output at different time segments within a cycle.

* * * * *